US006609342B2

(12) United States Patent
Hikai

(10) Patent No.: US 6,609,342 B2
(45) Date of Patent: Aug. 26, 2003

(54) SEALING MEMBER AND SIDING BOARDS ATTACHMENT STRUCTURE

(75) Inventor: Satoshi Hikai, Nagoya (JP)

(73) Assignee: Nichiha Co., Ltd., Nagoya (JP)

( * ) Notice: Subject to any disclaimer, the term of this patent is extended or adjusted under 35 U.S.C. 154(b) by 0 days.

(21) Appl. No.: 09/924,486

(22) Filed: Aug. 9, 2001

(65) Prior Publication Data

US 2002/0020130 A1 Feb. 21, 2002

(30) Foreign Application Priority Data

Aug. 10, 2000 (JP) ..... 2000-243172
Sep. 11, 2000 (JP) ..... 2000-275360

(51) Int. Cl.[7] ..... E04B 9/00

(52) U.S. Cl. ..... 52/506.01; 52/506.09; 52/520; 52/533

(58) Field of Search ..... 52/518, 520, 533, 52/235, 713, 506.09, 508, 506.1, 512, 302.4, 58, 97, 698, 327, 506.5, 506.01, 387; 277/590

(56) References Cited

U.S. PATENT DOCUMENTS 2,618,145 A * 11/1952 Sinner et al. ..... 52/509
2,853,870 A * 9/1958 Sinner et al. ..... 52/378
3,990,199 A * 11/1976 Gallo ..... 52/137
4,010,589 A * 3/1977 Gross ..... 52/489.1
4,263,764 A * 4/1981 Wendt ..... 52/481.2
4,516,373 A * 5/1985 Osawa ..... 52/387
4,523,413 A * 6/1985 Koppenberg ..... 52/139
4,685,263 A * 8/1987 Ting ..... 52/235
5,809,729 A * 9/1998 Mitchell ..... 52/474
5,953,865 A * 9/1999 Rickards ..... 52/139
6,079,164 A * 6/2000 Lanzani ..... 52/127.1
6,253,511 B1 * 7/2001 Boyer ..... 52/302.4
6,266,937 B1 * 7/2001 Watanabe ..... 52/489.2
6,298,616 B1 * 10/2001 Mitchell et al. ..... 52/235
6,315,489 B1 * 11/2001 Watanabe ..... 403/381
6,324,807 B1 * 12/2001 Ishiko ..... 52/506.01

FOREIGN PATENT DOCUMENTS

| | | | |
|---|---|---|---|
| IT | 479733 | * | 4/1992 |
| JP | 02136463 | * | 5/1990 |
| JP | 5-32558 | | 4/1993 |
| JP | 6-307059 | | 11/1994 |
| JP | 8-302954 | | 11/1996 |
| JP | 2000-64556 | | 2/2000 |

* cited by examiner

*Primary Examiner*—Lanna Mai
*Assistant Examiner*—John Fitzgerald
(74) *Attorney, Agent, or Firm*—Oblon, Spivak, McClelland, Maier & Neustadt, P.C.

(57) ABSTRACT

A sealing member and fastening fitting are arranged at a joint portion of four siding boards of a shiplap structure. The sealing member comprises a base plate portion, a horizontally rising plate portion at left and right sides of the base plate portion, and an inclined portion bent diagonally downwardly from the horizontally rising plate portion. At the base plate portion, a forward protrusion is provided upwardly of the horizontally rising plate portion. A storage recess, having a width substantially equal to the width of a fastening fitting, is formed between the left and right forward protrusions. Lateral elastic materials cover portions of the horizontally rising plate portion, the inclined portion, and the forward protrusion. The sealing member is of easy and stable construction and reliably prevents rain water penetration. A siding boards attachment structure uses the sealing member and a method of constructing the siding boards attachment structure is provided.

27 Claims, 40 Drawing Sheets

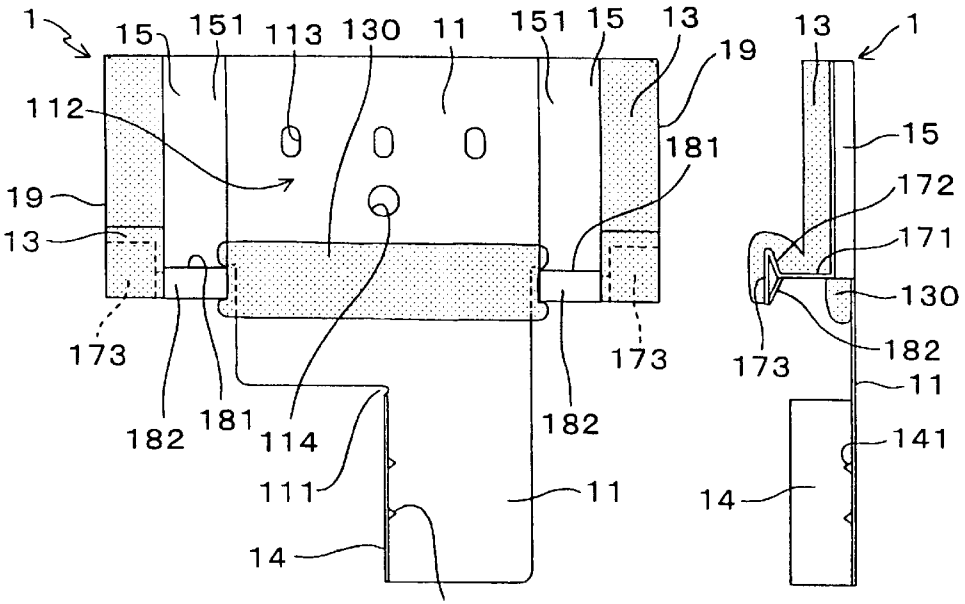
FIG.24C
FIG.24A
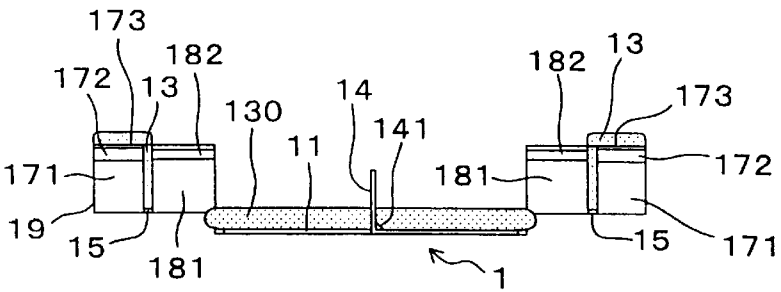
FIG.24B

PRIOR ART

PRIOR ART

SEALING MEMBER AND SIDING BOARDS ATTACHMENT STRUCTURE

CROSS-REFERENCES TO RELATED APPLICATIONS

The present application claims priority under 35 U.S.C. §119 to Japanese Patent Application No. 2000-243172, filed on Aug. 10, 2000, entitled "SEALING MEMBER AND SIDING BOARDS ATTACHMENT STRUCTURE" and Japanese Patent Application No. 2000-275360, filed on Sep. 11, 2000, entitled "SEALING MEMBER AND SIDING BOARDS ATTACHMENT STRUCTURE". The contents of these applications are incorporated herein by reference in their entirety.

BACKGROUND OF THE INVENTION

1. Field of the Invention

The present invention relates to a sealing member arranged at the back of a fastening fitting for mounting a siding board with a four side (left, right, upper and lower sides) shiplap structure on an underlayment (for instance furring strip); and a siding boards attachment structure and a method of attaching siding boards using the sealing member.

2. Discussion of the Background

Conventionally, there has been well known a siding boards attachment structure 9 using a siding board 2 having a four side (left, right, upper and lower sides) shiplap structure as shown in FIG. 38.

That is, the siding board 2 has an upper underlying tongue portion 22 and a lower overlying tongue portion 21 and a lateral underlying tongue portion 24 and a lateral overlying tongue portion 23 provided at its left and right sides (refer to FIG. 5). During construction, the lower overlying tongue portion 21 of the upper siding board 2 is superimposed on the upper underlying tongue portion 22 of the lower siding board 2, and a lateral overlying tongue portion 23 of the right siding board 2 is superimposed on a lateral underlying tongue portion 24 of the left siding board 2.

In the siding boards attachment structure 9, as shown in FIG. 38 and FIG. 39, a fastening fitting 5 is disposed at a corner portion 25 of each of the siding boards 2, and such each siding board 2 is fixed to the underlayment 3 (for instance furring strips). The fastening fitting 5 has a fixing plate portion 51 abutting against the rear side surface 26 of the siding boards 2 arranged vertically; a supporting portion 52 erected forward over the full width of the fixing plate portion 51; an upper board engaging portion 53 bent diagonally upward from a front end 521 of the supporting portion 52; a lower board engaging portion 54 bent diagonally downward from the front end 521 of the supporting portion 52; and a front flat plate 57 continuously provided between tip ends of the upper board engaging portion 53 and a lower board engaging portion 54.

The fixing plate portion 51 has a step portion 55 retracted diagonally backward at its upper end, and has a bent portion 56 bent backward by approximately 90 degrees at its bottom portion. A screw hole 512 for inserting a screw 4 to be fixed to the underlayment 3 is formed at the fixing plate portion 51 (Refer to FIG. 4A).

The fastening fitting 5 fixes the upper and lower siding boards 2 to the underlayment 3 by using the screw 4, as shown in FIG. 38 and FIG. 39. That is, the lower board engaging portion 54 is engagingly locked with the upper underlying tongue portion 22 of the lower siding board 2, the upper siding board 2 is supported by the supporting portion 52, and the upper board engaging portion 53 is engagingly locked with the lower overlying tongue portion 21 of the upper siding board 2.

The shapes of the upper underlying tongue portion 22 and lower overlying tongue portion 21 of the siding board 2 are as described in detail in the following Embodiment 1 (Refer to FIG. 7). A state in which the upper board engaging portion 53 and the lower board engaging portion 54 in the fastening fitting 5 engagingly locks the lower overlying tongue portion 21 and upper underlying tongue portion 22 of the siding board 2 is as described in detail in the following Embodiment 1 (Refer to FIG. 11).

As shown in FIG. 38 and FIG. 39, a caulking material 29 is attached on the upper underlying tongue portion 22 and the lateral underlying tongue portion 24 of the siding board 2. Over this caulking material 29, the lower overlying tongue portion 21 or lateral overlying tongue portion 23 of another siding board 2 is superimposed to press the caulking material 29, thereby preventing water penetration from a joint clearance portion 27 of each siding board 2 into a siding boards attachment structure 9.

In a siding boards attachment structure 9 of the four side shiplap structure 9, as shown in FIG. 38 and FIG. 39, the caulking material 29 is covered with the lower overlying tongue portion 21 or lateral overlying tongue portion 23, and is not exposed forward of the siding board. Therefore, a siding boards attachment structure having an excellent outward appearance design properties can be obtained.

However, although the caulking material 29 is attached on the siding boards attachment structure 9, there has been a problem that it is difficult to reliably prevent water penetration because of disadvantages described below.

In the siding boards attachment structure 9, the fastening fitting 5 is arranged at a portion which is a joint portion of the upper and lower siding boards 2 and the left and right siding boards 2, that is, at a portion at which the corner portions 25 of four siding boards 2 are disposed to be opposed to each other (FIG. 38). As shown in FIG. 38 and FIG. 39, the supporting portion 52 and the front flat plate 57 of the fastening fitting 5 are disposed between the lower overlying tongue portion 21 of the upper siding board 2 and the upper underlying tongue portion 22 of the lower siding board 2.

Thus, the caulking material 29 attached on the lateral underlying tongue portion 24 of the upper and lower siding boards 2 is not continuous over the upper and lower siding boards 2, and is cut off at the lower and upper portions of the supporting portion 52 and front flat plate 57 (FIG. 38 and FIG. 39).

As shown in FIG. 39 and FIG. 40, when rain water 6 penetrates from the joint clearance portion 27 of the left and right siding boards 2, the rain water 6 is inhibited from movement in the transverse direction (in the right direction in FIG. 39 and FIG. 40) by means of the caulking material 29, and drops downward through the joint clearance portion 27.

Then, the rain water 6 passes through a front face of the front flat plate 57 of the fastening fitting 5, and further, moves down to the joint clearance portion 27 which provided downward.

However, there is a possibility that a part of the rain water 6 flows laterally through the front face of the front flat plate 57, as shown in FIG. 39 and FIG. 40, drops to the upper underlying tongue portion 22 of the lower siding board 2 from a side end 59, and further, penetrates the rear side of the siding board 2.

In addition, a part of the rain water 6 that has moved laterally through the front flat plate 57 travels over the upper board engaging portion 53, and further, moves over the supporting portion 52, and then, moves to both side ends 59 thereof. This rain water 6 penetrates the rear side of the siding board 2 from the side end 59 of the fastening fitting 5 as well.

In this manner, corrosion and degradation of the siding board 2 or underlayment 3 may occur.

The rain water 6 penetrating from the joint clearance portion 270 between the upper and lower siding boards 2 is inhibited from moving upward by a lateral caulking material 29 attached on the upper underlying tongue portion, and is discharged forward (FIG. 39 and FIG. 40).

SUMMARY OF THE INVENTION

An object of the present invention to provide a sealing member capable of reliably preventing rain water penetration and achieving easy and stable construction using the sealing member, and a siding boards attachment structure and a method of attaching siding boards in the siding boards attachment structure of a four side (left, right, upper and lower sides) shiplap structure.

According to one aspect of the invention, there is provided a sealing member arranged at the back of a fastening fitting disposed at the upper, lower, left and right joint portion of four siding boards of a four side (left, right, upper and lower sides) shiplap structures, including:

a base plate portion fixed to an underlayment, a pair of horizontally rising plate portions provided at the left and right sides of the base plate portion and erected forward in a horizontal direction, and an inclined portion bent diagonally downward from front ends of the horizontally rising plate portion, wherein the base plate portion provides forward protrusions that protrude forward at the upward portion of the left and right horizontally rising plate portions, wherein a storage recess having a width substantially equal to the width of the fastening fitting is formed between the left and right forward protrusions, and wherein lateral elastic materials are arranged at top faces of the horizontally rising plate portion and the inclined portion and at front face of the forward protrusion.

As described above, the forward protrusion is provided at the base plate portion in the sealing member, and a storage recess having a width substantially equal to the width of the fastening fitting is formed between the left and right forward protrusion.

Therefore, when the sealing member is used together with the fastening fitting, the fastening fitting can be kept and placed at the recess (Refer to FIG. 4B). In this manner, during construction, the sealing member and the fastening fitting can be easily disposed.

The storage recess has a width substantially equal to the width of the fastening fitting. Thus, when the fastening fitting is disposed at the storage recess, a displacement between them can be prevented. Therefore, the sealing member and the fastening fitting can be easily and stably fixed to the underlayment.

As described above, a lateral elastic material is arranged at top faces of the horizontally rising plate portion and the inclined portion of the sealing member and at the front face of the forward protrusion. Thus, in the case where a siding boards attachment structure is constructed by using the sealing member, the lateral elastic material comes into close contact with the rear side surface and lower overlying tongue portion of the siding board.

Therefore, even if rain water penetrates into a longitudinal joint clearance portion of the two upper left and right siding boards, i.e., into a clearance between the lateral underlying tongue portion and the lateral overlying tongue portion, such rain water does not penetrate into the siding boards attachment structure. A description of this principle will be given below.

That is, the rain water penetrating the inside of the joint clearance portion is inhibited from lateral movement by means of the caulking material, and drops downwardly through the joint clearance portion. Then, the rain water passes through the front face of the front flat plate of the fastening fitting, and further, moves down to the joint clearance portion which provided downward and drops.

A part of the rain water moving laterally through the front flat plate travels over the upper board engaging portion, and further, moves over the supporting portion, and then moves to both side ends thereof.

However, as described above, the lateral elastic material provided at the sealing member is in close contact with the lower overlying tongue portion and the rear side surface of the siding board, at the left and right of both side ends of the fastening fitting.

Thus, even if rain water penetrates into the joint clearance portion, such rain water is dammed by the lateral elastic material (Refer to FIG. 17 to FIG. 19). That is, the rain water moving in the lateral direction through the front flat plate is dammed by the lateral elastic material that is in close contact with the lower overlying tongue portion of the siding board. Even if rain water moves to the top face of the supporting portion or penetrates between the siding board and the fixing plate portion of the fastening fitting, such rain water is dammed by the lateral elastic material that is in close contact with the lower overlying tongue portion and the rear side surface of the siding board.

In this way, by using the sealing member, the rain water can be reliably prevented from penetrating the inside of the siding boards attachment structure, and corrosion or degradation of the siding board or the underlayment and the like can be reliably prevented.

The lateral elastic material is disposed at the forward protrusion that protrudes forward from the base plate portion. Thus, the lateral elastic material can be brought into close contact with the rear side surface of the siding board without particularly increasing the thickness of the elastic material. Therefore, an inexpensive sealing member can be obtained by reducing the thickness of the lateral elastic material.

As described above, according to the present invention, in a siding boards attachment structure of the four side shiplap structure, there can be provided a sealing member capable of reliably preventing rain water, and capable of achieving easy and stable construction.

According to another aspect of the invention, there is provided a siding boards attachment structure of a four side (left, right, upper and lower sides) shiplap structure capable of disposing the siding board on the underlayment by using the sealing member and the fastening fitting, wherein the fastening fitting includes a fixing plate portion abutting against the rear side surfaces of siding boards arranged vertically, a supporting portion erected forward over a full width of the fixing plate portion, an upper board engaging portion bent diagonally upward from a front end of the supporting portion, a lower board engaging portion bent diagonally downward from a front end of the supporting portion, and a front flat plate continuously provided between the tip end of the upper board engaging portion and the tip end of the lower board engaging portion, wherein the sealing member and the fastening fitting disposed at a storage recess of the sealing member are fixed to the underlayment together by means of a fastening, wherein in the two adjacent siding boards disposed downward of the fastening fitting, an upper underlying tongue portion is engagingly locked with the lower board engaging portion of the fastening fitting and an inclined portion of the sealing member, wherein in the two adjacent siding boards disposed upward of the fastening fitting, a lower overlying tongue portion is placed on the supporting portion of the fastening fitting and is engagingly locked with an upper board engaging portion, wherein in the siding board, caulking materials are attached on the front faces of the upper underlying tongue portion and the lateral underlying tongue portion or on the rear faces of the lower overlying tongue portion and the lateral overlying tongue portion, and wherein the lateral elastic material of the sealing member is in close contact with the rear side surface and the lower overlying tongue portion of the siding board (Refer to FIG. 10).

In the siding boards attachment structure, the fastening fitting is kept and placed at the storage recess, and thus, a displacement between the fastening fitting and the sealing member can be prevented. Therefore, the sealing member and the fastening fitting can be easily and stably fixed to the underlayment.

The lateral elastic material is arranged at the forward protrusion that protrudes forward from the base plate portion. Thus, the lateral elastic material can be brought into close contract with the rear side surface of the siding board without particularly increasing the thickness of the lateral elastic material.

Further, in the siding boards attachment structure, the lateral elastic material of the sealing member is in close contact with the rear side surface and lower overlying tongue portion of the siding board.

Thus, as described above, the rain water can be reliably prevented from penetrating the inside of the siding boards attachment structure, and corrosion or degradation of the siding board or underlayment and the like can be reliably prevented.

As described above, according to the present invention, there can be provided the siding board attachment structure of the four side shiplap structure capable of reliably preventing rain water penetration and achieving easy and stable construction.

According to another aspect of the invention, there is provided a method for constructing the siding boards attachment structure as described below.

That is, the method of attaching siding boards includes the first to sixth steps of:

a first step of disposing a first siding board at an underlayment;

a second step of jointing a lateral overlying tongue portion of a second siding board with a lateral underlying tongue portion of the first siding board through a left-right side shiplap joint, and disposing the second siding board at the underlayment;

a third step of inserting a base plate portion of the sealing member and a fixing plate portion of the fastening fitting between the underlayment and the siding board in the state of that the fastening fitting is disposed at a storage recess of the sealing member;

a fourth step of engagingly locking a lower board engaging portion of the fastening fitting to an upper underlying tongue portion of the siding board, and abutting the horizontally rising plate portion and the inclined portion of the sealing member against an upper underlying tongue portion of the siding board, thereby fixing the sealing member and fastening fitting to the underlayment by means of a fastening;

a fifth step of disposing a third siding board at the first siding board so that a lower overlying tongue portion thereof is superimposed on an upper underlying tongue portion of the first siding board, and is engagingly locked with an upper board engaging portion of the fastening fitting; and a sixth step of disposing a fourth siding board so that a lower overlying tongue portion thereof is superimposed on an upper underlying tongue portion of the second siding board, a lateral overlying tongue portion is superimposed on a lateral underlying tongue portion of the third siding board, and the lower overlying tongue portion is engagingly locked with the upper board engaging portion of the fastening fitting;

wherein in the fifth and sixth steps, the lower overlying tongue portion and the rear side surface of the third and fourth siding boards come into close contact with the lateral elastic material of the sealing member (Refer to FIG. 12 to FIG. 16).

In the method of attaching siding boards, the fastening fitting is kept and placed at the storage recess of the sealing member during construction, thus the sealing member and fastening fitting can be easily and stably fixed to the underlayment.

The lateral elastic material of the sealing member is in close contact with the rear side surface and the lower overlying tongue portion of the siding board. Thus, there can be reliably obtained a siding boards attachment structure which is free of rain water penetration into the inside of the siding boards attachment structure. Therefore, corrosion or degradation of the siding board or the underlayment can be reliably prevented.

As described above, according to the present invention, there can be provided a method of attaching siding boards of the four side shiplap structure capable of reliably preventing rain water penetration and achieving easy and stable construction.

According to another aspect of the invention, there is provided a sealing member arranged at the back of a fastening fitting disposed at the upper, lower, left and right joint portion of four siding boards of a four side shiplap structures including:

a base plate portion fixed to an underlayment, forward protrusions that protrude forward at the left and right sides of the base plate portion, wherein a storage recess having a width substantially equal to the width of the fastening fitting is formed between the left and right forward protrusions, wherein inside horizontally rising plate portions erected forward in a horizontal direction are formed at the storage recess side of the forward protrusion, and an inside downwardly inclined portion inclined diagonally downward at a front end of the inside horizontally rising plate portion, wherein an outside horizontally rising plate portion erected forward in a horizontal direction from the forward protrusion is formed at the outside of the inside horizontally rising plate portion, and an outside upwardly inclined portion inclined diagonally upward at the front end of the outside horizontally rising plate portion and a downward suspended plate portion bent downward in the vertical direction from a tip end of the outside upwardly inclined portion, and wherein a lateral elastic material is arranged at top faces of the outside horizontally rising plate portion and the outside upwardly inclined portion, at a front face of the forward protrusion upward of these portions, and at a front face of the downward suspended plate portion.

As described above, at a base plate portion of the sealing member, the forward protrusion is provided, and a storage recess having a width substantially equal to the width of the fastening fitting is formed between the left and right forward protrusions.

Therefore, when the sealing member is used together with the fastening fitting, the fastening fitting can be kept and placed at the storage recess (Refer to FIG. 26B). In this manner, during construction, the sealing member and the fastening fitting can be easily disposed.

In addition, the storage recess has a width substantially equal to the width of the fastening fitting. Thus, when the fastening fitting is disposed at the storage recess, a displacement between them can be prevented. Therefore, the sealing member and the fastening fitting can be easily and stably fixed to the underlayment.

In addition, as described above, a lateral elastic material is arranged at top faces of the outside horizontally rising plate portion and the outside upwardly inclined portion of the sealing member, a front face of the forward protrusion upward of these portions, and a front face of the downward suspended plate portion. The lateral elastic material arranged at the outside horizontally rising plate portion and the outside upwardly inclined portion is in close contact with a lower engaging portion of the lower overlying tongue portion of an upper siding board. The lateral elastic material arranged at the forward protrusion is in close contact with the rear side surface of the siding board. In addition, the lateral elastic material arranged at the downward suspended plate portion is in close contact with the rear side surface of the lower overlying tongue portion of the upper siding board. In particular, the lateral elastic material is in close contact with the lower engagement portion of the lower overlying tongue portion of the siding board so as to cover the lower engaging portion (Refer to FIG. 31).

The lateral elastic material is not provided at the inside horizontally rising plate portion and the inside downwardly inclined portion.

Thus, in the case where a siding boards attachment structure is constructed by using the sealing member, a water conduit is formed at the portion that is inward of the lateral elastic material and the top faces of the inside horizontally rising plate portion and the inside downwardly inclined portion.

Therefore, even if rain water penetrates into a longitudinal joint clearance portion of the two upper left and right siding boards, i.e., into a clearance between the lateral underlying tongue portion and the lateral overlying tongue portion, the rain water moving in the lateral direction is dammed by the lateral elastic material. The rain water passes through the water conduit, and is positively discharged forward of the wall face. Therefore, the rain water does not penetrate into the siding boards attachment structure.

In this way, by using the sealing member, the rain water can be reliably prevented from penetrating the inside of the siding boards attachment structure, and corrosion or degradation of the siding board or the underlayment and the like can be reliably prevented. A water penetration preventing function will be described in detail in a Embodiment 3 described later.

In addition, the lateral elastic material is arranged at the forward protrusion that protrudes forward from the base plate portion. Thus, the lateral elastic material can be brought into close contact with the rear side surface of the siding board without particularly increasing the thickness of the lateral elastic material. Therefore, an inexpensive sealing member can be obtained by reducing the thickness of the lateral elastic material.

As has been described above, according to the present invention, in the siding boards attachment structure of a four side shiplap structure, there can be provided a sealing member capable of reliably preventing rain water penetration, and achieving easy and stable construction.

According to another aspect of the invention, there is provided a siding boards attachment structure of a four side shiplap structure for disposing the siding board on the underlayment by using the sealing member and the fastening fitting, including: a fixing plate portion abutting against rear side surfaces of the siding boards arranged vertically, a supporting portion erected forward over the full width of the fixing plate portion, an upper board engaging portion bent diagonally upward from a front end of the supporting portion, a lower board engaging portion bent diagonally downward from a front end of the supporting portion, and a front flat plate continuously provided between the tip end of the upper board engaging portion and the tip end of the lower board engaging portion, wherein the sealing member and the fastening fitting disposed at a storage recess of the sealing member are fixed to the underlayment together by means of a fastening, wherein in two adjacent siding boards disposed downward of the fastening fitting, an upper underlying tongue portion is engagingly locked with a lower board engaging portion of the fastening fitting and an inside downwardly inclined portion of the sealing member, wherein in two adjacent siding boards disposed upward of the fastening fitting, a lower overlying tongue portion is disposed on the supporting portion of the fastening fitting and is engagingly locked with an upper board engaging portion of the fastening fitting and an outside upwardly inclined portion of the sealing member, wherein caulking materials are attached on the front faces of the upper underlying tongue portion and the lateral underlying tongue portion or on the rear faces of the lower overlying tongue portion and the lateral overlying tongue portion, wherein a lateral elastic material of the sealing member is in close contact with the rear side surface and the lower overlying tongue portion of the upper siding board, and wherein a water conduit communicating from a joint clearance portion of the upper and lower siding boards forward of the wall face is formed at the top face side of the inside horizontally rising plate portion and the inside downwardly inclined portion (Refer to FIG. 30).

In the siding boards attachment structure, the fastening fitting is kept and placed on the storage recess, whereby a displacement between the fastening fitting and the sealing member can be prevented. Therefore, the sealing member and the fastening fitting can be easily and stably fixed to the underlayment.

The lateral elastic material is arranged at a forward protrusion that protrudes forward from the base plate portion. Thus, the lateral elastic material can be brought into close contact with the rear side surface of the siding board without particularly increasing the thickness of the elastic material.

In the siding boards attachment structure, the lateral elastic material of the sealing member is in close contact with the rear side surface and the lower overlying tongue portion of the siding board. A water conduit is formed inward from the lateral elastic material and the top face between the inside horizontally rising plate portion and the inside downwardly inclined portion.

Therefore, the rain water penetrating the joint clearance portion of the left and right siding boards is passed through the water conduit, and can be positively discharged from the joint clearance portion of the upper and lower siding boards forward of the wall face.

Thus, as described above, the rainwater can be reliably prevented from penetrating the inside of the siding boards attachment structure, and corrosion or degradation of the siding board or the underlayment and the like can be reliably prevented.

As has been described above, according to the present invention, there can be provided a siding boards attachment structure capable of reliably preventing rain water penetration, and achieving easy and stable construction.

According to the other aspect of the present invention, there is provided a method of constructing the siding boards attachment structure includes the first to sixth steps of:

a first step of disposing the first siding board at the underlayment, a second step of jointing a lateral overlying tongue portion of the second siding board at a lateral underlying tongue portion of the first siding board through the left-right side shiplap joint, and disposing the second siding board at the underlayment, a third step of inserting a base plate portion of the sealing member and a fixing plate portion of the fastening fitting between the underlayment and the siding board in the state of that the fastening fitting is disposed at a storage recess of the sealing member, a fourth step of engagingly locking a lower board engaging portion of the fastening fitting with the upper underlying tongue portion of the siding board, and engagingly locking the inside downwardly inclined portion of the sealing member with the upper underlying tongue portion of the siding board, thereby fixing the sealing member and the fastening fitting to the underlayment by means of a fastening, a fifth step of mounting a third siding board so that a lower overlying tongue portion of the third siding board is superimposed on an upper underlying tongue portion of the first siding board, and is engagingly locked with an upper board engaging portion of the fastening fitting and an outside upwardly inclined portion of the sealing member, and a sixth step of disposing a fourth siding board so that a lower overlying tongue portion of the fourth siding board is superimposed on an upper underlying tongue portion of the second siding board, a lateral overlying tongue portion of the fourth siding board is superimposed on a lateral underlying tongue portion of the third siding board, and a lower overlying tongue portion of the fourth siding board is engagingly locked with an upper board engaging portion of the fastening fitting and an outside upwardly inclined portion of the sealing member, wherein in the fifth and sixth steps, the lower overlying tongue portion and the rear side surface of the third and fourth siding boards are brought into close contact with a lateral elastic material of the sealing member (Refer to FIG. 32 to FIG. 34).

In the method of attaching siding boards, the fastening fitting is kept and placed at the storage recess of the sealing member, and thus, the sealing member and the fastening fitting can be easily and stably fixed to the underlayment.

In addition, the lateral elastic material of the sealing member is in close contact with the rear side surface and the lower overlying tongue portion of the siding board. Thus, a siding boards attachment structure free from rain water penetration into the siding boards attachment structure can be reliably obtained. Therefore, corrosion or degradation of the siding board or the underlayment and the like can be reliably prevented.

As has been described above, according to the present invention, there can be provided a method of attaching siding boards of the four side shiplap structure capable of reliably preventing rain water penetration and achieving easy and stable construction.

BRIEF DESCRIPTION OF THE DRAWINGS

A more complete appreciation of the invention and many of the attendant advantages thereof will become readily apparent with reference to the following detailed description, particularly when considered in conjunction with the companying drawings, in which:

FIG. 24A is a front view of the sealing member according to the Embodiment 3;

FIG. 24B is a plan view of the sealing member according to the Embodiment 3;

FIG. 24C is a side view of the sealing member according to the Embodiment 3;

DESCRIPTION OF THE PREFERRED EMBODIMENTS

Figure 1:
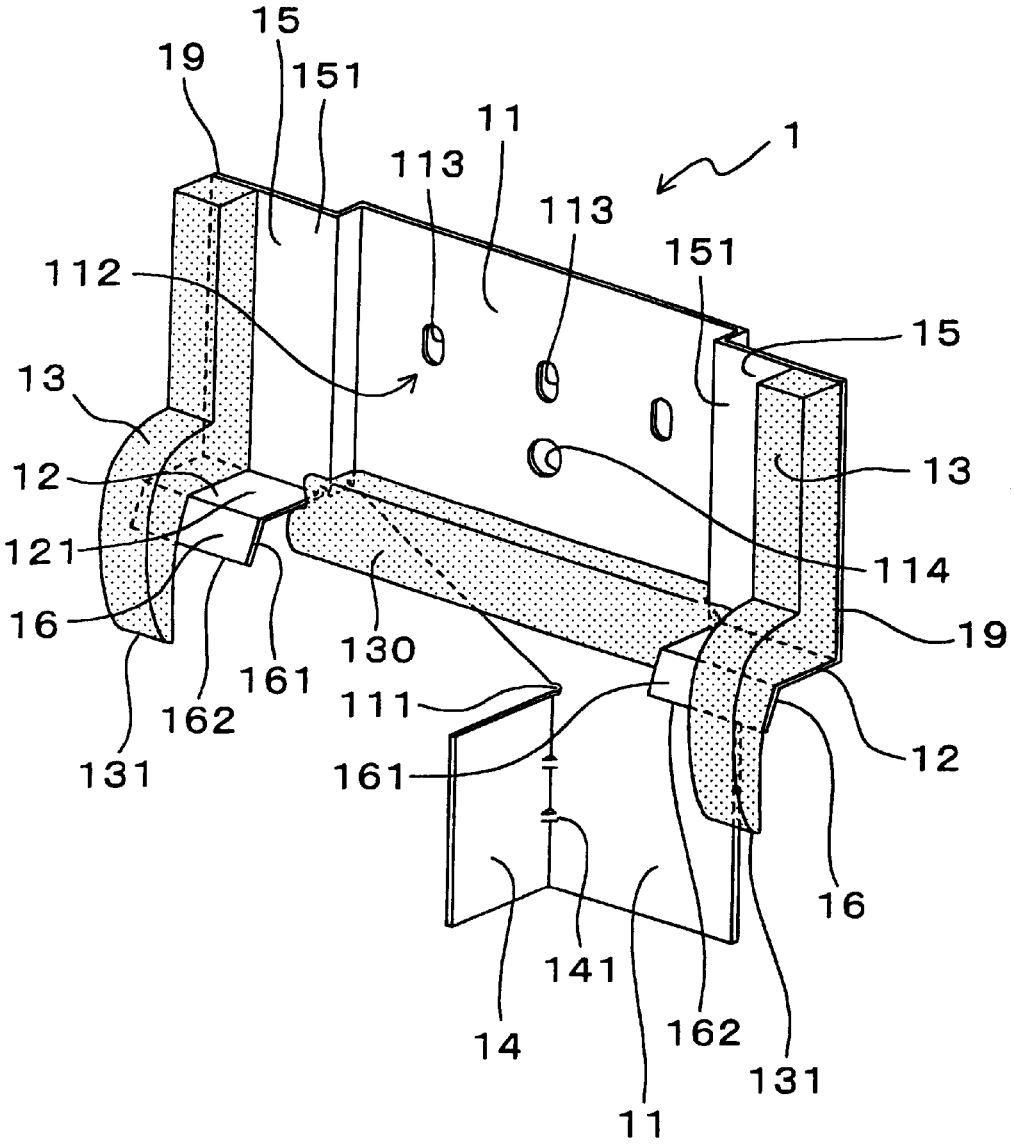
FIG. 1 is a perspective view of a sealing member according to Embodiment 1.

The preferred embodiments will now be described with reference to the accompanying drawings, wherein like reference numerals designate corresponding or identical elements throughout the various drawings.

The lateral elastic material has elasticity and water resistance. In addition, the forward protrusion is constructed to be disposed backward from a base plate portion of a fastening fitting disposed at the storage recess.

Figure 5:
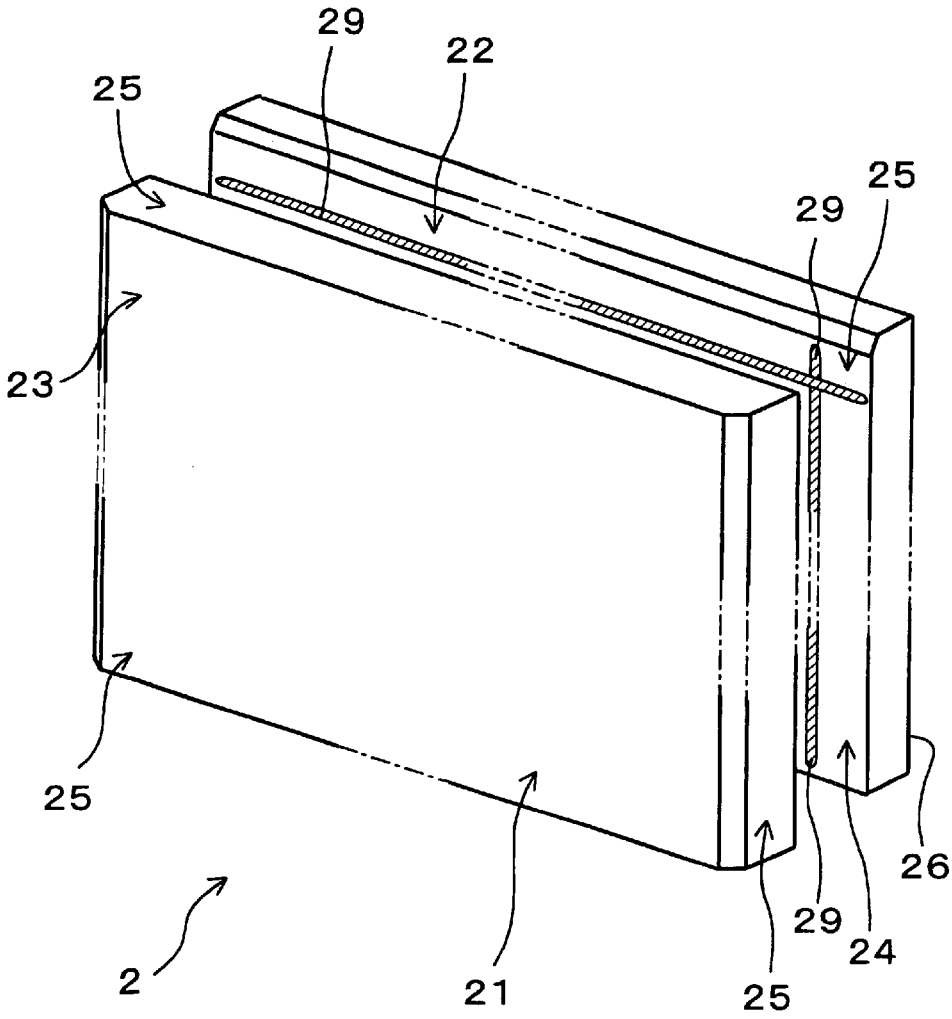
FIG. 5 is a perspective view of a siding board according to the Embodiment 1.

The siding board of the four side (left, right, upper and lower sides) shiplap structure denotes a siding board having an upper underlying tongue portion and a lower overlying tongue portion at the top and bottom sides and a lateral underlying tongue portion and a lateral overlying tongue portion at the left and right sides (Refer to FIG. 5).

In the specification, the outward direction of a building is defined as "forward", and the inward direction of building is defined as "backward". With respect to the fastening fitting, when the fastening fitting is disposed on an underlayment (for instance furring strip), a direction corresponding to the outward direction of a building is defined as "forward", and a direction corresponding to the inward direction of a building is defined as "backward".

Figure 4A:
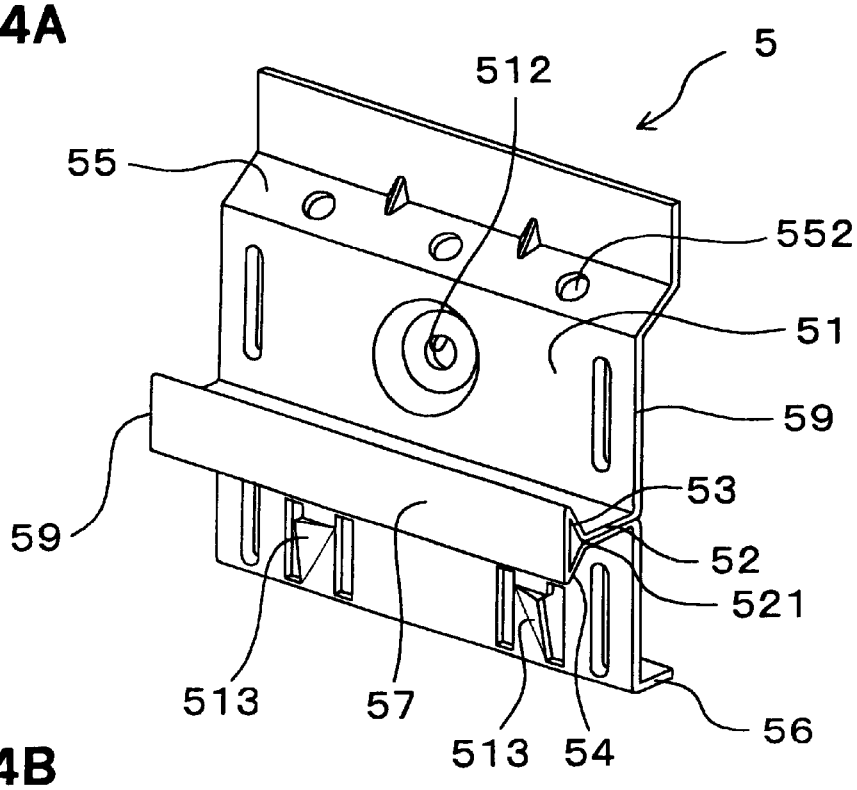
FIG. 4A is a perspective view of a fastening fitting according to the Embodiment 1.

The fastening fitting has a fixing plate portion abutting against rear side surfaces of the siding boards arranged vertically, a supporting portion erected forward over the full width of the fixing plate portion, an upper board engaging portion bent diagonally upward from a front end of the supporting portion, a lower board engaging portion bent diagonally downward from a front end of the supporting portion, and a front flat plate continuously provided between the tip end of the upper board engaging portion and the tip end of the lower board engaging portion (Refer to FIG. 4A).

The sealing member is used together with the fastening fitting to dispose a siding board on an underlayment, and, for example, the following siding boards attachment structure is formed.

That is, the sealing member and the fastening fitting disposed at the storage recess of the sealing member are fixed to the underlayment together.

In the adjacent two siding boards disposed downward of the fastening fitting, an upper underlying tongue portion is engagingly locked with the lower board engaging portion of the fastening fitting. In the adjacent two siding boards disposed upward of the fastening fitting, a lower overlying tongue portion is mounted on the supporting portion of the fastening fitting and is engagingly locked with the upper board engaging portion (Refer to FIG. 8 and FIG. 10).

At the siding board, caulking materials are attached on the front faces of the upper underlying tongue portion and the lateral underlying tongue portion or on the rear faces of the lower overlying tongue portion and the lateral overlying tongue portion (Refer to FIG. 5).

It is preferable that the lateral elastic material is not provided at inner ends of the forward protrusion, the horizontally rising plate portion and the inclined portion.

That is, the lateral elastic material is provided only at a portion of the width of about 5 mm from the side end of a sealing member, in the forward protrusion, the horizontally rising plate portion and the inclined portion, for example. This elastic material is not provided at an inner end that is closer to the center side of the sealing member (Refer to FIG. 2).

In the case of that a siding boards attachment structure is thus constructed by using the sealing member, the rain water dammed by the lateral elastic material is discharged from the joint clearance portion of the upper and lower siding boards forward of the wall face after the rain water passes through an inclined portion from the inclined portion provided inward of the lateral elastic material or the forward protrusion and the horizontally rising plate portion. That is, a water conduit guiding rain water forward of the wall face is formed inward of the lateral elastic material (Refer to FIG. 19).

Thus, the rain water penetrating the joint clearance portion of the left and right siding board can be positively discharged from the joint clearance portion of the upper and lower siding board. Therefore, there can be provided a sealing member preventing water penetration into the siding boards attachment structure more reliably.

It is preferable that the lateral elastic material is constructed to be extended over the tip end of the inclined portion, and the tip end of the lateral elastic material is disposed under a caulking material formed at the upper underlying tongue portion of the siding board when the sealing member is disposed at the upper underlying tongue portion of the siding board (Refer to FIG. 1).

In this manner, a part of the rain water discharged forwardly of the wall face through the inclined portion which is inward from the lateral elastic material can be reliably prevented from being leaked outward from the lateral elastic material. That is, the rain water can be reliably lead downward under the caulking material, and thus, the rain water can be reliably discharged forward of the wall face. Therefore, there can be provided a sealing member preventing water penetration into the siding boards attachment structure more reliably.

It is preferable that a backward elastic material continuously provided between the left and right horizontally rising plate portion is provided at the storage recess.

In this manner, in the case where the siding boards attachment structure is formed by using the sealing member, the backward elastic material comes into close contact with the rear side and the side end of the fixing plate portion of the fastening fitting. Thus, rain water can be reliably prevented from leaking downwardly from a space between the supporting portion of the fastening fitting and the horizontally rising plate portion of the sealing member. In particular, in the case where a bending notch is provided at the proximal end of the forward protrusion or the horizontally rising plate portion, the notch is closed by the backward elastic material, and water leakage from the notch can be reliably prevented (Refer to FIG. 1 and FIG. 2).

It is preferable that, in the sealing member, the lateral elastic material is provided at the inner ends of the inclined portion, the horizontally rising plate portion and the forward protrusion at the left side or right side; and the lateral elastic material is not provided at the inner ends of the inclined portion, the horizontally rising plate portion and the forward protrusion portion at the opposite side.

In this case, the lateral elastic material at either the left side or the right side comes into close contact with the side ends of the front flat plate, the supporting portion and the fixing plate portion of the fastening fitting, whereby rain water is dammed at the side end.

On the other hand, a water conduit for discharging the rain water flowing through the front flat plate of the fastening fitting or the like forward of the wall face, is formed inward from the lateral elastic material at the opposite side.

Therefore, rain water can be efficiently discharged forward of the wall face from either the left side or the right side of the fastening fitting.

When the sealing member is used for a siding boards attachment structure using a siding board that has a lateral underlying tongue portion at a right side portion and a lateral overlying tongue portion at a left side portion, it is preferable that the lateral elastic material is provided at the inner end at the inclined portion, the horizontally rising plate portion and the forward protrusion at the right side; and the lateral elastic material is not provided at the inner end at the inclined portion, the horizontally rising plate portion, and the forward protrusion at the left side.

In the case of such siding boards attachment structure, the rain water penetrating the left and right joint clearance portion is generally prone to flow to the left side end portion of the fastening fitting that is closer to the left side. Thus, the lateral elastic material is brought into close contact with the side end at the right side of the fastening fitting, and the water conduit is formed at the left side, whereby rain water can be discharged more efficiently.

It is preferable that a vertically rising plate portion erected forward in a vertical direction is provided at the bottom of the base plate portion.

Figure 17:
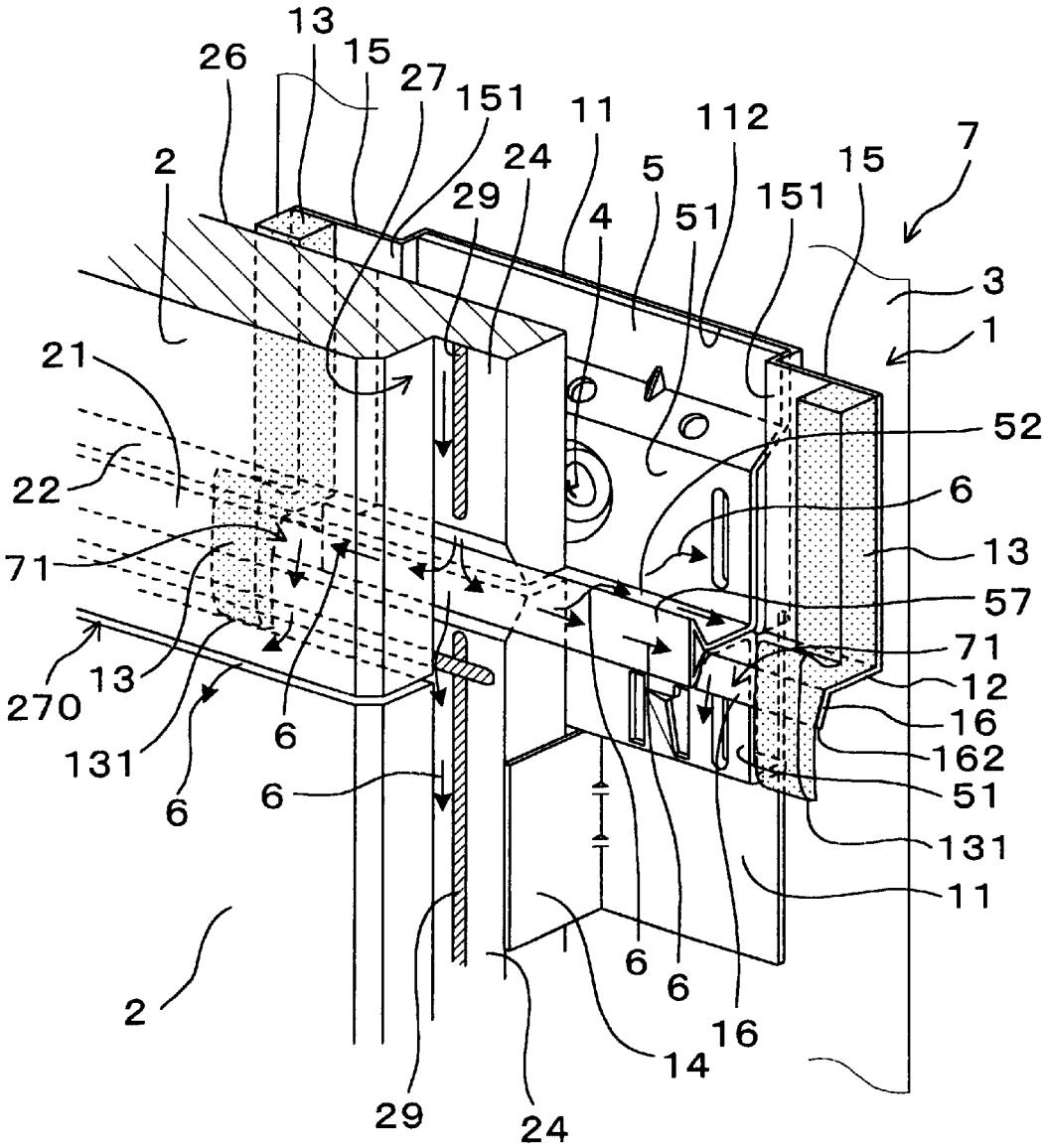
FIG. 17 is a perspective view illustrating a flow of rain water at the periphery of the sealing member and the fastening fitting according to the Embodiment 1.

A side face of the lateral underlying tongue portion of the lower siding board abuts against the vertically rising plate portion when it is disposed (Refer to FIG. 17).

In this manner, the positions of the siding board in the lateral direction can be precisely aligned with each other, and the lateral displacement of the siding boards in the lateral direction after construction can be prevented.

It is preferable that the lateral elastic material and the backward elastic material are made of a foam body. In this manner, there can be provided a sealing member preventing rain water penetration more reliably.

As the foam body, there is, for example, a rubber foam made of EPDM (ethylene propylene rubber) or the like or a synthetic resin foam body such as polyethylene.

It is preferable that the foam is made of a foam body with closed cells.

It is preferable that the base plate portion has a through hole at a position that corresponds to a nail hole or a screw hole formed at the fastening fitting.

In this manner, the sealing member can be easily and precisely fixed to the underlayment.

Figure 10:
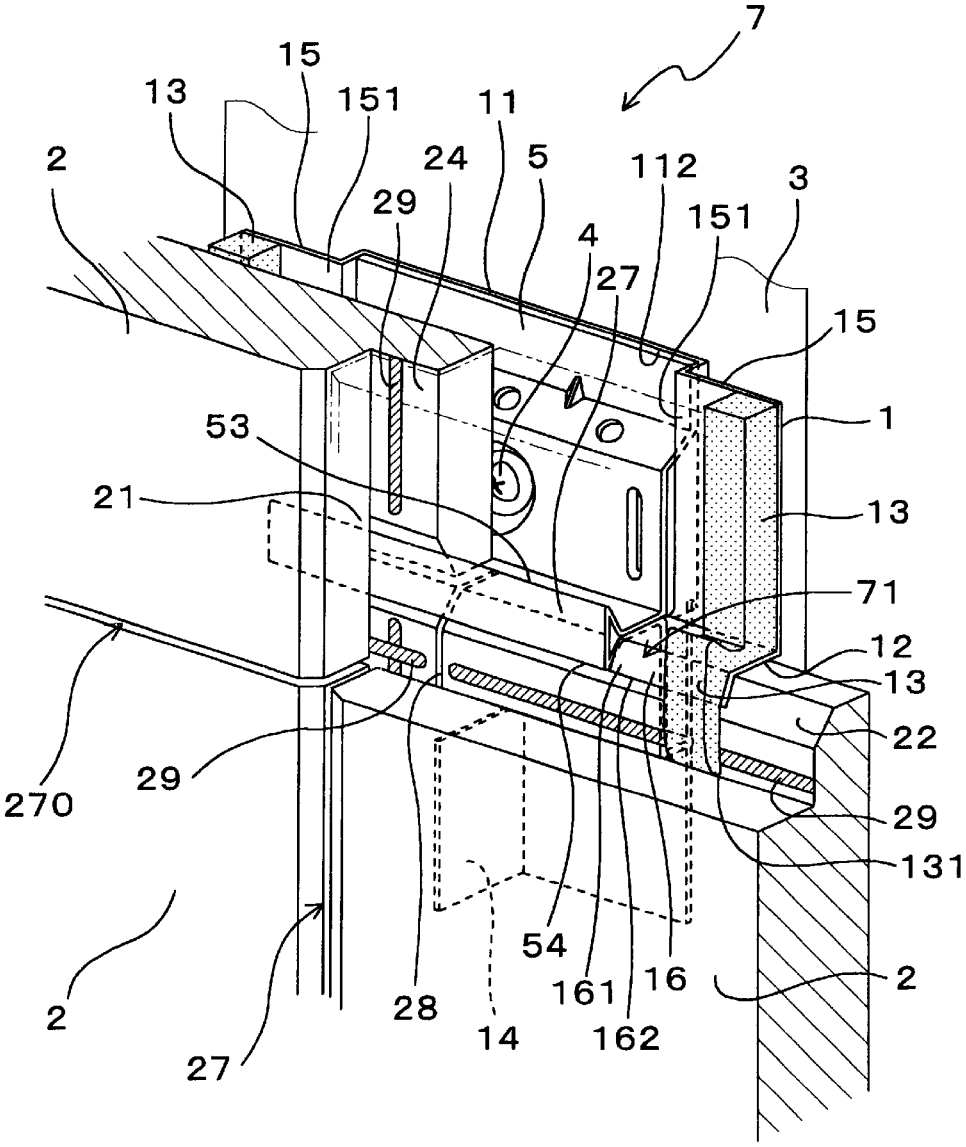
FIG. 10 is a perspective view illustrating a siding boards attachment structure according to the Embodiment 1.

It is preferable that, at the sealing member, the lateral elastic material is not provided at inner ends of the forward protrusion, the horizontally rising plate portion and the inclined portion; and a water conduit communicating from the joint clearance portion of the upper and lower siding boards forward of the wall face is formed inward from the lateral elastic material (FIG. 10).

In this manner, the rain water dammed by the lateral elastic material is discharged from the joint clearance portion of the upper and lower siding board forward of the wall face through the water conduit inward from the elastic material.

Thus, the rain water penetrating the joint clearance portion of the left and right siding boards can be positively discharged from the joint clearance of the upper and lower siding boards. Therefore, water penetration into the siding boards attachment structure can be prevented more reliably.

Figure 11:
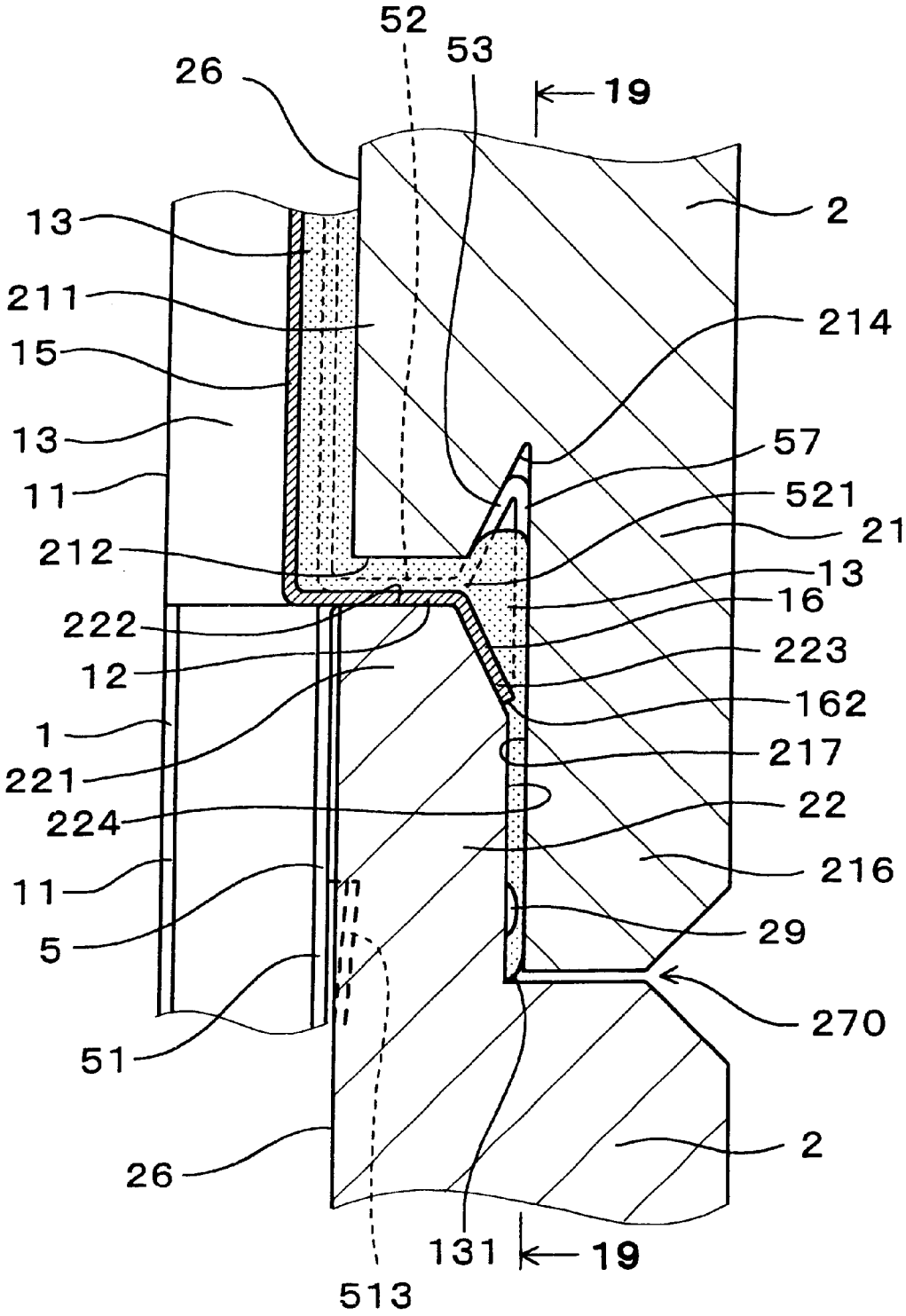
FIG. 11 is a magnified longitudinal cross sectional view illustrating jointing portion of the upper-lower side shiplap structure according to the Embodiment 1.

It is preferable that the lateral elastic material of the sealing member is extended over a tip end of the inclined portion, and the tip end of the lateral elastic material is disposed under a caulking material formed at the upper underlying tongue portion of the siding board (Refer to FIG. 10 and FIG. 11).

In this manner, as described above, rain water can be reliably discharged forward of the wall face, and water penetration into the inside of the siding boards attachment structure can be prevented more reliably.

It is preferable that a backward elastic material continuously provided between the left and right horizontally rising plate portions is provided at the storage recess of the sealing member, and the backward elastic material comes into close contact with the rear side surface of the fixing plate portion of the fastening fitting.

In this manner, as described above, rain water can be prevented from downward leaking from a space between the supporting portion of the fastening fitting and the horizontally rising plate portion of the sealing member.

Figure 21:
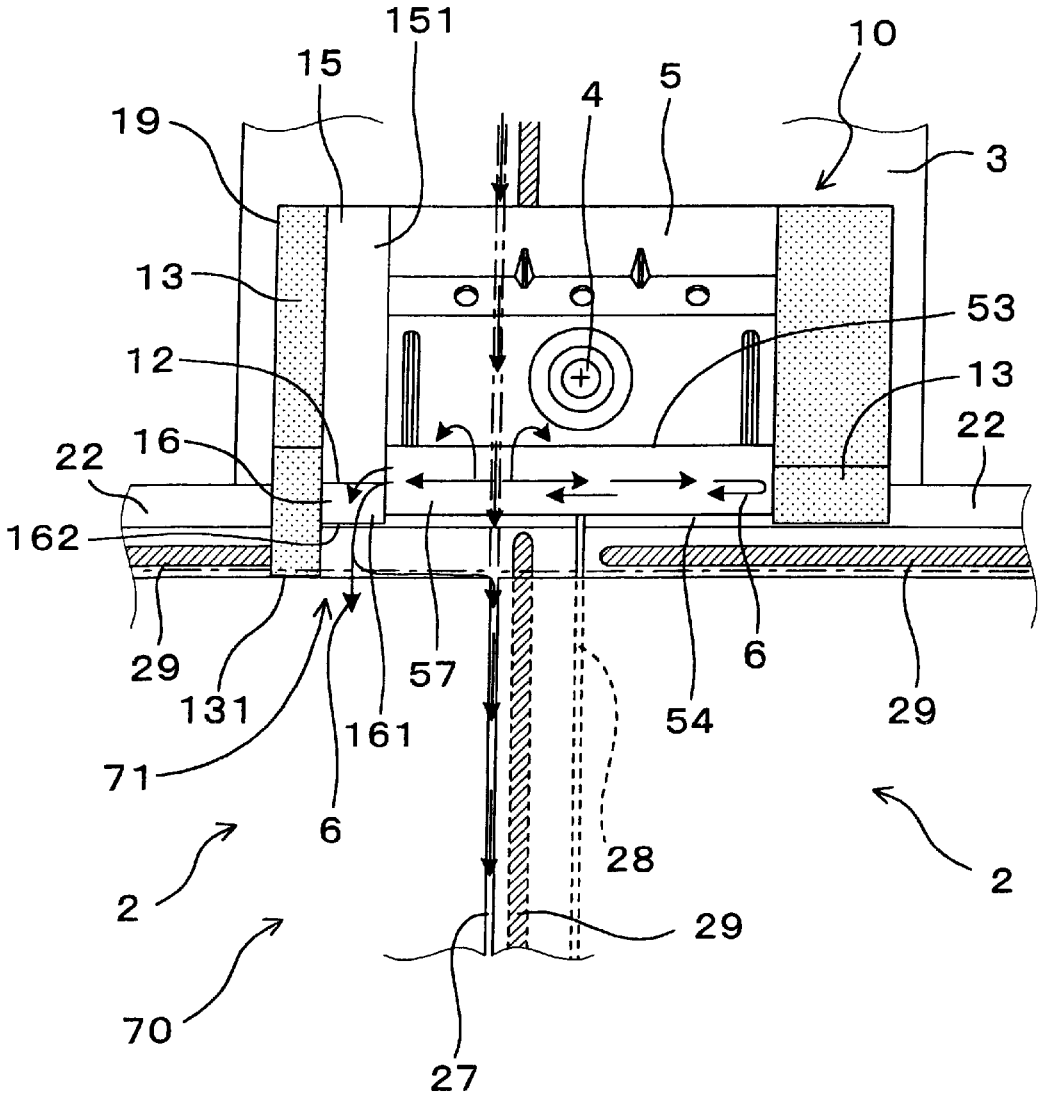
FIG. 21 is an illustrative front view of a siding boards attachment structure according to the Embodiment 2.

It is preferable that in the sealing member, the lateral elastic material is provided at the inner ends of the inclined portion, the horizontally rising plate portion and the forward protrusion at the left side or right side; at the opposite side of the inclined portion, the horizontally rising plate portion and the forward protrusion, the lateral elastic material is provided at a portion excluding at least an inner end at the inclined portion, the horizontally rising plate portion and the forward protrusion; and a water conduit is formed inward from the lateral elastic material (Refer to FIG. 21).

That is, the lateral elastic material is not provided at inner ends of the inclined portion, the horizontally rising plate portion, and the forward protrusion, at either the left side of the sealing member or the right side of the sealing member.

In this case, as described above, rain water can be efficiently discharged from either the left side or the right side of the fastening fitting forward of the wall face.

It is preferable that a caulking material in the upper underlying tongue portion of the siding board is formed outward from the lateral elastic material that forms the water conduit.

That is, in the siding board, a caulking material is not attached on a portion at which the water conduit is formed.

In this manner, rain water can be discharged more efficiently from the water conduit forward of the wall face.

It is preferable that a vertically rising plate portion erected forward in a vertical direction is provided at the bottom of the base plate portion of the sealing member, and the lateral underlying tongue portion of the lower siding board abuts against the vertically rising plate portion.

In this manner, a lateral displacement of the siding boards after construction can be reliably prevented.

It is preferable that a vertically rising plate portion erected forward in a vertical direction is provided at the bottom of the base plate portion of the sealing member; at the third step, the vertically rising plate portion is inserted into the rear side joint clearance at the rear face side of the left and right siding boards; and at the fourth step, the vertically rising plate portion is pressed against the lateral underlying tongue portion of the first siding board, and the sealing member is fixed to the underlayment (Refer to FIG. 17).

In this manner, the sealing member can be easily positioned, and the lateral displacement of the siding boards after construction can be reliably prevented.

The lateral elastic material has elasticity and water resistance. In addition, the lateral elastic material is not provided at the inside horizontally rising plate portion and the inside downwardly inclined portion. Further, the forward protrusion is constructed to be disposed backward from the base plate portion of the fastening fitting disposed at the storage recess.

The sealing member is used together with the fastening fitting to mount a siding board on an underlayment, and form the siding boards attachment structure as described below.

That is, in the siding boards attachment structure, the sealing member and the fastening fitting disposed at the storage recess of the sealing member are fixed to the underlayment together.

Figure 28:
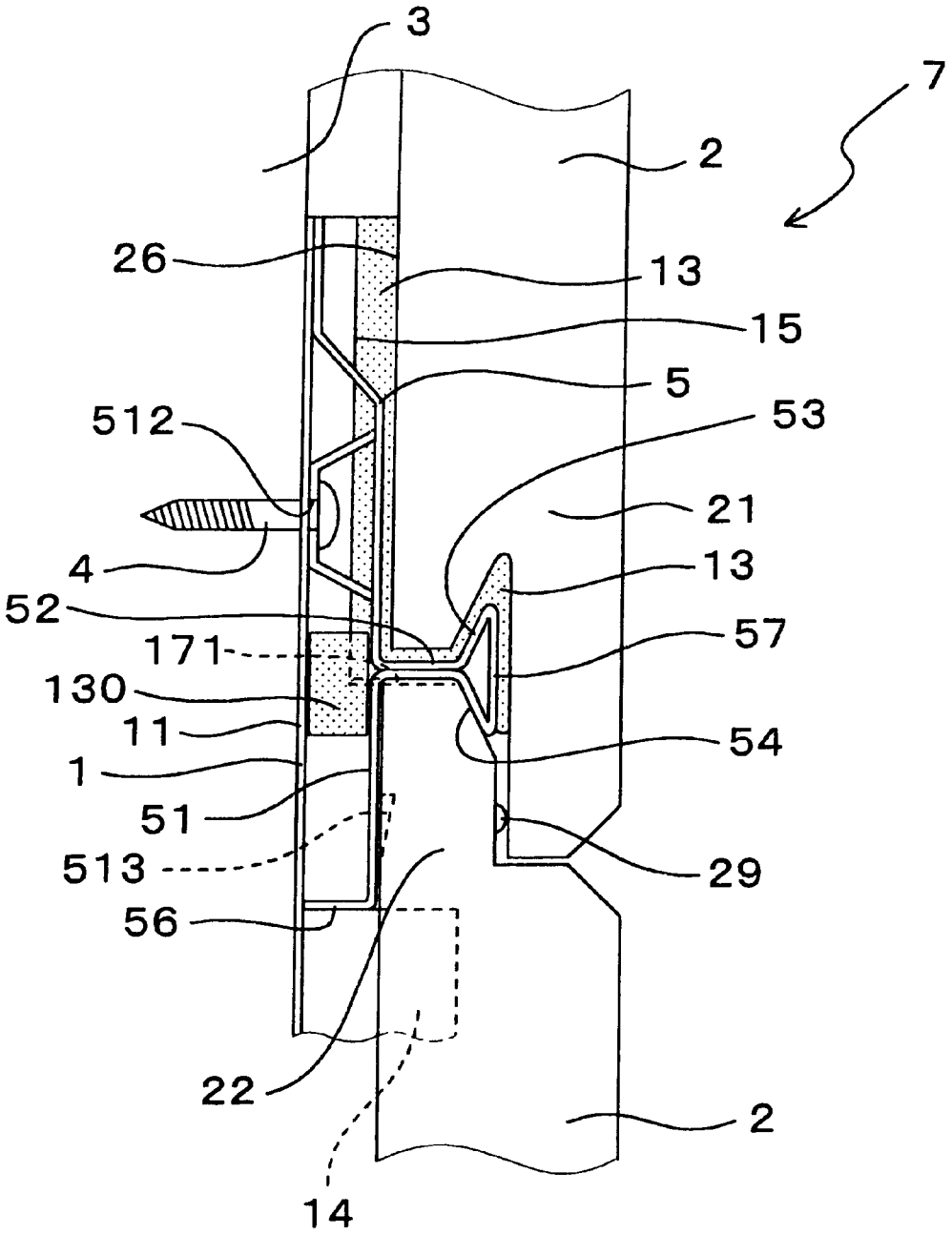
FIG. 28 is a longitudinal cross section illustrating a jointing portion of the upper-lower side shiplap structure taken along line 28—28 of FIG. 27.
Figure 30:
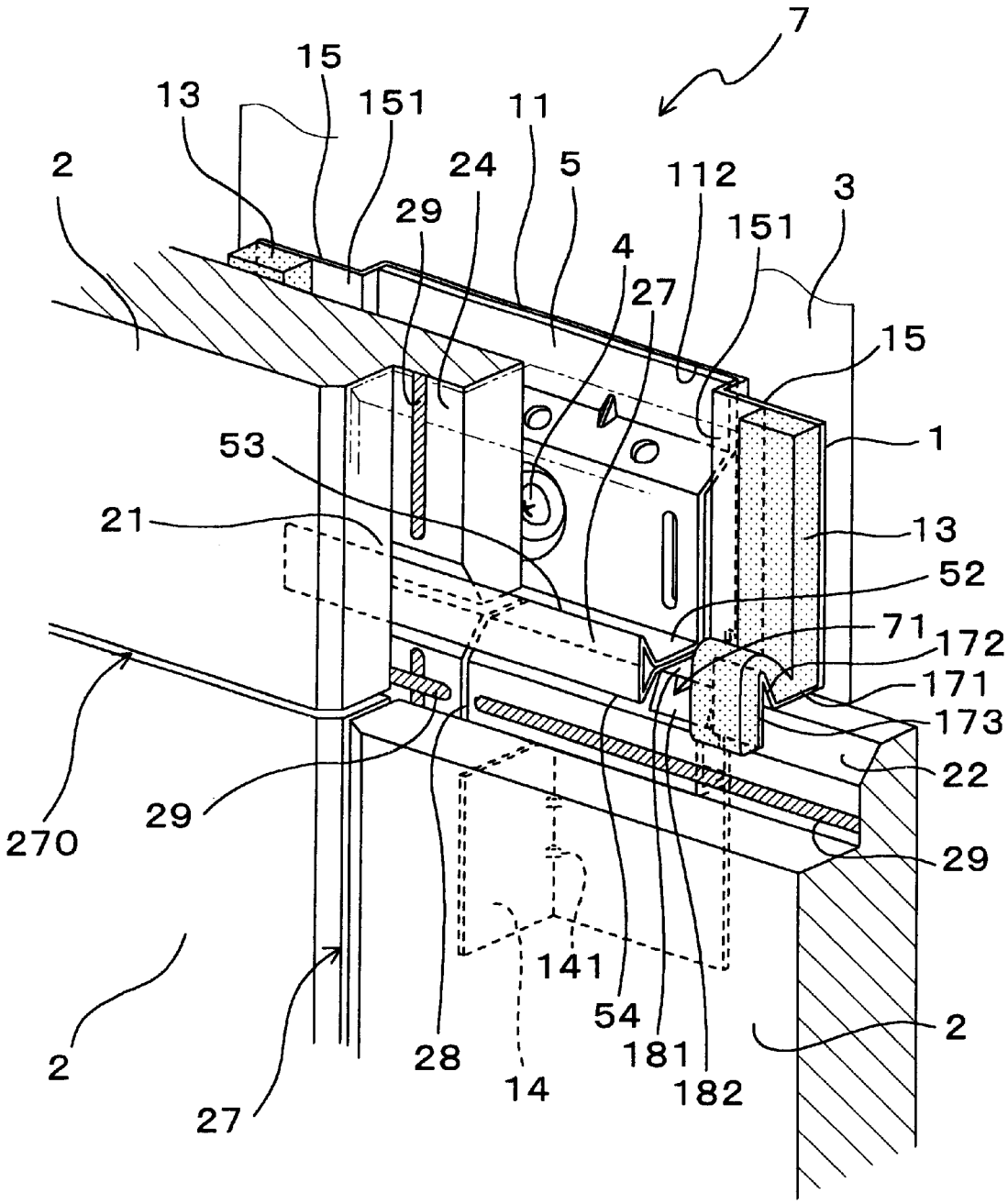
FIG. 30 is a perspective view illustrating a siding boards attachment structure according to the Embodiment 3.

In the adjacent two siding boards disposed downward of the fastening fitting, the upper underlying tongue portion is engagingly locked with the lower board engaging portion of the fastening fitting and the downwardly inclined portion of the sealing member. In addition, in the adjacent two siding boards disposed upward of the fastening fitting, the lower overlying tongue portion is mounted on the supporting portion of the fastening fitting and engagingly locked with the upper board engaging portion of the fastening fitting and the outside upwardly inclined portion of the sealing member (FIG. 28, FIG. 30).

Figure 23:
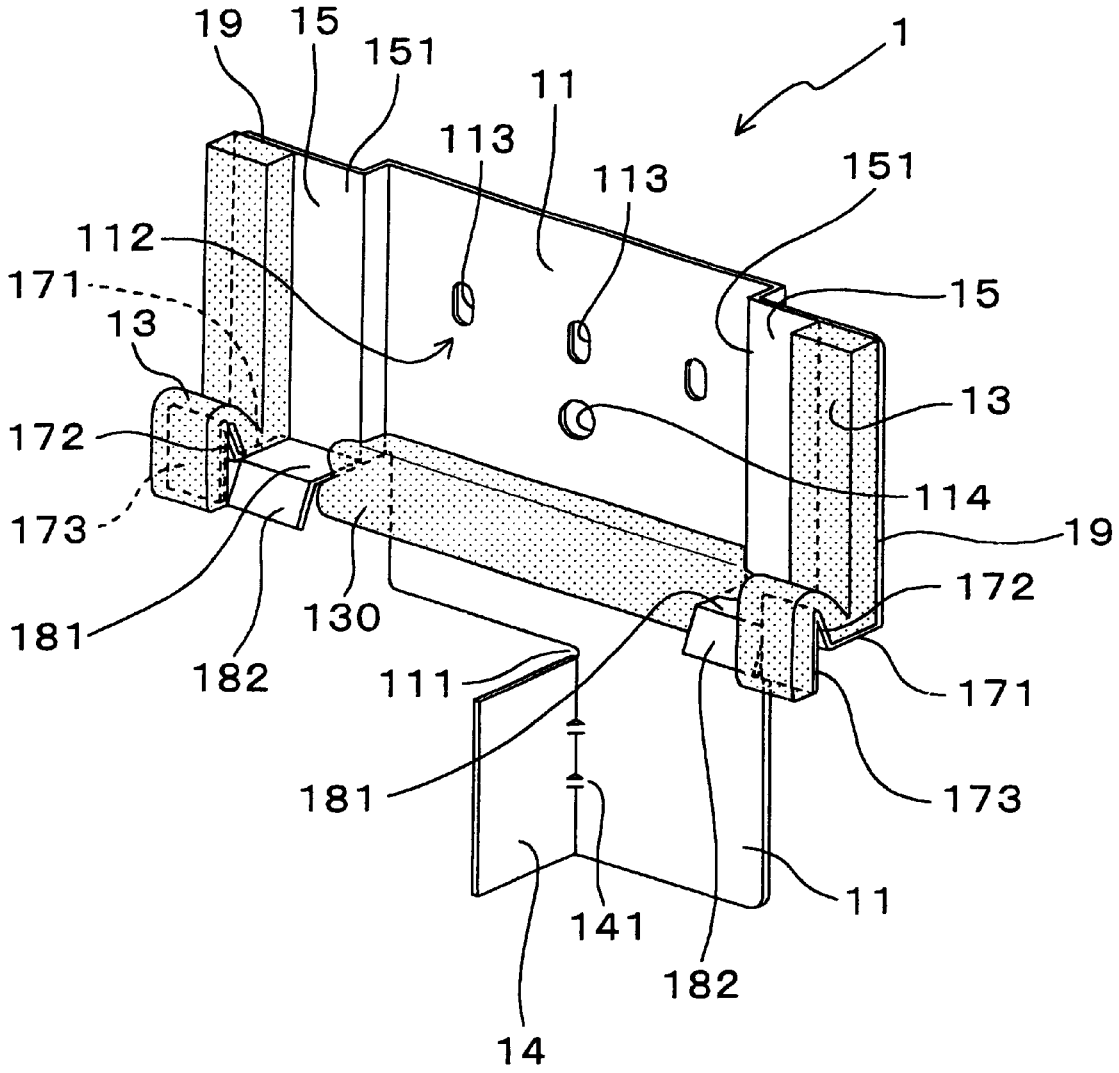
FIG. 23 is a perspective view of the sealing member according to a Embodiment 3.

It is preferable that a backward elastic material continuously provided between the left and right inside horizontally rising plate portions is provided at the storage recess (Refer to FIG. 23 and FIG. 24).

In this manner, in the case where the siding boards attachment structure is formed by using the sealing member, the backward elastic material comes into close contact with the rear side and side end of the fixing plate portion of the fastening fitting. Thus, rain water can be reliably prevented from leaking downward from a space between the supporting portion of the fastening fitting and the inside horizontally rising plate portion of the sealing member. In particular, in the case where a bending notch is provided at the proximal ends of the forward protrusion and the inside horizontally rising plate portion, the notches are closed by the backward elastic material, whereby water leakage from the notch can be reliably prevented.

It is preferable that a vertically rising plate portion erected forward in a vertical direction is provided at the bottom of the base plate portion.

Figure 35:
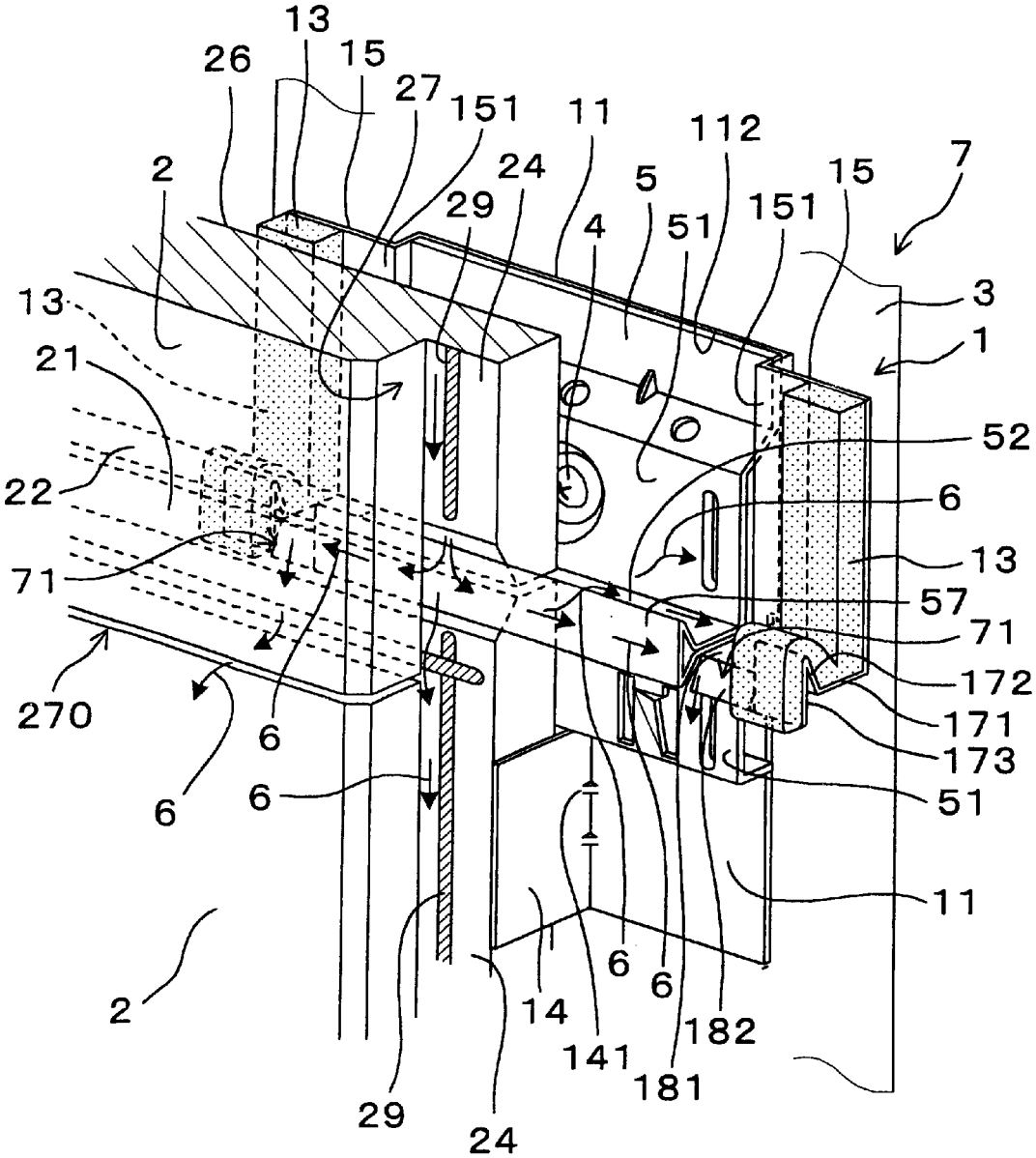
FIG. 35 is an illustrative perspective view illustrating a flow of rain water at the periphery of the sealing member and the fastening fitting according to the Embodiment 3.

The side face of the lateral underlying tongue portion of the lower siding board abuts against the vertically rising plate portion when it is disposed (Refer to FIG. 35).

In this manner, a position in the lateral direction of the siding boards can be precisely aligned with each other, and a lateral displacement of the siding boards after construction can be prevented.

It is preferable that the lateral elastic material and the backward elastic material are made of a rubber elastic material or a foam body.

In this manner, there can be provided a sealing member preventing rain water penetration more reliably.

As the rubber elastic material or foam body, there is a rubber foam made of ethylene rubber or EPDM (ethylene propylene rubber) and the like or a synthetic resin foam such as polyethylene.

It is preferable that the foam body is made of a foam body with closed cells.

It is preferable that the base plate portion has a through hole at a position that corresponds to the nail hole and the screw hole formed at the fastening fitting.

In this manner, the sealing member can be easily and precisely fixed to the underlayment.

It is preferable that a backward elastic material continuously provided between the left and right inside horizontally rising plate portions is provided at the storage recess of the sealing member, and the backward elastic material comes into close contact with the rear side surface of the fixing plate portion of the fastening fitting.

In this manner, as described above, rain water can be reliably prevented from leaking downward from a space between the supporting portion of the fastening fitting and the horizontally rising plate portion inner portion of the sealing member.

It is preferable that a vertically rising plate portion erected forward in a vertical direction is provided at the bottom of the base plate portion of the sealing member, and the lateral underlying tongue portion of the lower siding board abuts against the vertically rising plate portion.

In this manner, a lateral displacement of the siding boards after construction can be reliably prevented.

It is preferable that a vertically rising plate portion erected forward in a vertical direction is provided at the bottom of the base plate portion of the sealing member; the vertically rising plate portion is inserted into the rear side joint clearance at the rear face side of the left and right siding boards at the third step; and the vertically rising plate portion is pressed against the lateral underlying tongue portion of the first siding board, thereby fixing the sealing member to the underlayment at the fourth step (Refer to FIG. 35).

In this manner, the sealing member can be easily positioned, and the lateral displacement of the siding boards after construction can be reliably prevented.

Embodiment 1

A sealing member and a siding boards attachment structure using the sealing member according to the embodiments of the present invention will be described with reference to FIG. 1 to FIG. 19.

Figure 18:
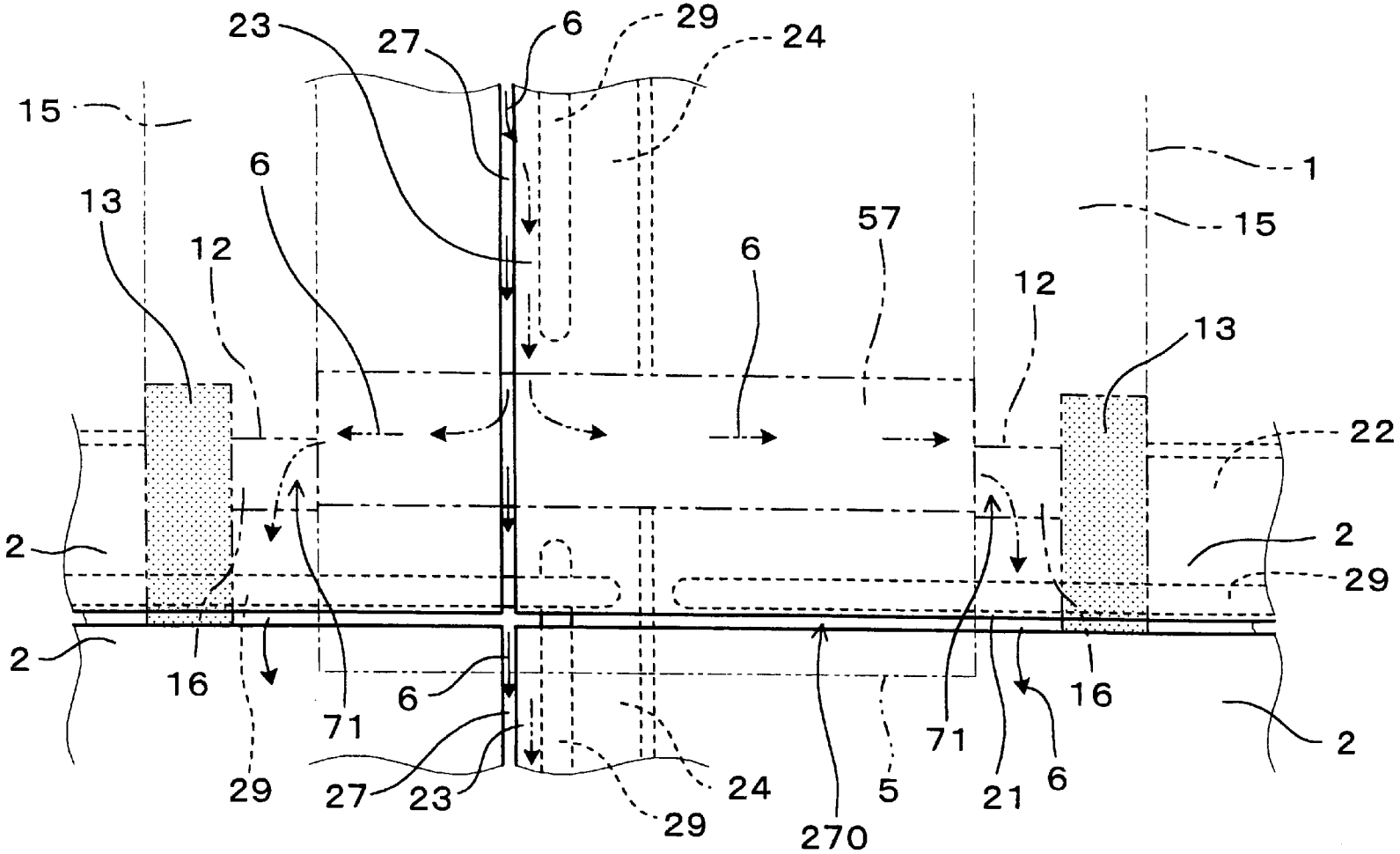
FIG. 18 is an illustrative front view illustrating a flow of rain water at the periphery of the sealing member and the fastening fitting according to the Embodiment 1.
Figure 19:
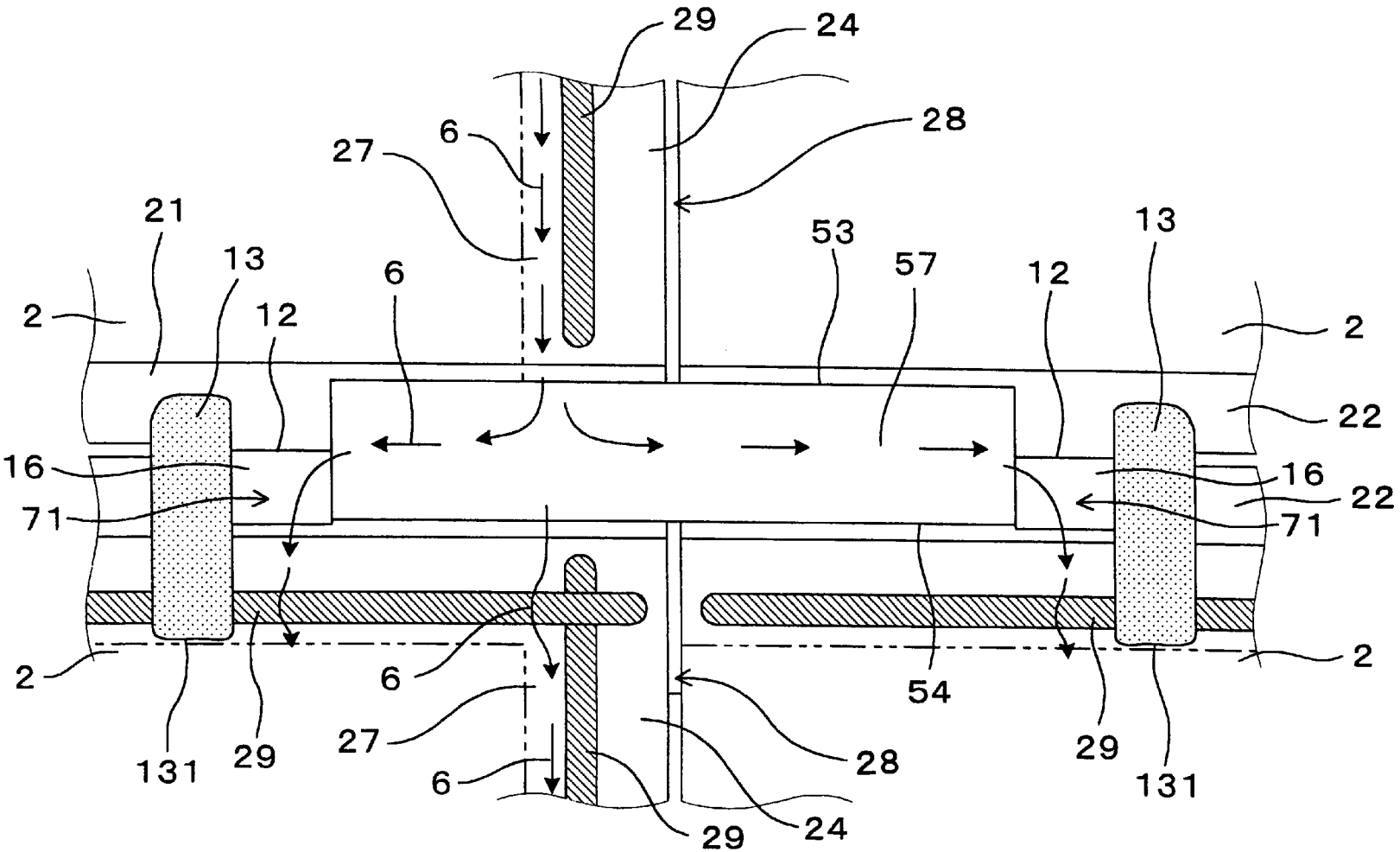
FIG. 19 is an illustrative view illustrating a flow of rain water taken along line 19—19 of FIG. 11.

FIG. 1 to FIG. 4B are primarily illustrative views of a sealing member 1 and a fastening fitting 5; FIG. 5 to FIG. 11 are primarily illustrative views of a siding boards attachment structure; FIG. 12 to FIG. 16 are primarily illustrative views of a method of attaching siding boards; and FIG. 17 to FIG. 19 are primarily illustrative views of an advantageous effect.

Figure 4B:
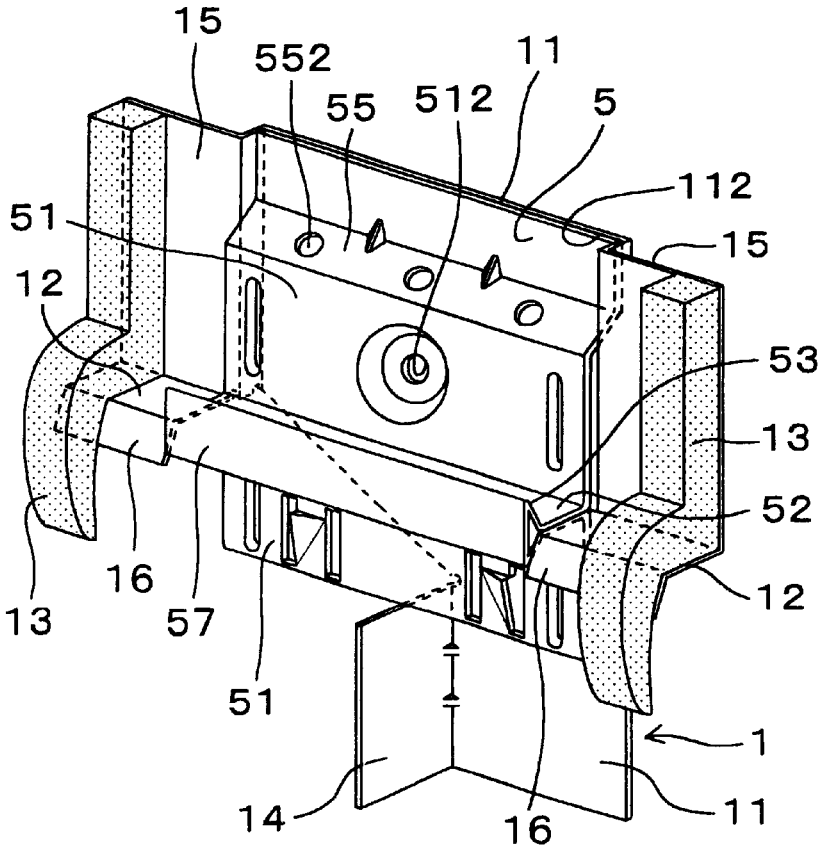
FIG. 4B is a perspective view of the state of that the fastening fitting is superimposed on the sealing member according to the Embodiment 1.
Figure 6:
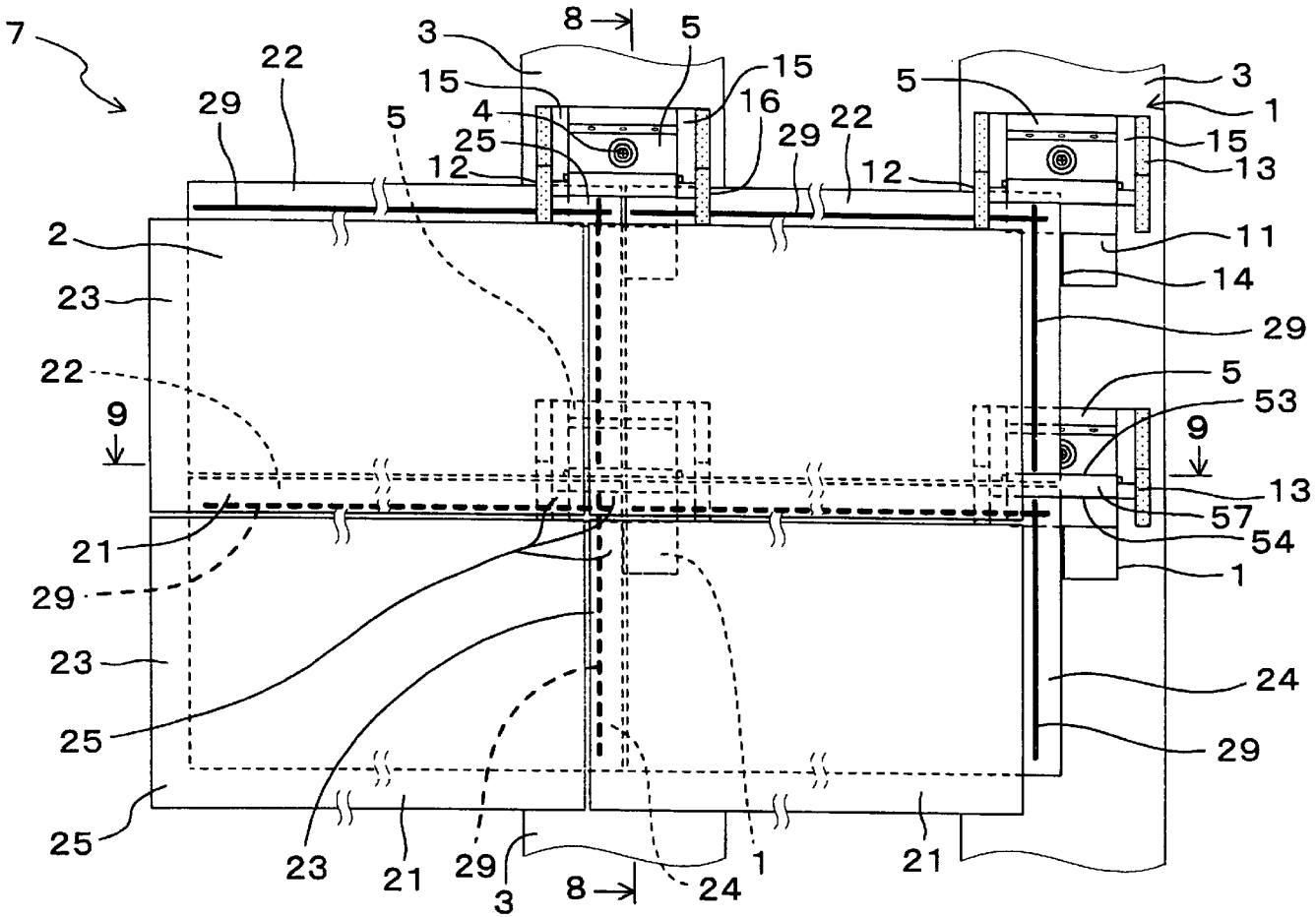
FIG. 6 is a front view of a siding boards attachment structure according to the Embodiment 1.

A sealing member 1 is used together with a fastening fitting 5 shown in FIG. 4A, and is arranged at the back of the fastening fitting 5, as shown in FIG. 4B. The fastening fitting 5 is adopted to mount a siding board 2 with a four side shiplap structure having an upper underlying tongue portion 22 and a lower overlying tongue portion 21 and a lateral underlying tongue portion 24 and a lateral overlying tongue portion 23 provided laterally on an underlayment 3, as shown in FIG. 6, and is disposed at a portion at which corner portions 25 of the four siding boards 2 are disposed to be opposed to each other, i.e., at the top and bottom and left and right joint portions.

Figures 2A, 2B, 2C:
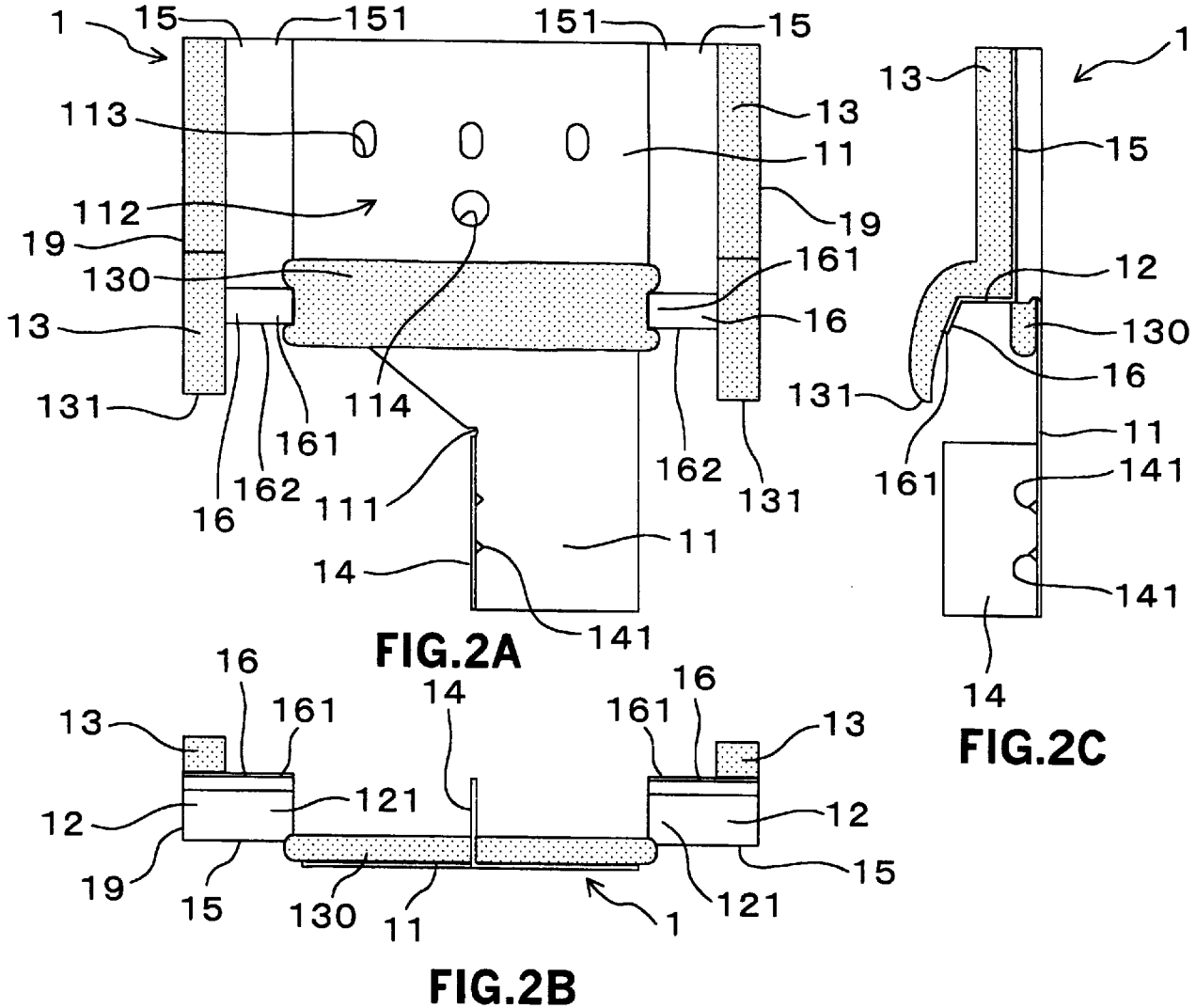
FIG. 2A is a front view of the sealing member according to the Embodiment 1.
FIG. 2B is a plan view of the sealing member according to the Embodiment 1.
FIG. 2C is a side view of the sealing member according to the Embodiment 1.
Figure 3:
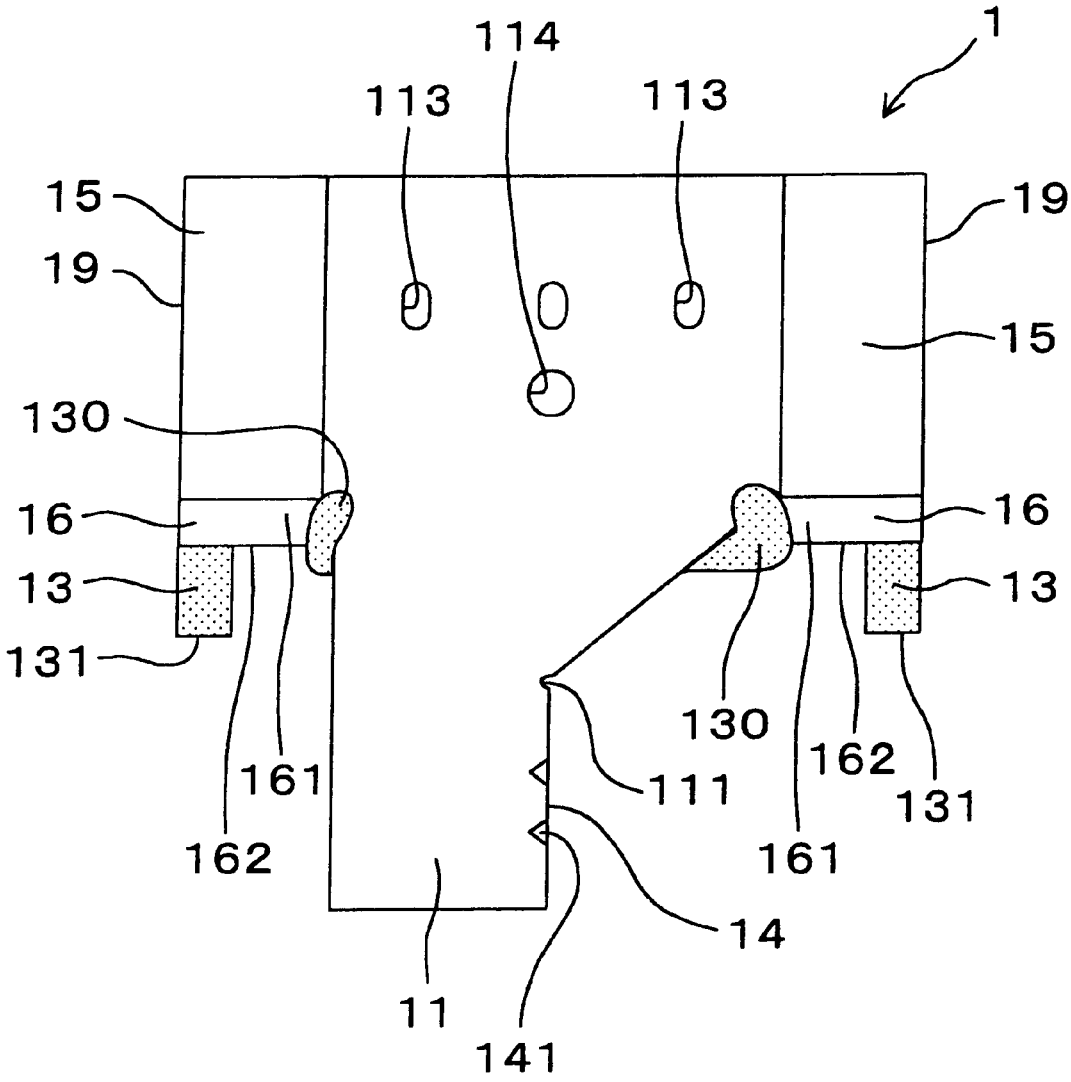
FIG. 3 is a back side view of the sealing member according to the Embodiment 1.

The sealing member 1 has a base plate portion 11 fixed to the underlayment 3, a pair of horizontally rising plate portions 12 provided at the left and right sides of the base plate portion 11 and erected forward in a horizontal direction and an inclined portion 16 bent diagonally downward from its front end, as shown in FIG. 1 to FIG. 3.

The base plate portion 11 provides a forward protrusion 15 that has a width substantially equal to the width of the horizontally rising plate portion 12 and protrudes forward at upward portion of the left and right horizontally rising plate portions 12.

A storage recess 112 having a width substantially equal to the width of the fastening fitting 5 is formed between these left and right forward protrusions 15.

A lateral elastic material 13 is arranged at the top faces of the horizontally rising plate portion 12 and the inclined portion 16 and at the front face of the forward protrusion 15.

The forward protrusion 15 rises forwardly by about 90 degrees and about 3.5 mm at the left and right sides of the base plate portion 11, and further, bent by about 90 degrees toward the outside, and a plane surface that is substantially parallel to the base plate portion 11 is formed. The storage recess 112 between the forward protrusions 15 is constituted so as to keep and place the fastening fitting 5, as shown in FIG. 4B. The width of the storage recess 115 is formed to be wider than that of the fastening fitting 5 by about 0.5 mm. In addition, the depth of the storage recess 112 is formed to be an extent such that the fixing plate portion 11 of the fastening fitting 5 protrudes by about 2 mm.

The lateral elastic material 13 is provided at a portion excepting inner ends 151, 121, and 161 at the forward protrusion 15, the horizontally rising plate portion 12, and the inclined portion 16.

That is, the lateral elastic material 13 is provided only at a portion having a width of about 5 mm from a side end 19 of the sealing member 1 at the forward protrusion 15, the horizontally rising plate portion 12, and the inclined portion 16. This elastic material is not provided inner ends 151, 121, and 161 having a width of about 10 mm that is closer to the center side of the sealing member 1.

The lateral elastic material 13 is extended over a tip end 162 of the inclined portion 16. A backward elastic material 130 continuously provided between the left and right horizontally rising plate portions 12 is provided at the storage recess 112.

As shown in FIG. 1 and FIG. 2, a vertically rising plate portion 14 erected forward in a vertical direction is provided at the bottom of the base plate portion 11.

The sealing member 1 is fabricated by cutting and bending a metal plate such as stainless steel. The lateral elastic material 13 and backward elastic material 130 are foam bodies having closed cells made of EPDM or the like.

As shown in FIG. 2A, the base plate portion 11 of the sealing member 1 has through holes 113 and 114 at positions that correspond to a nail hole 552 and a screw hole 512 that are formed at the fastening fitting 5.

At bent portions of the sealing member 1, i.e., at the proximal end of the forward protrusion 15, at the proximal end of the horizontally rising plate portion 12, and at the proximal end of the vertically rising plate portion 14, there is provided a notch 111 for facilitating bending. As shown in FIG. 2C, at a bent portion at which the vertically rising plate portion 14 of the sealing member 1 is bent, there is provided a cavity 141 for reinforcing the vertically rising plate portion 14.

The proximal end of the forward protrusion 15 and the notch 111 at the proximal end of the horizontally rising plate portion 12 are covered with the backward elastic material 130. That is, as shown in FIG. 3 (a view of which the sealing member is seen from the rear face side), the backward elastic material 130 is adhered with both ends thereof rounded to the rear side of the base plate portion 11.

The fastening fitting 5 has a fixing plate portion 51 abutting against the rear side surface 26 of the siding boards 2 arranged vertically (FIG. 11) and a supporting portion 52 erected forward over the full width of the fixing plate portion 51, as shown in FIG. 4A. In addition, an upper board engaging portion 53 bent diagonally upward and a lower board engaging portion 54 bent diagonally downward are formed from a front end 521 of the supporting portion 52. A forward flat plate portion or front flat plate 57 is continuously provided between tip ends of the upper board engaging portion 53 and the lower board engaging portion 54.

The fixing plate portion 51 has a step portion 55 retracted diagonally backward at its top end and a bent portion 56 bent backward at approximately 90 degrees at its lower end. A screw hole 512 for inserting a screw 4 to be fixed to the underlayment 3 is formed at the fixing plate portion 51. In addition, a nail hole 552 is provided at the step portion 55 as well, and the fastening fitting 5 can be fixed to the underlayment 3 by inserting the nail through the hole.

A cut-raised portion 513 which is cut and raised forwardly is provided at the bottom of the fixing plate portion 51, and the cut-raised portion 513 is cut into a rear side surface 26 of the siding board 2 arranged downward, thereby preventing lateral movement, and improving fixing force (FIG. 11).

Now, a siding boards attachment structure 7 of four side shiplap structure in which the ceramic type siding board 2 is mounted on the underlayment 3 using the sealing member 1 and the fastening fitting 5 will be described primarily with reference to FIG. 5 to FIG. 11.

Figure 8:
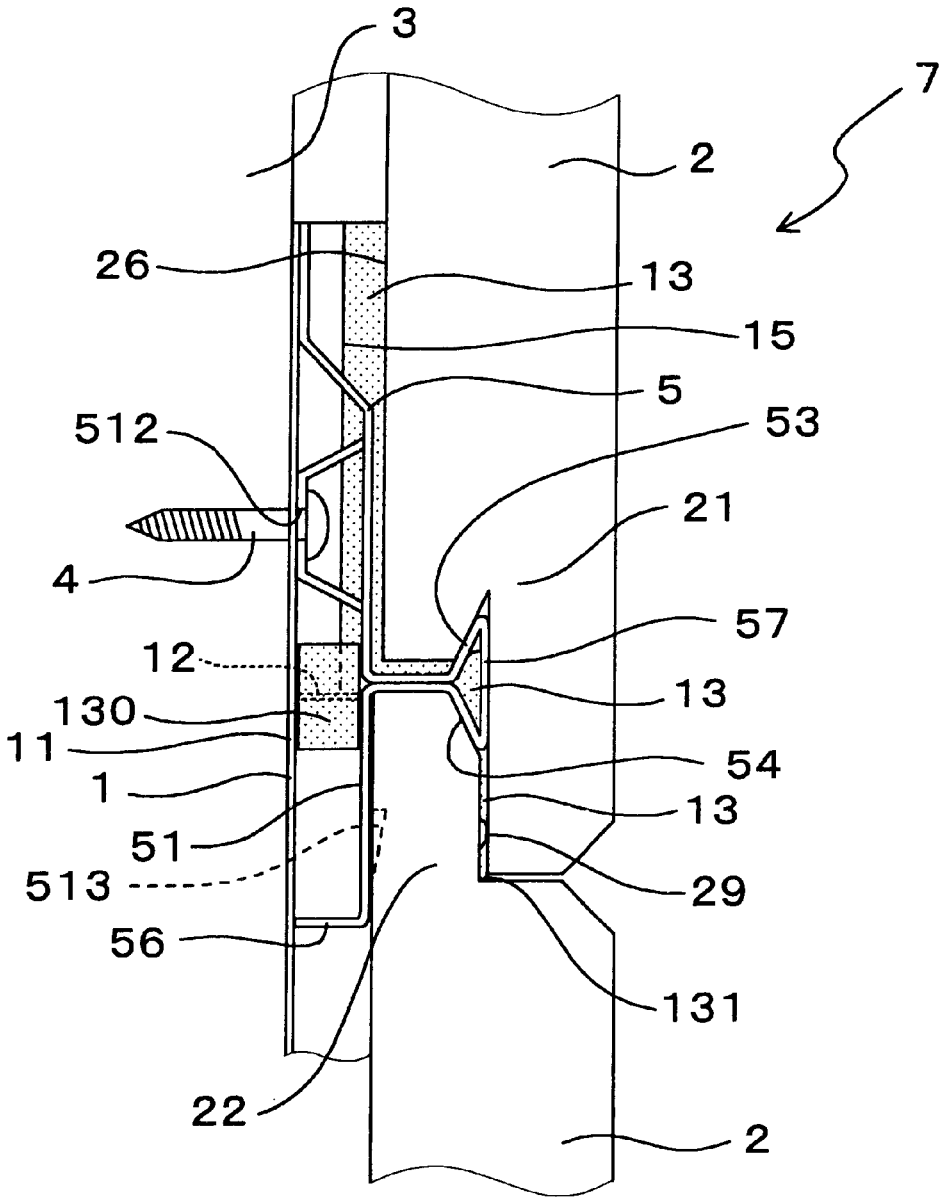
FIG. 8 is a longitudinal cross section illustrating a joint portion of the upper-lower side shiplap structure taken along line 8—8 of FIG. 6.
Figure 9:
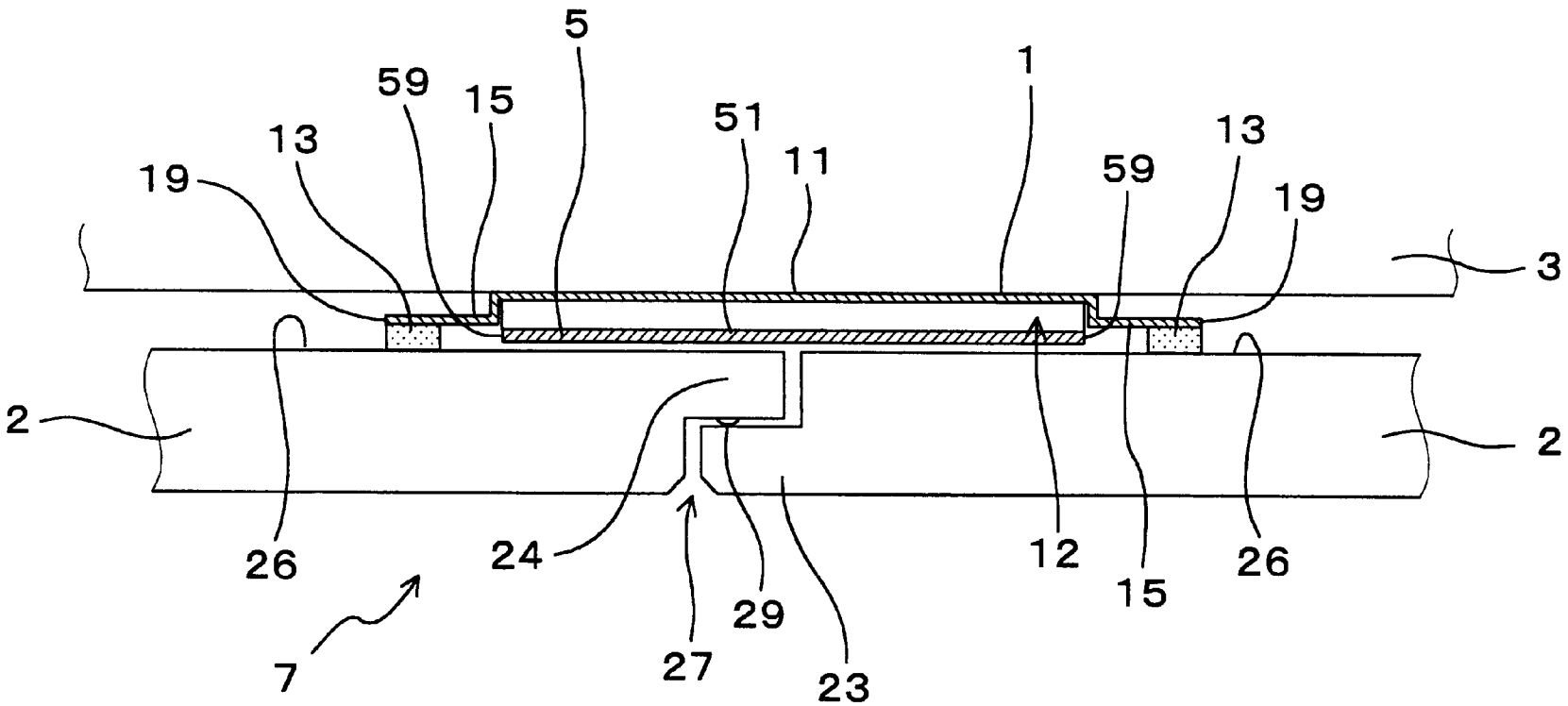
FIG. 9 is a lateral cross section illustrating a joint portion of the left-right shiplap structure taken along line 9—9 of FIG. 6.

FIG. 5 is a perspective view of the siding board 2; FIG. 6 is a front view of the siding boards attachment structure 7; FIG. 8 is a longitudinal cross section of a joint portion of the upper and lower siding boards 2; and FIG. 9 is a lateral cross section of a joint portion of the left and right siding boards 2.

In FIG. 6, some of the sealing member 1, fastening fitting 5 and siding boards 2 are omitted for the purpose of clarity.

Prior to a description of the siding boards attachment structure 7 (FIG. 6) of the present embodiment, the shape of the lower overlying tongue portion 21 and the upper underlying tongue portion 22 of the siding board 2 and an engagingly locking state of them by the fastening fitting 5 will be described with reference to FIG. 7 and FIG. 11.

Figure 7A:
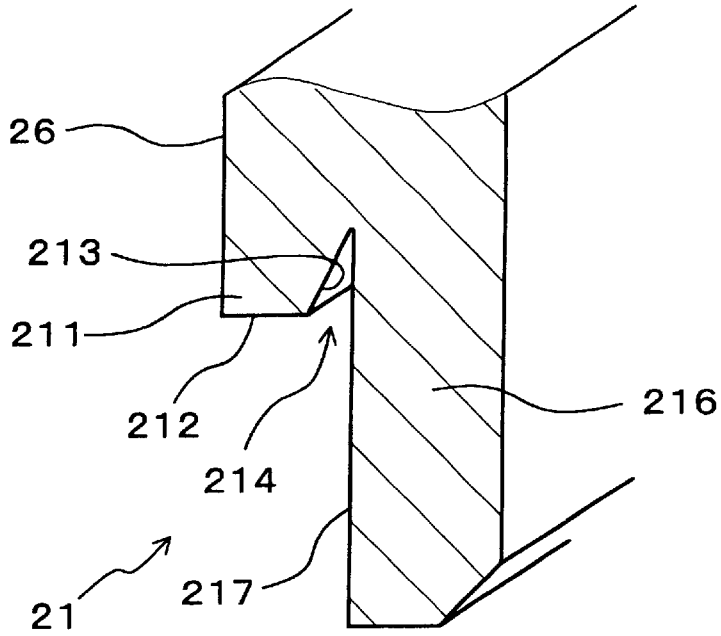
FIG. 7A is a perspective view of a lower overlying tongue portion of the siding board according to the Embodiment 1.

The lower overlying tongue portion 21 of the siding board 2 consists of a lower engagement portion 211 to be engaged into a space formed by the fixing plate portion 51, the supporting portion 52 and the upper board engaging portion 53 of the fastening fitting 5, and a surface lower end portion 216 extending downward under the lower engagement portion 211 in front of the lower engaging portion 211, as shown in FIG. 7A. The lower engagement portion 211 has a lower end face 212 to be supported by the supporting portion 52 and an inclined face 213 engagingly locked with the upper board engaging portion 53.

A notched groove portion 214 is formed between the inclined face 213 and a rear side surface 217 of the surface lower end 216 by means of them.

As shown in FIG. 11, the upper board engaging portion 53 and the front flat plate 57 of the fastening fitting 5 is engaged into the notched groove portion 214. In this manner, the front flat plate 57 comes into contact with a rear side surface 217 of the surface lower end 216, and the upper board engaging portion 53 engagingly locks the inclined face 213 to provide the state that the upper board engaging portion 53 is engagingly locked with the lower overlying tongue portion 21.

Figure 7B:
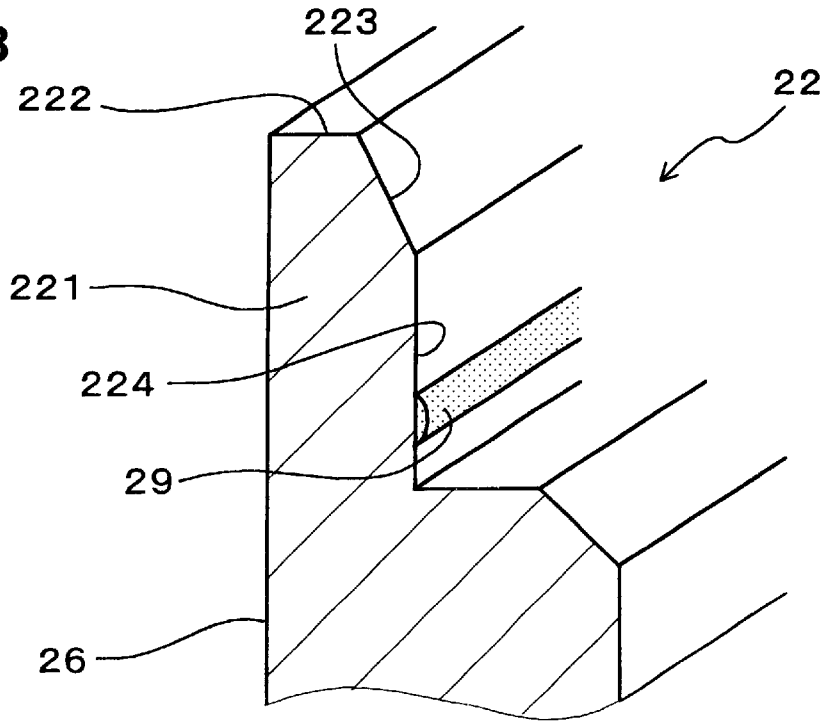
FIG. 7B is a perspective view of an upper underlying tongue portion of the siding board.

On the other hand, the upper underlying tongue portion 22 of the siding board 2 has a rear face upper end 221 formed backward from the front side by cutting out a top side at the upper end of the siding board 2, as shown in FIG. 7B. An inclined face 223 is formed at a corner portion between the upper end face 222 and front face 224 of the rear face upper end 221.

The back side upper end 221 is constituted so as to be engaged into a space formed by the fixing plate portion 51, the supporting portion 52, and the lower board engaging portion 53 of the fastening fitting 5.

That is, as shown in FIG. 11, the upper end face 222 of the rear face upper end 221 is abutted against the supporting portion 52, and the inclined face 223 is engagingly locked with the bottom face engagingly locking portion 54 to provide the state that the lower board engaging portion 54 is engagingly locked with the upper underlying tongue portion 22.

As shown in FIG. 7B, a caulking material 29 is attached on a front face 224 of the rear face upper end 221. A rear side surface 217 of a surface lower end 216 at the lower overlying tongue portion 21 of the upper siding board 2 is superimposed on the front face 224 of the rear face upper end 221 at the upper underlying tongue portion 22 of the lower siding board 2 so as to join the siding boards through an upper-lower side shiplap structure (FIG. 1).

As shown in FIG. 8 and FIG. 10, in the siding boards attachment structure 7 of the present embodiment, the sealing member 1 and the fastening fitting 5 arranged to be superimposed in front of the sealing member 1 are fixed to the underlayment 3 together by a screw 4 of a fastening.

In the adjacent two siding boards 2 disposed downward of the fastening fitting 5, the upper underlying tongue portion 22 is engagingly locked with the lower board engaging portion 54 of the fastening fitting 5, as shown in FIG. 10. In addition, the upper underlying tongue portion 22 is engagingly locked with an inclined portion 16 of the sealing member 1 as well.

At the adjacent two siding boards 2 disposed upward of the fastening fitting 5, as shown in FIG. 10, the lower overlying tongue portion 21 is placed on the supporting portion 52 of the fastening fitting 5, and is engagingly locked with the upper board engaging portion 53.

At the siding board 2, as shown in FIG. 5, a caulking material 29 is attached on the upper underlying tongue portion 22 and the lateral underlying tongue portion 24. The lower overlying tongue portion 21 or lateral overlying tongue portion 23 of another siding board is superimposed over this caulking material 29, and the caulking material 29 is pressed, thereby preventing water penetration from the joint clearance portion of each of the siding boards 2 (FIG. 11).

The caulking material 29 may be attached on the rear side surface of the lower overlying tongue portion 21 and lateral overlying tongue portion 23 of the siding board 2.

As shown in FIG. 10, in the siding boards attachment structure 71 the fastening fitting 5 is kept and placed at a storage recess 112 of the sealing member 1.

As shown in FIG. 8 to FIG. 11, the lateral elastic material 13 of the sealing member 1 comes into close contact with the rear side surface 26 and lower overlying tongue portion 21 of the upper siding board 2.

As shown in FIG. 10, a water conduit 71 communicating from the joint clearance portion 270 of the upper and lower siding boards 2 to the front face of the wall is formed at the inside of the lateral elastic material 13 in the sealing member 1.

As shown in FIG. 10 and FIG. 11, a lower end 131 of the lateral elastic material 13 of the sealing member 1 is disposed downward under the caulking material 29 formed at the upper underlying tongue portion 22 of the siding board 2.

A backward elastic material 130 provided at the storage recess 112 of the sealing member 1 comes into close contact with the rear side surface of the fixing plate portion 51 of the fastening fitting 5. The backward elastic material 130 closes notches 111 at the proximal end of the forward protrusion 15 and at the proximal end of the horizontally rising plate portion 12 of the sealing member 1, thereby preventing water penetration into the rear side of the sealing member 1 from them.

As shown in FIG. 17, a side face of the lateral underlying tongue portion 24 of the siding board 2 under the sealing member 1 abuts against the vertically rising plate portion 14 provided at the sealing member 1.

Now, a method for constructing the siding boards attachment structure 7 will be described primarily with reference to FIG. 12 to FIG. 16. The following description corresponds to a description of some constructing steps using the method of attaching siding boards.

That is, the method of attaching siding boards includes the following first to sixth steps.

Figure 12:
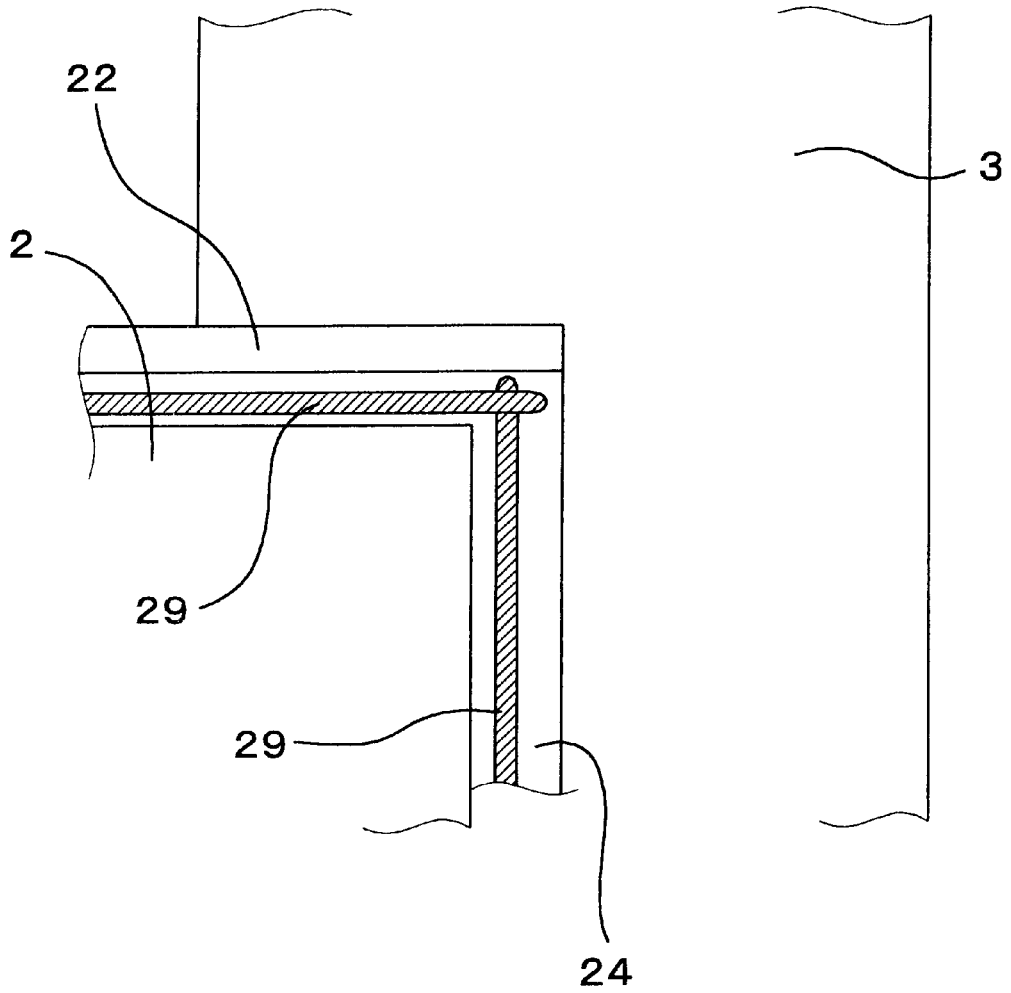
FIG. 12 is an illustrative view of a state of that a first step of the method of attaching siding boards is terminated according to the Embodiment 1.

At the first step, as shown in FIG. 12, a first siding board 2 is disposed at the back material 3.

Figure 13:
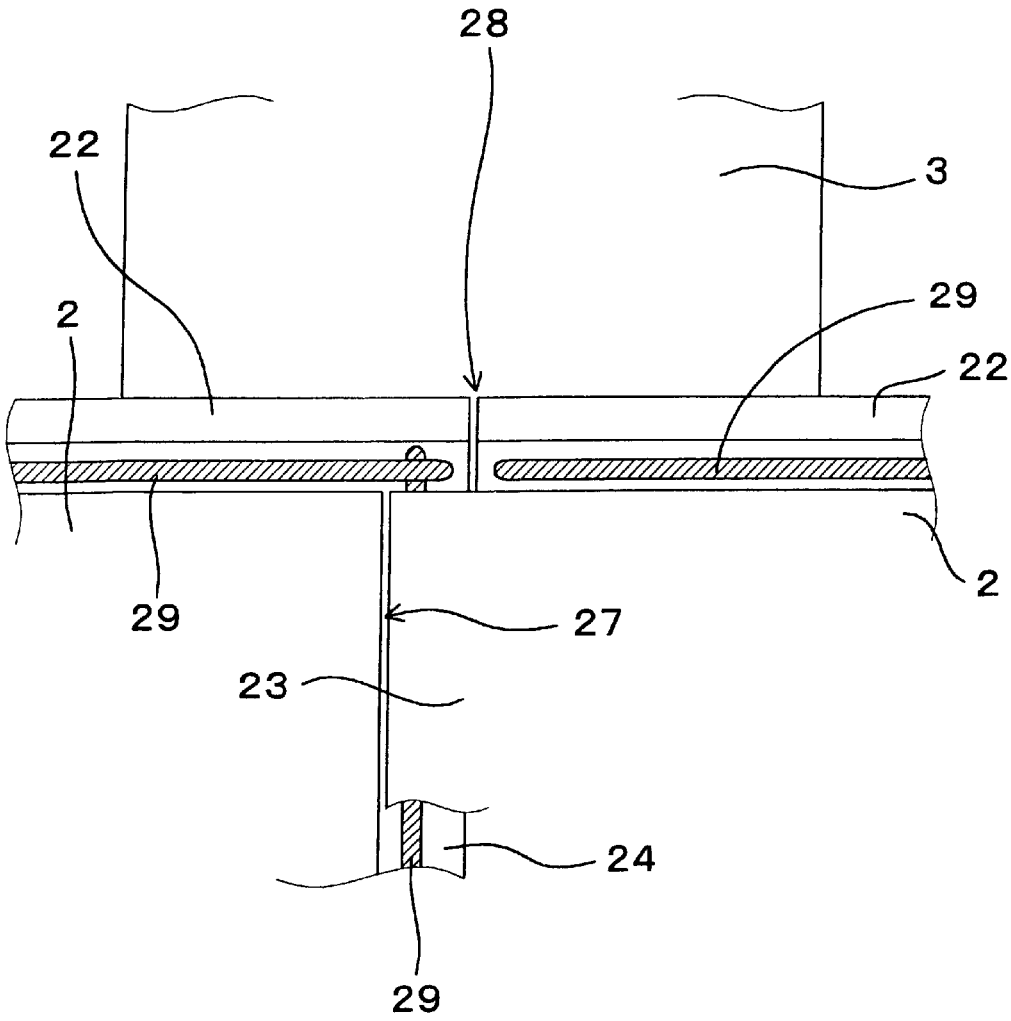
FIG. 13 is an illustrative view of a state of that a second step of the method of attaching siding boards is terminated according to the Embodiment 1.

At the second step, as shown in FIG. 13, a lateral overlying tongue portion 23 of a second siding board 2 is jointed to a lateral underlying tongue portion 24 of the first siding board 2 through a left-right side shiplap joint, as shown in FIG. 13, and the second siding board 2 is disposed at the underlayment 3.

Figure 14:
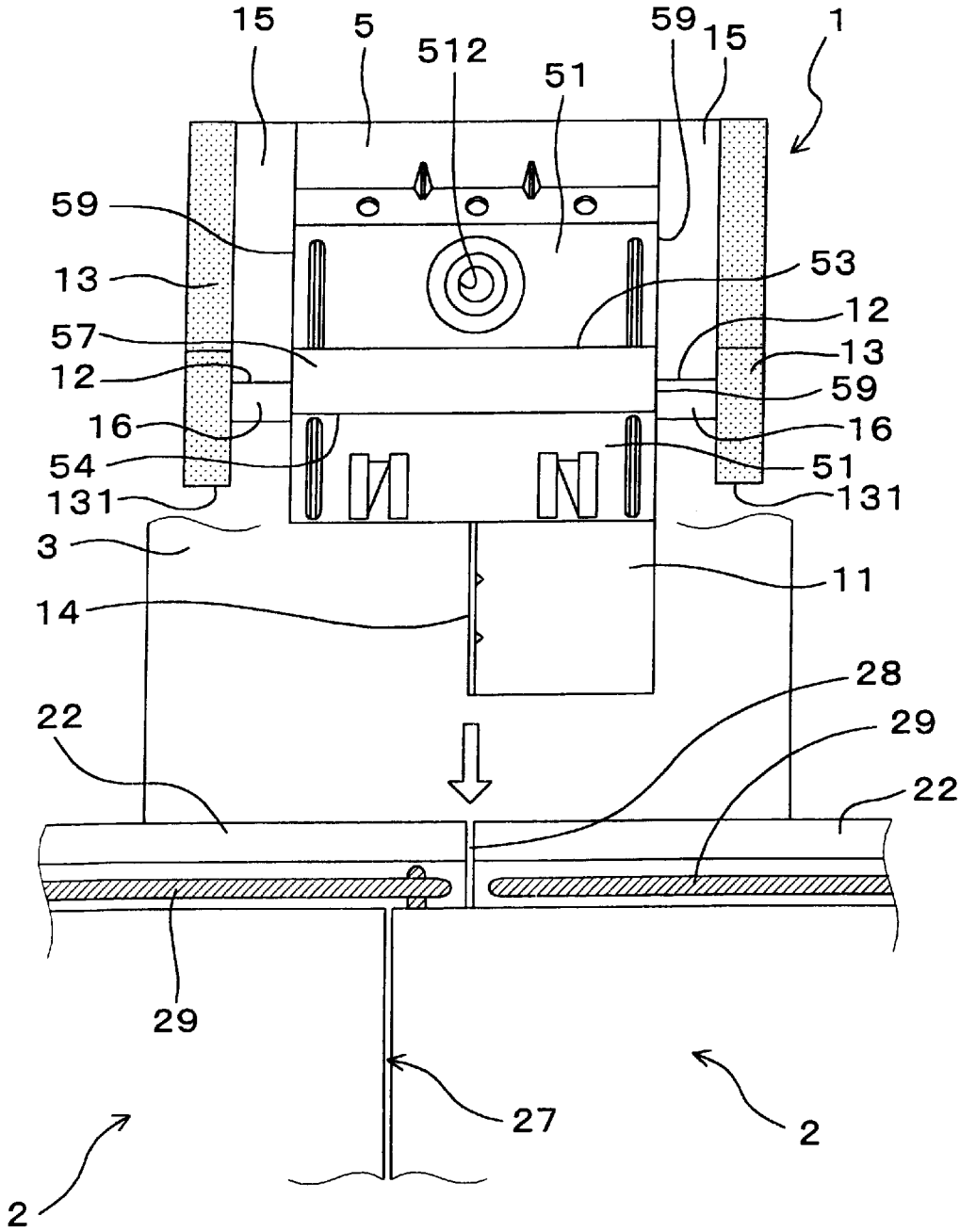
FIG. 14 is an illustrative view of a third step of the method of attaching siding boards according to the Embodiment 1.

At the third step, as shown in FIG. 14, a fastening fitting 5 is disposed at a storage recess 112 of the sealing member 1.

At this time, a bent portion 56 that is a lower end of the fastening fitting 5 abuts against the vertically rising plate portion 14 of the sealing member 1. In addition, the screw hole 512 of the fastening fitting 5 is superimposed on a through hole 114 of the sealing member.

In this state, the base plate portion 11 of the sealing member 1 and the fixing plate portion 51 of the fastening fitting 5 are inserted between the underlayment 3 and the siding board 2.

The vertically rising plate portion 14 of the sealing member 1 is inserted into a rear side joint clearance 28 of about 1 mm at the rear face side of the left and right siding boards 2.

Figure 15:
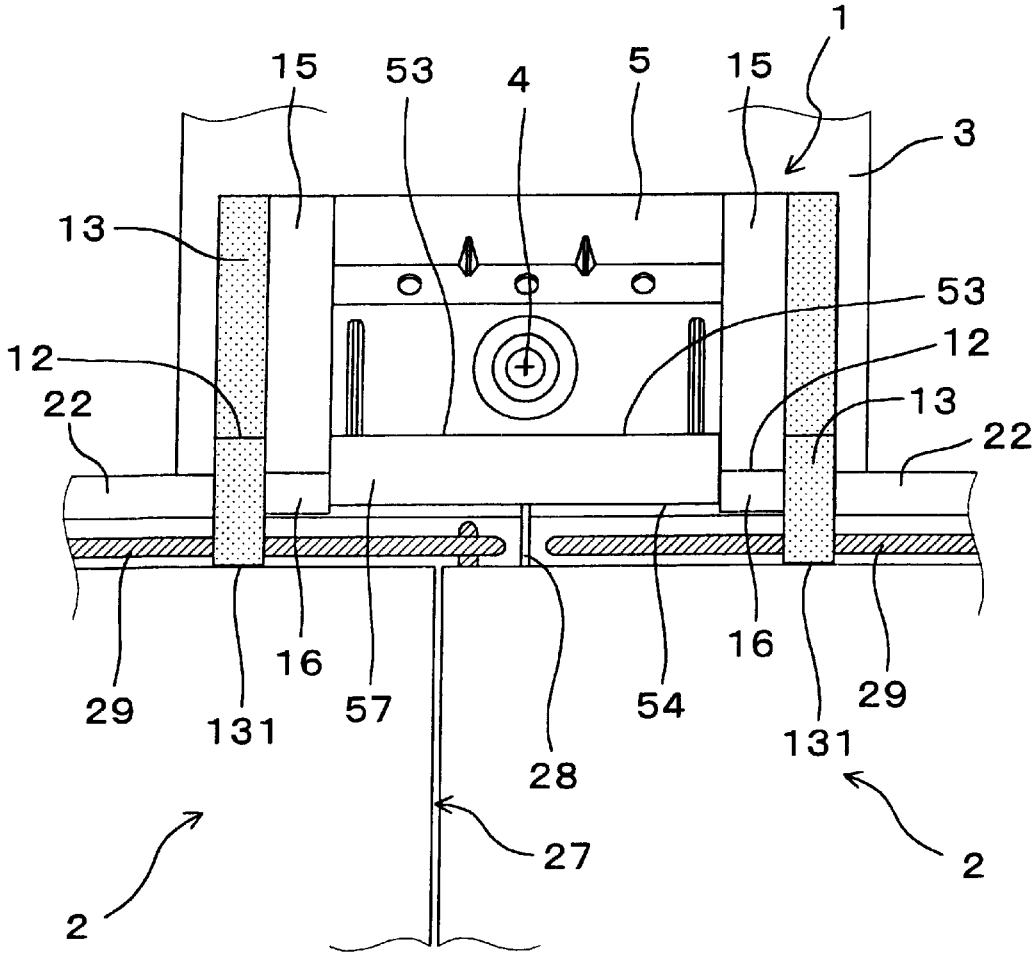
FIG. 15 is an illustrative view of a state of that a fourth step of the method of attaching siding boards is terminated according to the Embodiment 1.

At the fourth step, as shown in FIG. 15, the bottom end engagingly locking portion 54 of the fastening fitting 5 is engagingly locked with the upper underlying tongue portion 22 of the siding board 2, and the inclined portion 16 of the sealing member 1 is engagingly locked with the upper underlying tongue portion 22 of the siding board 2.

At this time, as shown in FIG. 17, the vertically rising plate portion 14 of the sealing member 1 is pressed laterally against a side face of the lateral underlying tongue portion 24 of the first siding board 2. In addition, a tip end 131 of the lateral elastic material 13 is disposed downward under the caulking material 29 at the upper underlying tongue portion 22 of the siding board 2.

A screw 4 is inserted into a screw hole 512 of the fastening fitting 5 and a through hole 114 of the sealing member 1, and the sealing member 1 and fastening fitting 5 are fixed to the underlayment 3 by means of the screw 4.

Figure 16:
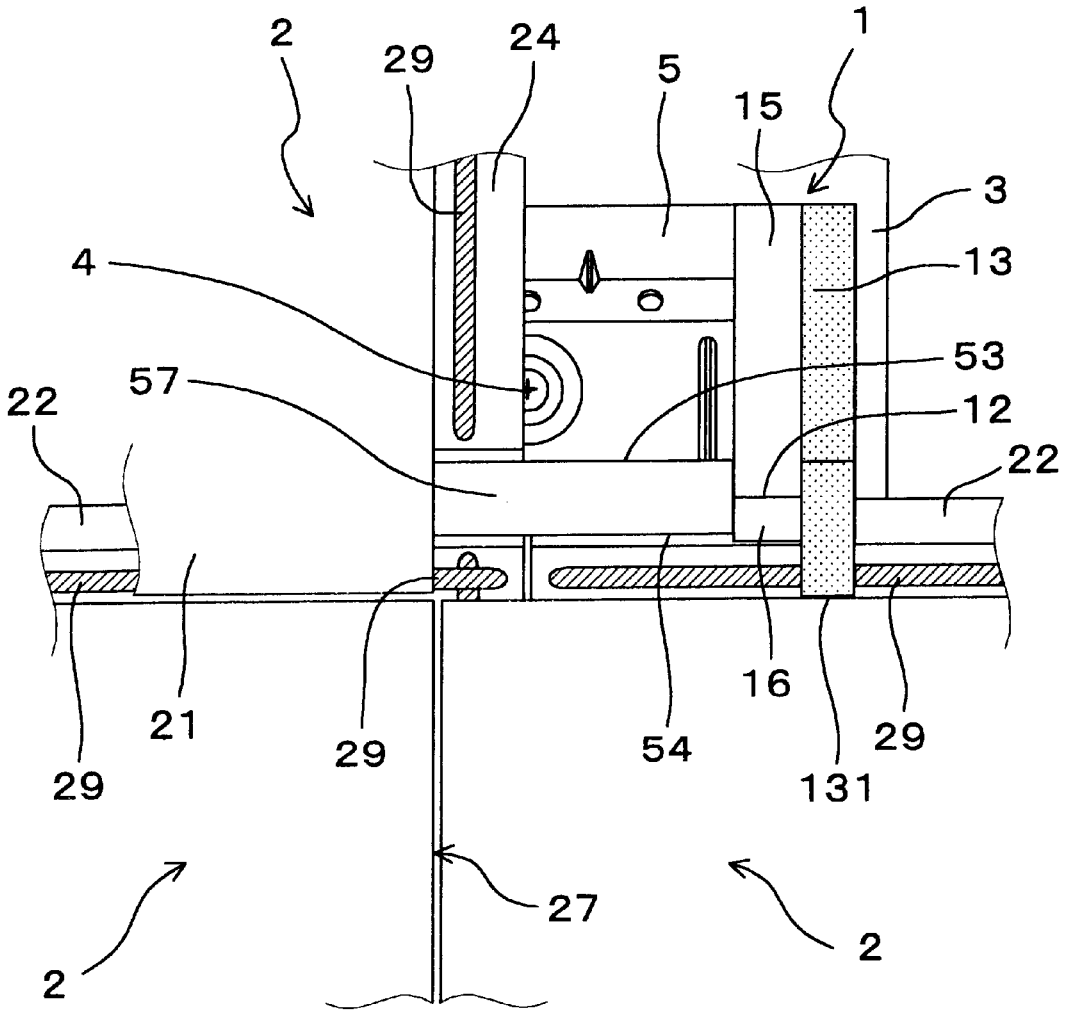
FIG. 16 is an illustrative view of a state of that a fifth step of the method of attaching siding boards is terminated according to the Embodiment 1.

At the fifth step, as shown in FIG. 16, in disposing a third siding board 2, the lower overlying tongue portion 21 of the third siding board 2 is superimposed on the upper underlying tongue portion 22 of the first siding board 2, and is engagingly locked with the upper board engaging portion 53 of the fastening fitting 5.

At this time, the lower overlying tongue portion 21 and rear side surface 26 of the third siding board 2 is brought into close contact with a lateral elastic material 13 of the sealing member 1.

At the sixth step, in disposing a fourth siding board 2, the lower overlying tongue portion 21 of the fourth siding board 2 is superimposed on the upper underlying tongue portion 22 of the second siding board 2, the lateral overlying tongue portion 23 of the fourth siding board 2 is superimposed on the lateral underlying tongue portion 24 of the third siding board 2, and the lower overlying tongue portion 21 of the fourth siding board 2 is engagingly locked with the upper board engaging portion 53 of the fastening fitting 5.

By repeating the first to sixth steps, there is obtained a siding boards attachment structure 7 in which the siding board 2 is fastened to the underlayment 3 by using the sealing member 1 and the fastening fitting 5 (FIG. 6).

Now, advantageous effects of the present embodiment will be described here.

As described above, in the sealing member 1, the forward protrusion 15 is provided at the base plate portion 11, and a storage recess 112 having a width substantially equal to the width of the fastening fitting 5 is formed between the left and right forward protrusions 15.

Therefore, in constructing the siding boards attachment structure 7, as shown in FIG. 4B, the fastening fitting 5 can be kept and placed in the storage recess 112. In this manner, during construction, the sealing member 1 and the fastening fitting 5 can be easily disposed on the underlayment.

The storage recess 112 has a width substantially equal to the width of the fastening fitting 5. Thus, when the fastening fitting 5 is disposed at the storage recess 112, displacement between them can be prevented. Therefore, the sealing member 1 and the fastening fitting 5 can be easily and stably fixed to the underlayment 3.

As described above, the lateral elastic material 13 is arranged at the top face of the horizontally rising plate portion 12 and the inclined portion 16 and at the front face of the forward protrusion 15 of the sealing member 1. Thus, in the siding boards attachment structure 7, as shown in FIG. 8, the lateral elastic material 13 comes into close contact with the rear side surface 26 and lower overlying tongue portion 21 of the siding board 2.

Thus, even if rain water penetrates the joint clearance portion 27 in the longitudinal direction of the two upper left and right siding boards 2, that is, a clearance between the lateral underlying tongue portion and the lateral overlying tongue portion 23, water does not penetrate the inside of the siding boards attachment structure 7. On this case, a description will be given below primarily with respect to FIG. 17 to FIG. 19.

FIG. 17 is a perspective view illustrating a siding boards attachment structure 7 according to the present embodiment. A siding board 2 at the right side of the fastening fitting 5 is omitted for clarity. FIG. 18 is a front view illustrating the siding boards attachment structure 7, wherein the contour of the siding board 2 actually seen from the front face is indicated by solid line, the backward fastening fitting 5 at the rear side and sealing member 1 are indicated by double-dotted chain line, and a portion that cannot be actually seen from the front face is indicated by broken line.

FIG. 19 is a sectional view of the siding boards attachment structure taken along a flat face (cross section taken along 19—19 of FIG. 11) that passes through the caulking material 29, and is an illustrative view of a flow of rain water 6 at that portion.

As shown in FIG. 17 to FIG. 19, the rainwater 6 penetrating the joint clearance portion 27 is inhibited from lateral movement by means of the caulking material 29, and drops downward through the joint clearance portion 27. Then, the rain water 6 passes through the front face of the front flat plate 57 of the fastening fitting 5, and further, moves and drops downward through the joint clearance portion 27.

In addition, a part of the rain water 6 moving laterally through the front flat plate 57 travels over the upper board engaging portion 53, as shown in FIG. 17, moves over the supporting portion 52, and then, moves to both side ends 59 of the supporting portion 52.

As described above, the lateral elastic material 13 provided at the sealing member 1 comes into close contact with the lower overlying tongue portion 21 and rear side surface 26 of the siding board 2 at the left and right sides of the both side ends 59 of the fastening fitting 5.

Therefore, even if the rain water 6 penetrates the joint clearance portion 27, the rain water is dammed by the lateral elastic material 13 (FIG. 17 to FIG. 19). That is, the rain water 6 moving in transverse direction through the front flat plate 57 is dammed by the lateral elastic material 13 in close contact with the lower overlying tongue portion 21 of the siding board 2 (rear side surface 217 of the surface lower end 216 (FIG. 11)). In addition, even if the rain water 6 moves to the top face of the supporting portion 52 or penetrates between the siding board 2 and the fixing plate portion 51 of the fastening fitting 5, the rain water is dammed by the lateral elastic material 13 in close contact with the lower overlying tongue portion 21 and rear side surface 26 of the siding board 2.

The lateral elastic material 13 is not provided at inward ends 151, 121, and 161 at the forward protrusion 15, the horizontally rising plate portion 12, and the inclined portion 16.

In this way, as shown in FIG. 17 to FIG. 19, the rain water 6 dammed by the lateral elastic material 13 travels from the inward inclined portion 16 or forward protrusion 15 and horizontally rising plate portion 12, which are inside the lateral elastic material 13, through the inclined portion 16, and is discharged from the joint clearance portion 270 of the upper and lower siding boards 2 forward of the wall face. That is, a water conduit 71 guiding the rain water 6 forward of the wall face is formed inside the lateral elastic material 13.

Thus, the rain water 6 penetrating the joint clearance portion 27 of the left and right siding boards 2 can be positively discharged from the joint clearance portion 270 of the upper and lower siding boards 2. Therefore, water penetration into the siding boards attachment structure 7 can be prevented more reliably.

The lateral elastic material 13 is provided to extend over a tip end 162 of the inclined portion 16. A tip end 131 of the lateral elastic material 13 is disposed downward under the caulking material 29 formed at the upper underlying tongue portion 22 of the siding board 2.

In this manner, a part of the rain water 6 discharged forward of the wall face through the inclined portion 16 inward from the lateral elastic material 13 can be reliably prevented from leaking outwardly from the lateral elastic material 13. That is, the rain water 6 can be reliably guided downward under the caulking material 29, and thus, the rain water 6 can be reliably discharged forward of the wall face (FIG. 19). Therefore, water penetration into the siding boards attachment structure 7 can be prevented more reliably.

A backward elastic material 130 continuously provided between the left and right horizontally rising plate portions 12 is provided at the storage recess 112, and the backward elastic material 130 comes into close contact with the rear side of the fixing plate portion 51 of the fastening fitting 5 and the side end 59 thereof.

Therefore, rain water can be reliably prevented from leaking downward from a space between the supporting portion 52 of the fastening fitting 5 and the horizontally rising plate portion 12 of the sealing member 1. In addition, notches 111 at the proximal end of the forward protrusion 15 of the sealing member 1 and at the proximal end of the horizontally rising plate portion 12 of the sealing member 1 is closed by the lateral elastic material 130, whereby water leakage from the notch 111 can be reliably prevented.

In this way, the rain water 6 can be reliably prevented from penetrating the inside of the siding boards attachment structure 7 by using the sealing member 1, and corrosion or degradation of the siding board 2 or underlayment 3 and the like can be reliably prevented.

In addition, the lateral elastic material 13 is arranged at the forward protrusion 112 that extrudes forward from the base plate portion 11. Thus, the lateral elastic material 13 can be brought into close contact with the rear side surface 26 of the siding board 2 without particularly increasing the thickness of the elastic material 13 (FIG. 8 and FIG. 9). Therefore, an inexpensive sealing member 1 can be obtained because the thickness of the lateral elastic material 13 is decreased.

The base plate portion 11 of the sealing member 1 has through holes 113 and 114 at positions that correspond to a nail hole 552 and a screw hole 512 formed at the fastening fitting 5. Thus, the sealing member 1 can be easily and precisely fixed age to the underlayment 3.

As shown in FIG. 17, the vertically rising plate portion 14 is provided at the bottom of the base plate portion 11 of the sealing member 1, and a side face of the lateral underlying tongue portion 24 of the lower siding board 2 abuts against the vertically rising plate portion 14. In this manner, the lateral displacement of the siding board 2 after construction can be reliably prevented.

The elastic material 13 is made of a foam body with closed cells that consist of EPDM or the like, therefore the penetration of the rain water 6 can be prevented more reliably.

Further, by using the method of attaching siding boards as described above, the elastic material 13 can be easily and reliably installed to come into close contact with the front flat plate 57, the supporting portion 52, and the side end 59 of the fixing plate portion 51 of the fastening fitting 5, and the rear side surface 26 and the lower overlying tongue portion 21 of the upper siding board 2.

As described above, according to the present embodiment, in the siding boards attachment structure of the four side shiplap structure, there can be provided a sealing member capable of reliably preventing rain water penetration and achieving easy and stable construction.

Embodiment 2

Figure 20:
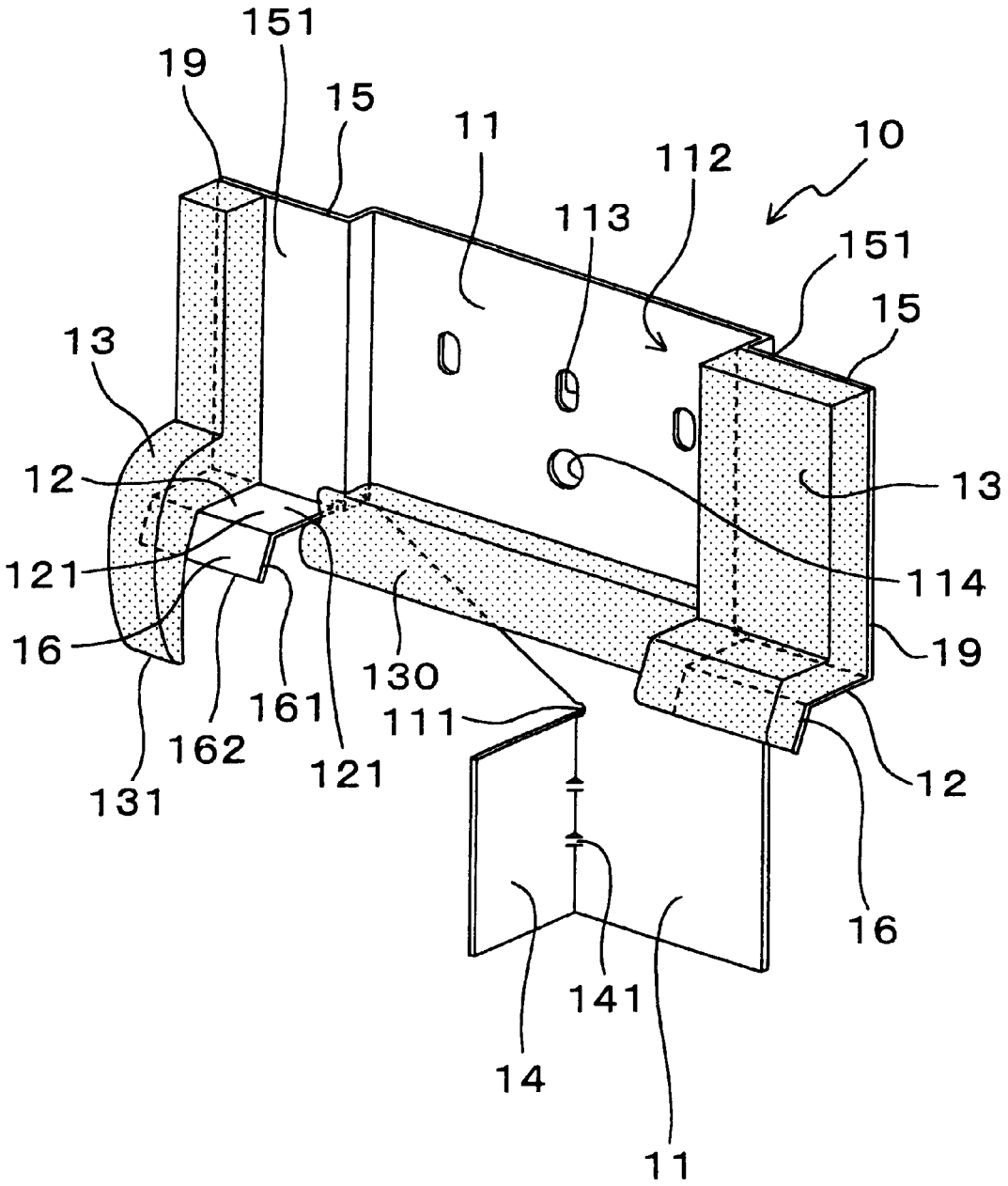
FIG. 20 is a perspective view of the sealing member according to the Embodiment 2.
Figure 22:
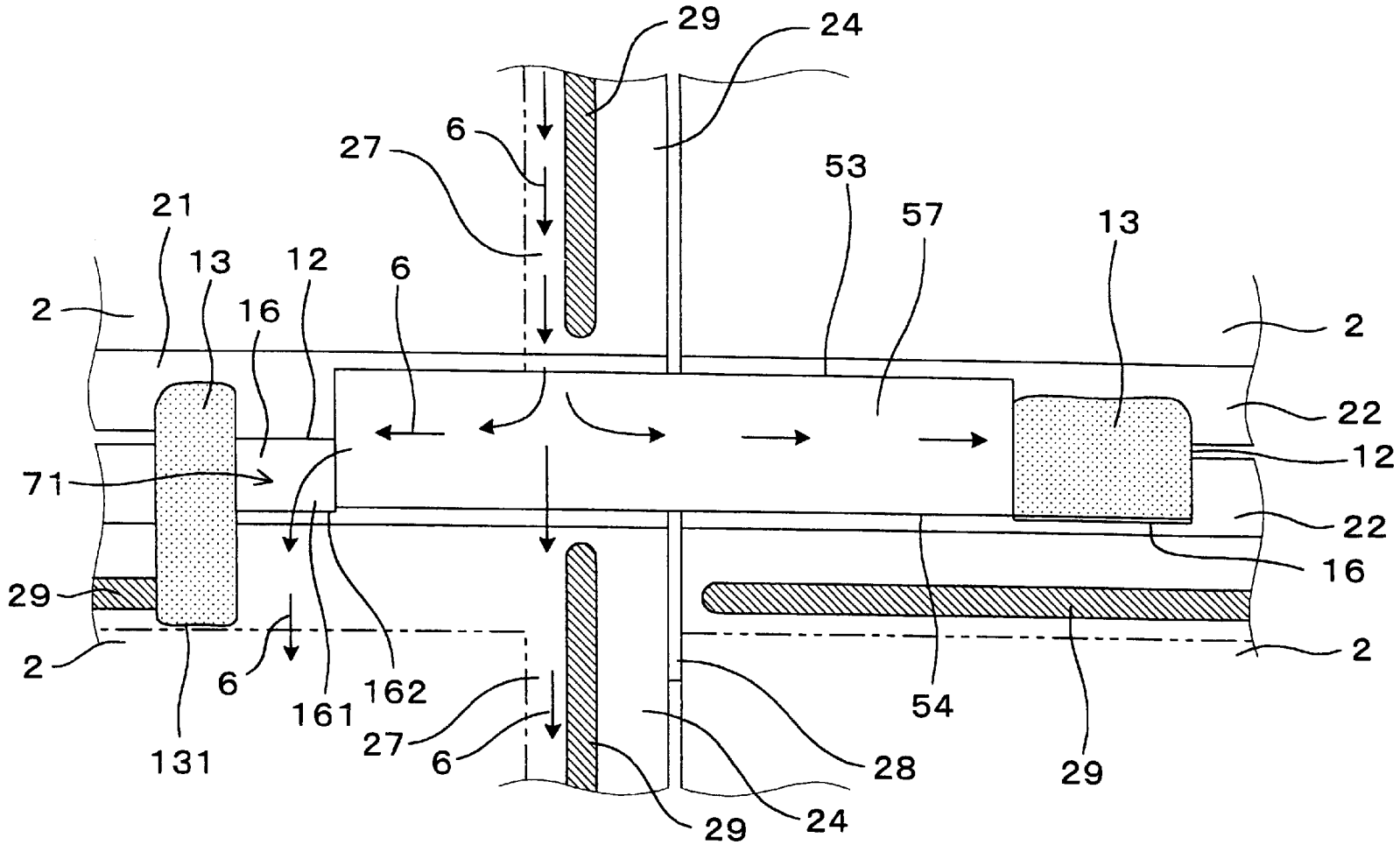
FIG. 22 is an illustrative front view illustrating a flow of rain water at the periphery of the sealing member and the fastening fitting according to the Embodiment 2.

This embodiment is an example of that an arrangement state of the lateral elastic material 13 in the sealing member 10 is changed, as shown in FIG. 20 to FIG. 22.

That is, as shown in FIG. 20, in the sealing member 10, a lateral elastic material 13 is provided over the right inclined portion 16, the right horizontally rising plate portion 12, and the right forward protrusion 15 with the full width including the inward ends 161, 121, and 151.

On the other hand, at the left inclined portion 16, the left horizontally rising plate portion 12, and the left forward protrusion 15, as in the Embodiment 1, the lateral elastic material 13 is not provided at the inner ends 161, 121, and 151. That is, at the left inclined portion 16, the left horizontally rising plate portion 12, and the left forward protrusion 15, the lateral elastic material 13 is provided only at a width of about 5 mm from the side end 19 of the sealing member 10.

As shown in FIG. 21 and FIG. 22, the caulking material 29 at the upper underlying tongue portion 22 of the siding board 2 is formed outward from the lateral elastic material 13 forming the water conduit 71. That is, at the upper underlying tongue portion 22 of the siding board 2 arranged at the lower left part of the sealing member 10, the caulking material 29 is attached on the left side across a left end of the lateral elastic material 13 at the left side of the sealing member 10, and the caulking material 13 is not attached on the right side across the left end. Therefore, the caulking material 29 is not attached on a portion at which the water conduit 71 is formed.

The other is similar to the Embodiment 1.

In this case, as shown in FIG. 21 and FIG. 22, the lateral elastic material 13 at the right side comes into close contact with the side end 59 of the front flat plate 57, the supporting portion 52 and the fixing plate portion 51 of the fastening fitting 5, and rain water 6 is dammed at the side end 59.

On the other hand, inside the lateral elastic material 13 at the left side, a water conduit 71 for discharging the rain water 6 flowing through the front flat plate 57 or the like of the fastening fitting 5 from the joint clearance portion 270 of the upper and lower siding boards 2 forward of the wall face is formed.

Therefore, the rain water 6 can be efficiently discharged from the left side of the fastening fitting 5 forward of the wall face.

The siding board 2 in the siding boards attachment structure 70 according to the present embodiment has a lateral underlying tongue portion 24 at the right side portion and a lateral overlying tongue portion 23 at the left side portion. Thus, the joint clearance portion 27 between the left and right siding boards 2 is arranged at a position which is close to a side end 59 at the left side of the fastening fitting 5, as shown in FIG. 21.

Thus, in general, the rain water 6 penetrating the joint clearance portion 27 between the left and right siding boards 2 easily flows to the side end 59 at the left side. Therefore, the lateral elastic material 13 is brought into close contact with the side end 59 at the right side of the fastening fitting 5 as described above, and the water conduit 71 is formed at the left side, whereby the rain water 6 can be discharged more efficiently.

In addition, the caulking material 29 at the upper underlying tongue portion 22 of the siding board 2 is formed outward from the lateral elastic material 13 forming the water conduit 71, and thus, the rain water 6 can be discharged more efficiently forward of the wall face from the water conduit 71.

The other advantageous effect is similar to that of the Embodiment 1.

Embodiment 3

The present embodiment is an example of a sealing member and a siding boards attachment structure using the sealing member, as shown in FIG. 23 to FIG. 37.

Figure 31:
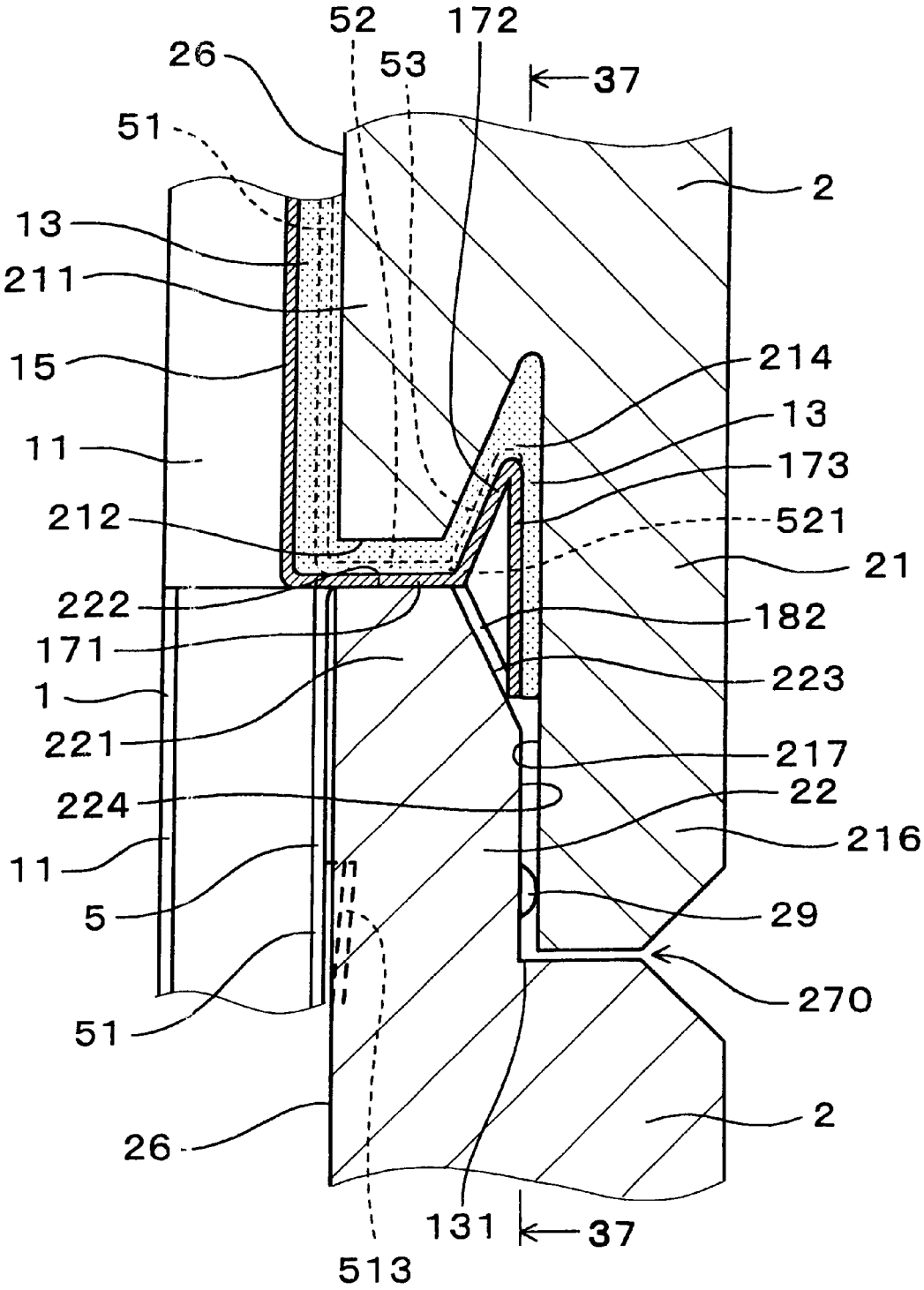
FIG. 31 is enlarged longitudinal cross section of a jointing portion of the upper-lower side shiplap structure according to the Embodiment 3.
Figure 32:
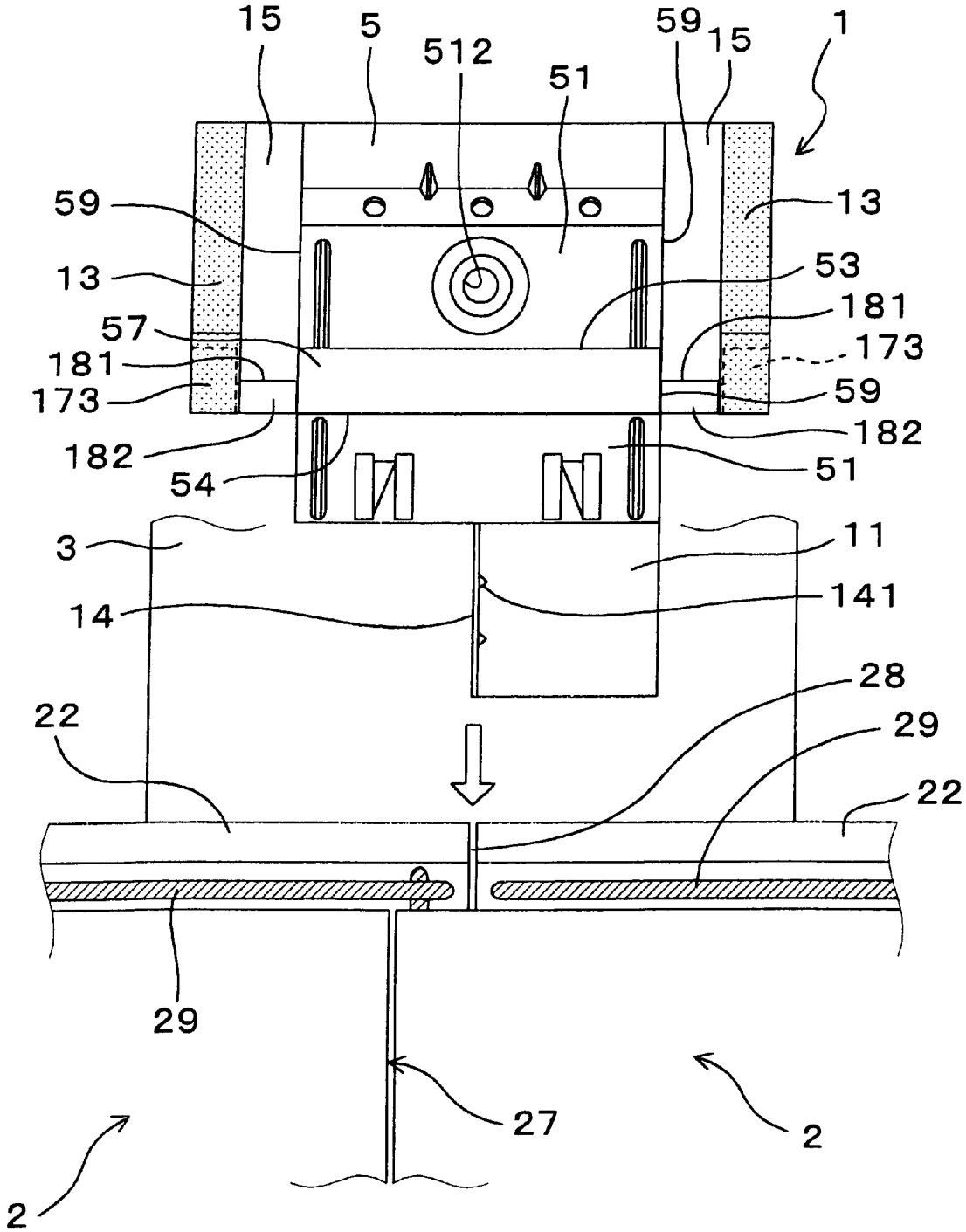
FIG. 32 is an illustrative view illustrating a third step of the method of attaching siding boards according to the Embodiment 3.
Figure 33:
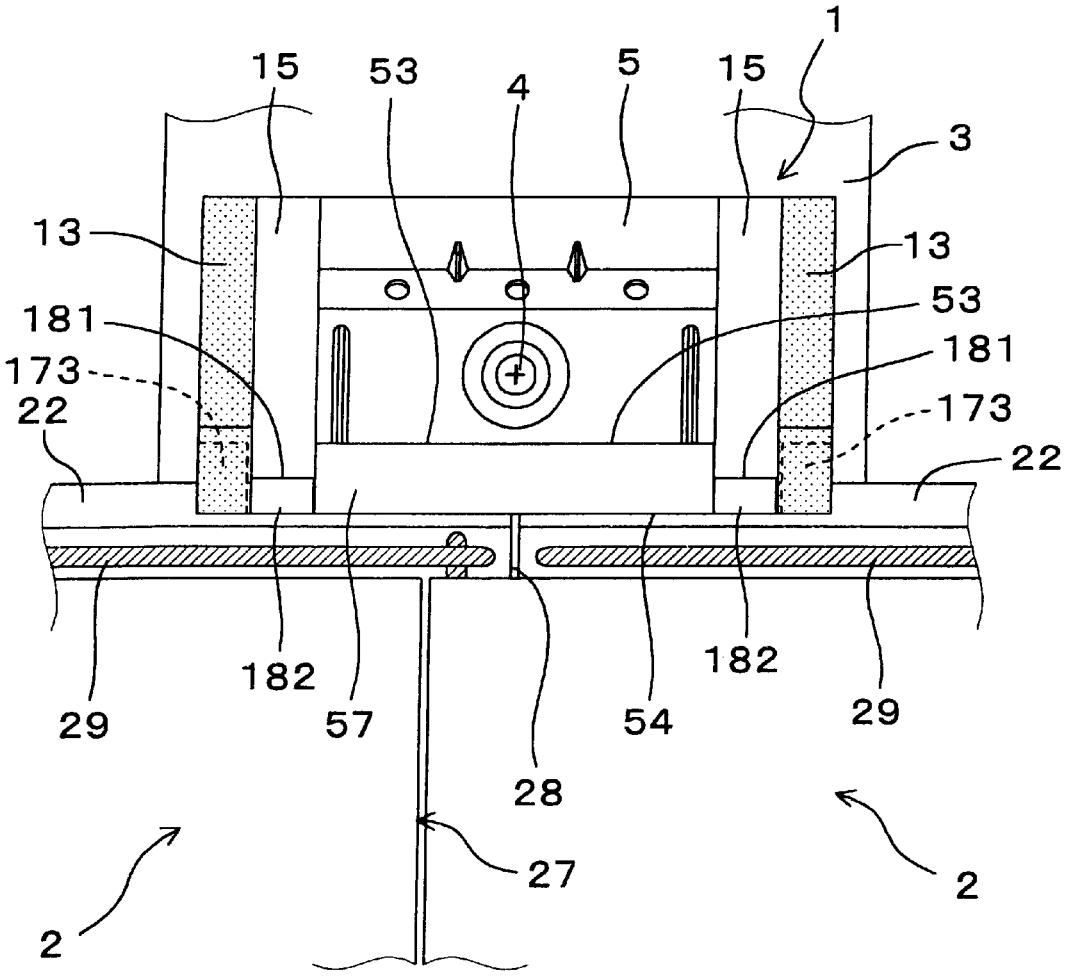
FIG. 33 is an illustrative view illustrating a state of that a fourth step of the method of attaching siding boards is terminated according to the Embodiment 3.
Figure 34:
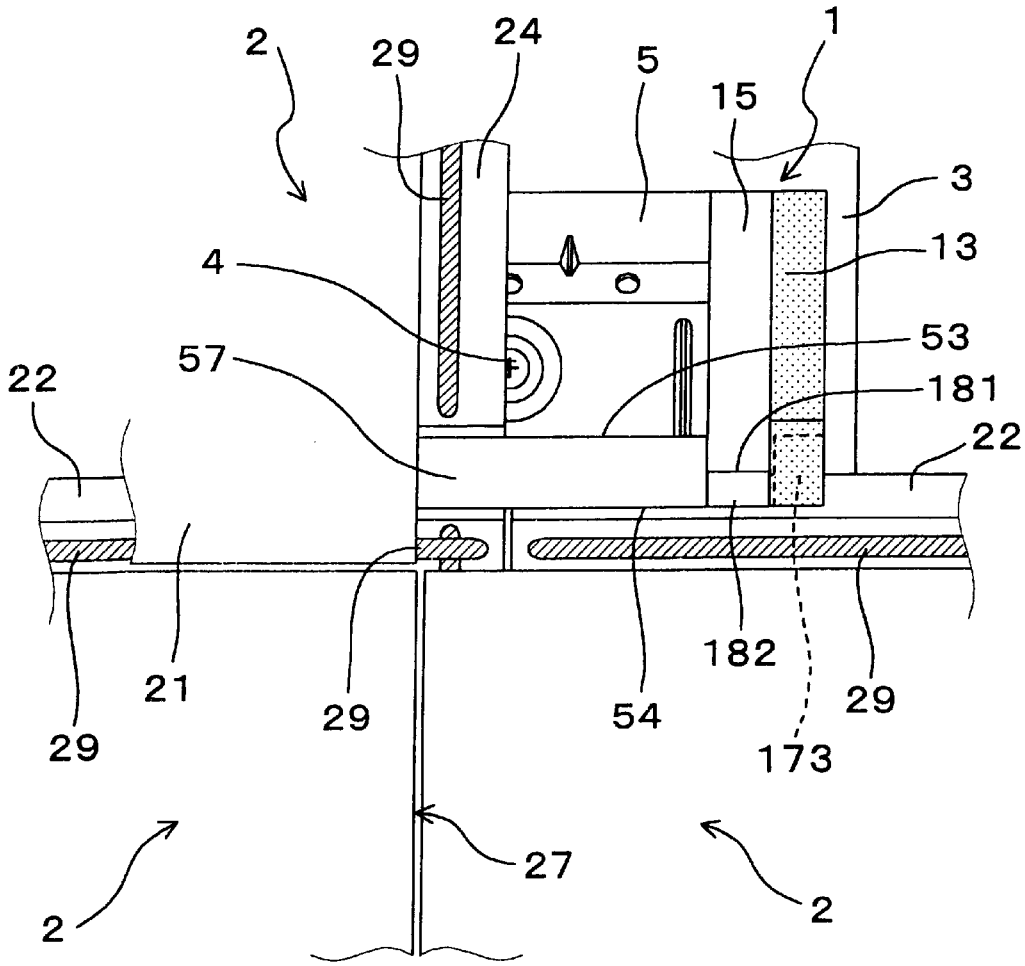
FIG. 34 is an illustrative view illustrating a state of that a fifth step of the method of attaching siding boards is terminated according to the Embodiment 3.
Figure 36:
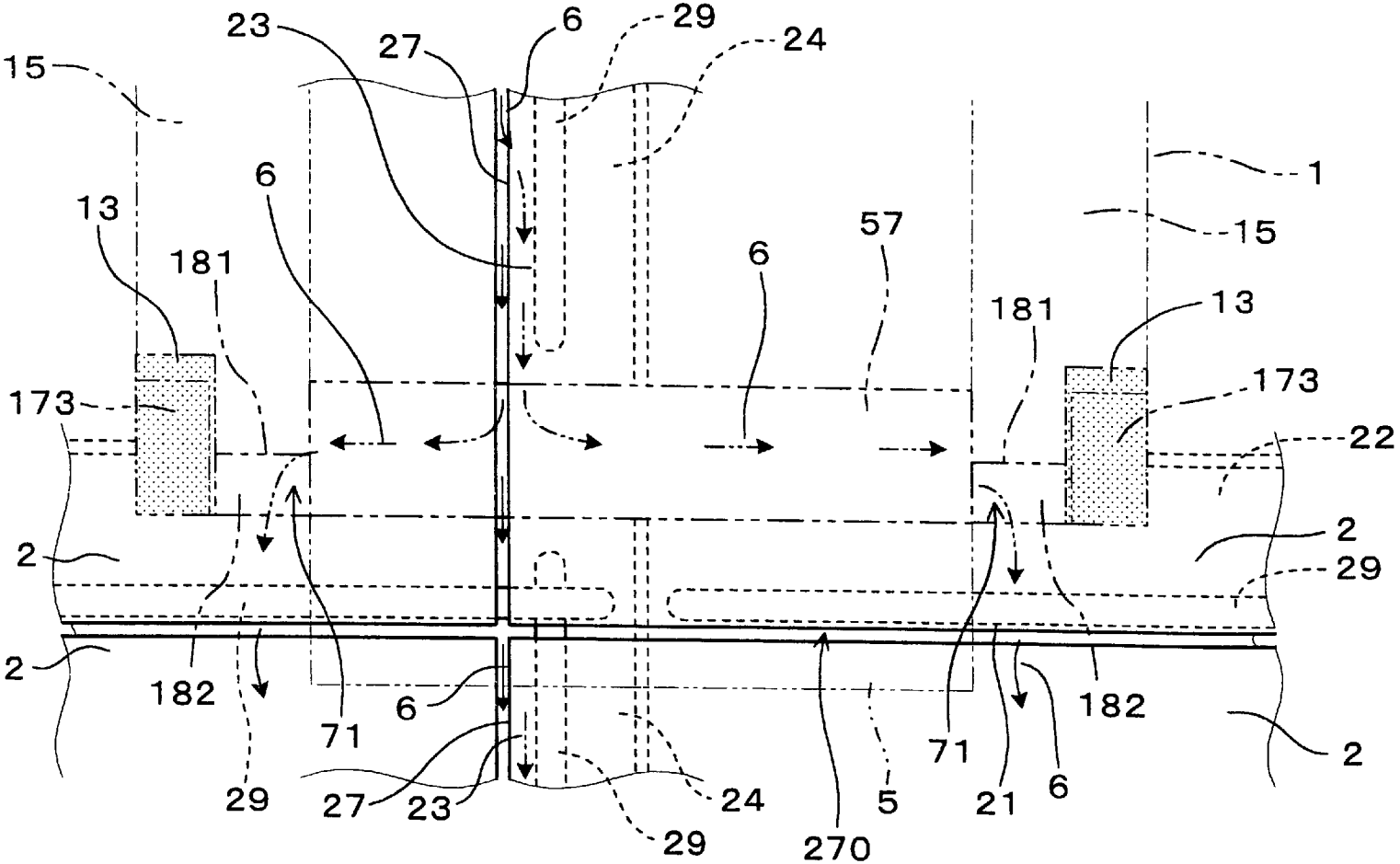
FIG. 36 is an illustrative front view illustrating a flow of rain water at the periphery of the sealing member and the fastening fitting according to the Embodiment 3.
Figure 37:
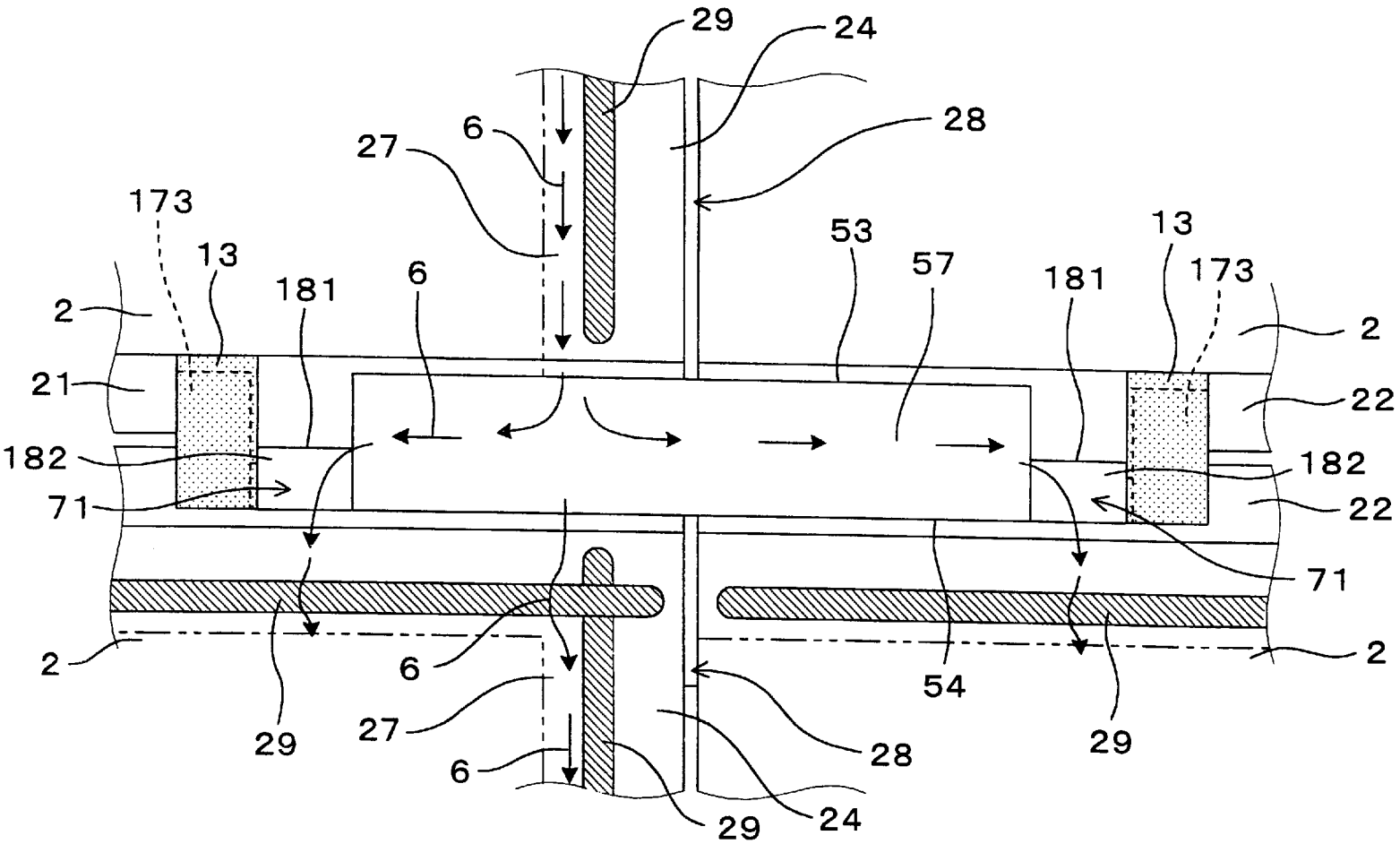
FIG. 37 is an illustrative view illustrating a flow of rain water taken along line 37—37 of FIG. 31.
Figure 38:
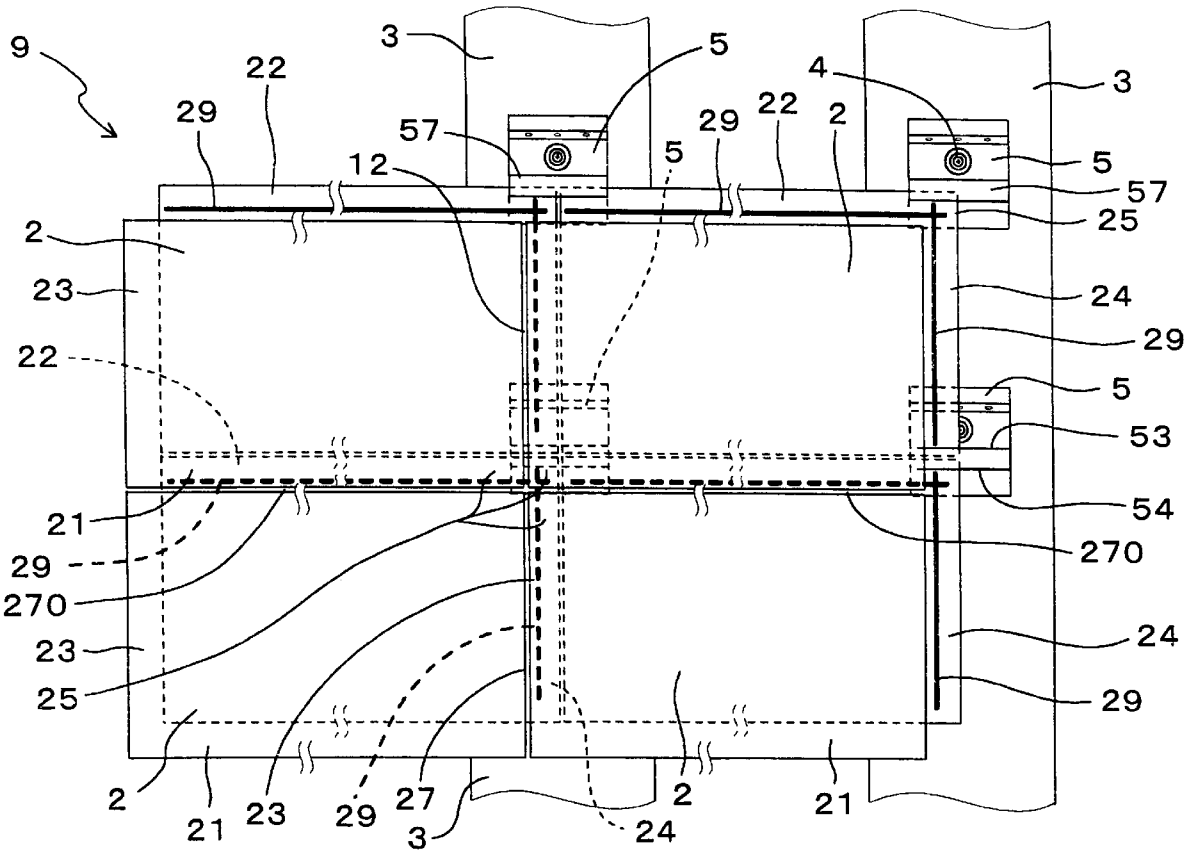
FIG. 38 is a front view of a conventional siding boards attachment structure.
Figure 39:
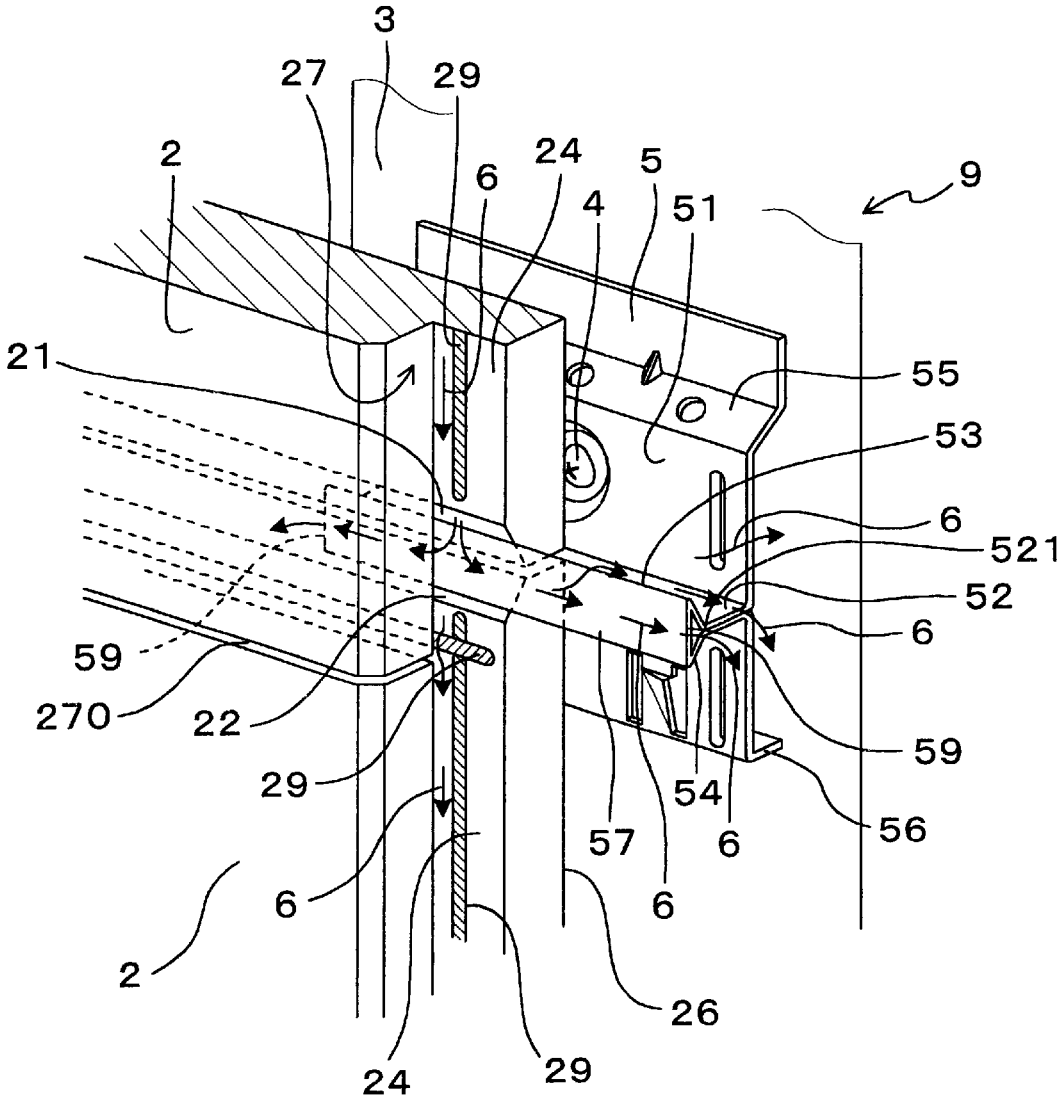
FIG.39 PRIOR ART
FIG. 39 is an illustrative perspective view illustrating a flow of rain water at the periphery of the sealing member and the fastening fitting in the conventional structure.
Figure 40:
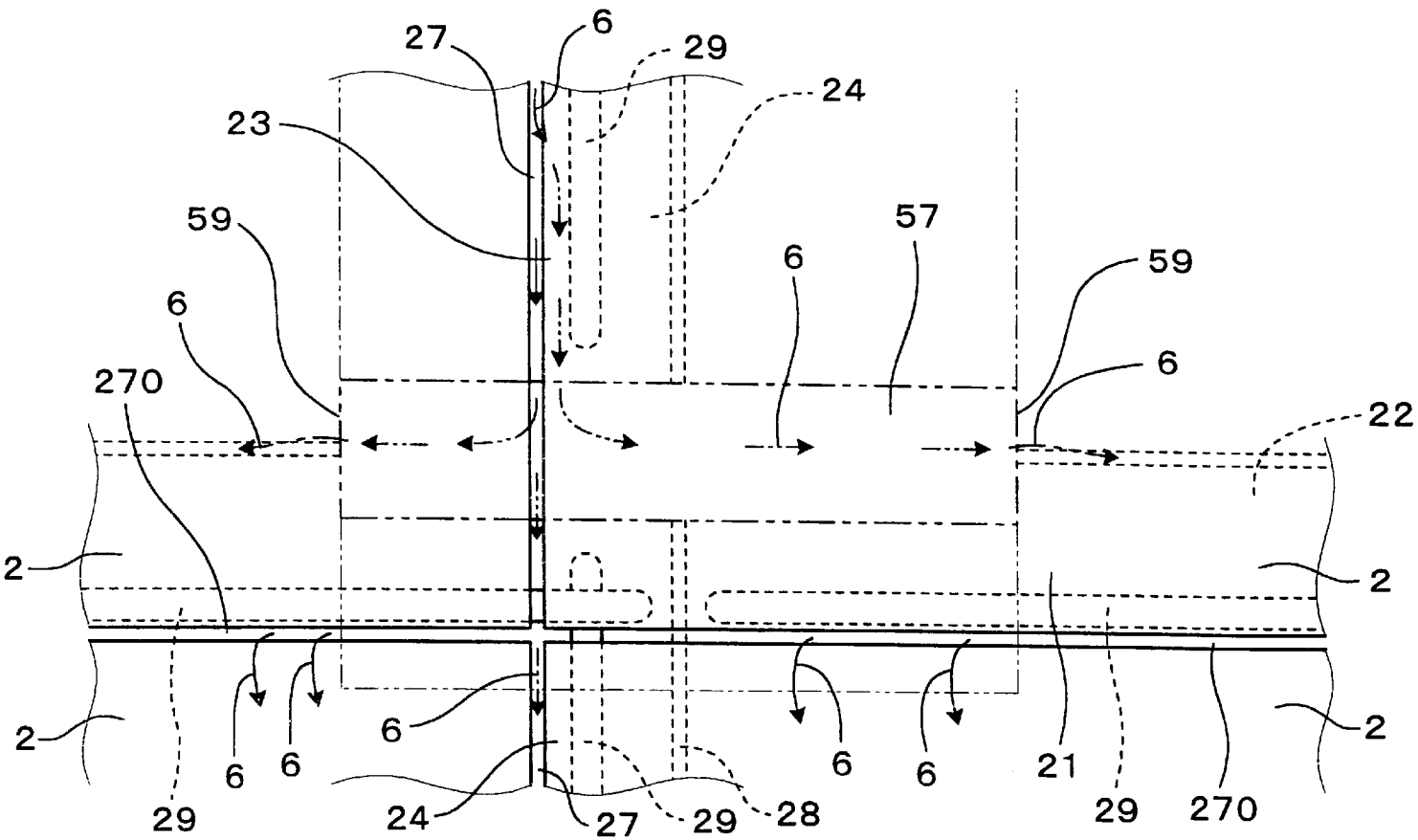
FIG. 40 is an illustrative front view illustrating a flow of rain water at the periphery of the sealing member and the fastening fitting in the conventional structure.

FIG. 23 to FIG. 26 are illustrative views primarily illustrating the sealing member 1 and the fastening fitting 5. FIG. 27 to FIG. 31 are illustrative view primarily illustrating a siding boards attachment structure. FIG. 32 to FIG. 34 are illustrative views primarily illustrating a siding boards attachment structure. FIG. 35 to FIG. 37 are illustrative views primarily illustrating an advantageous effect.

Figure 26A:
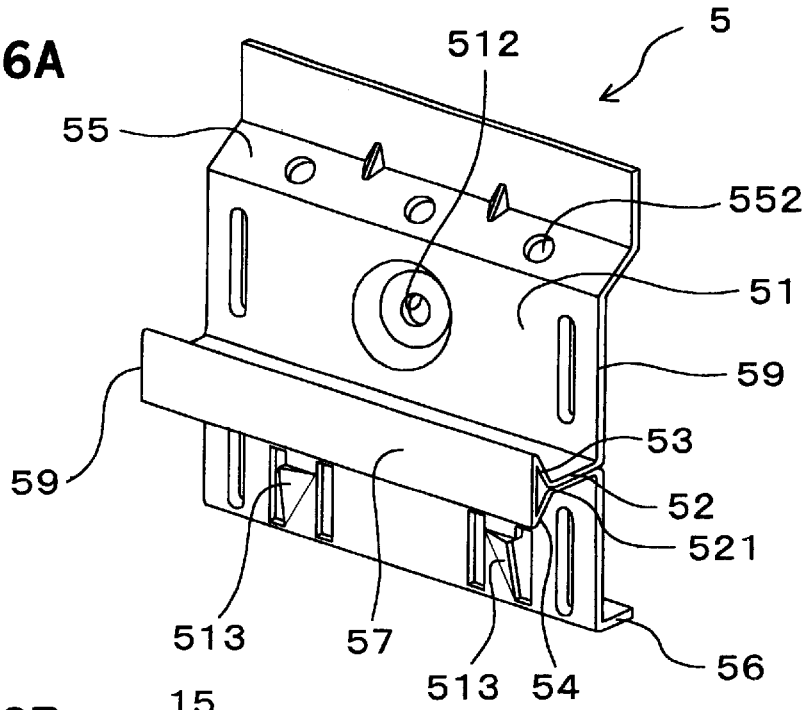
FIG. 26A is a perspective view of the fastening fitting according to the Embodiment 3.
Figure 26B:
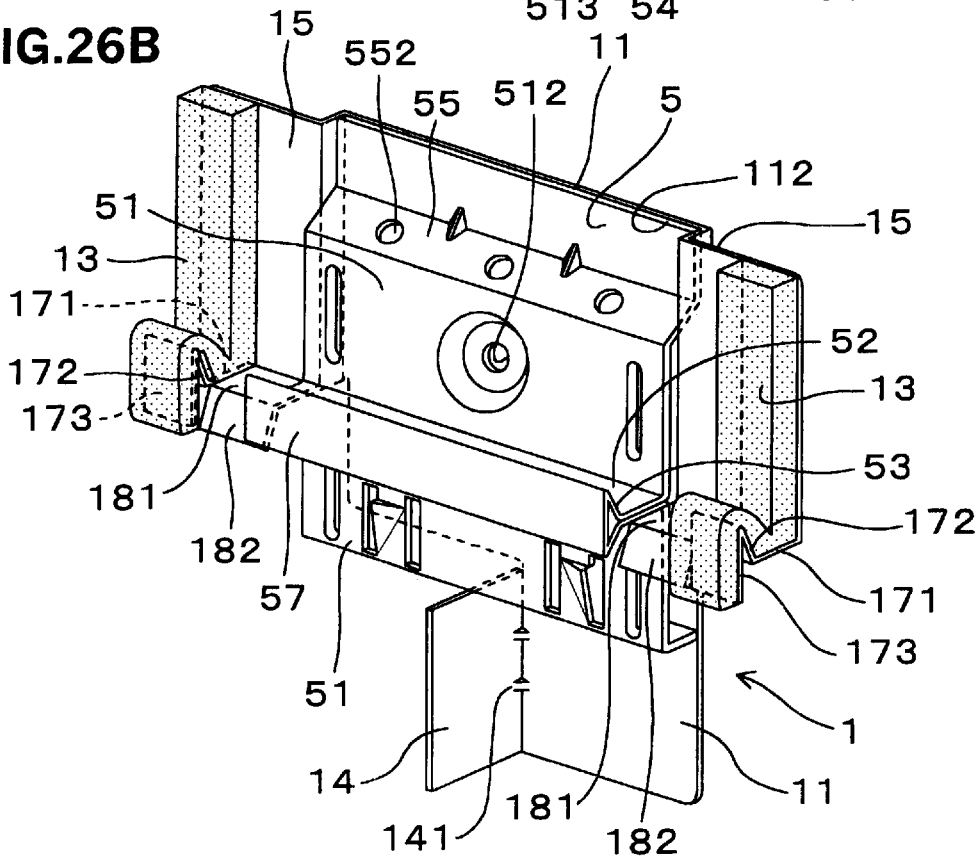
FIG. 26B is a perspective view of that the fastening fitting is superimposed on the sealing member according to the Embodiment 3.
Figure 27:
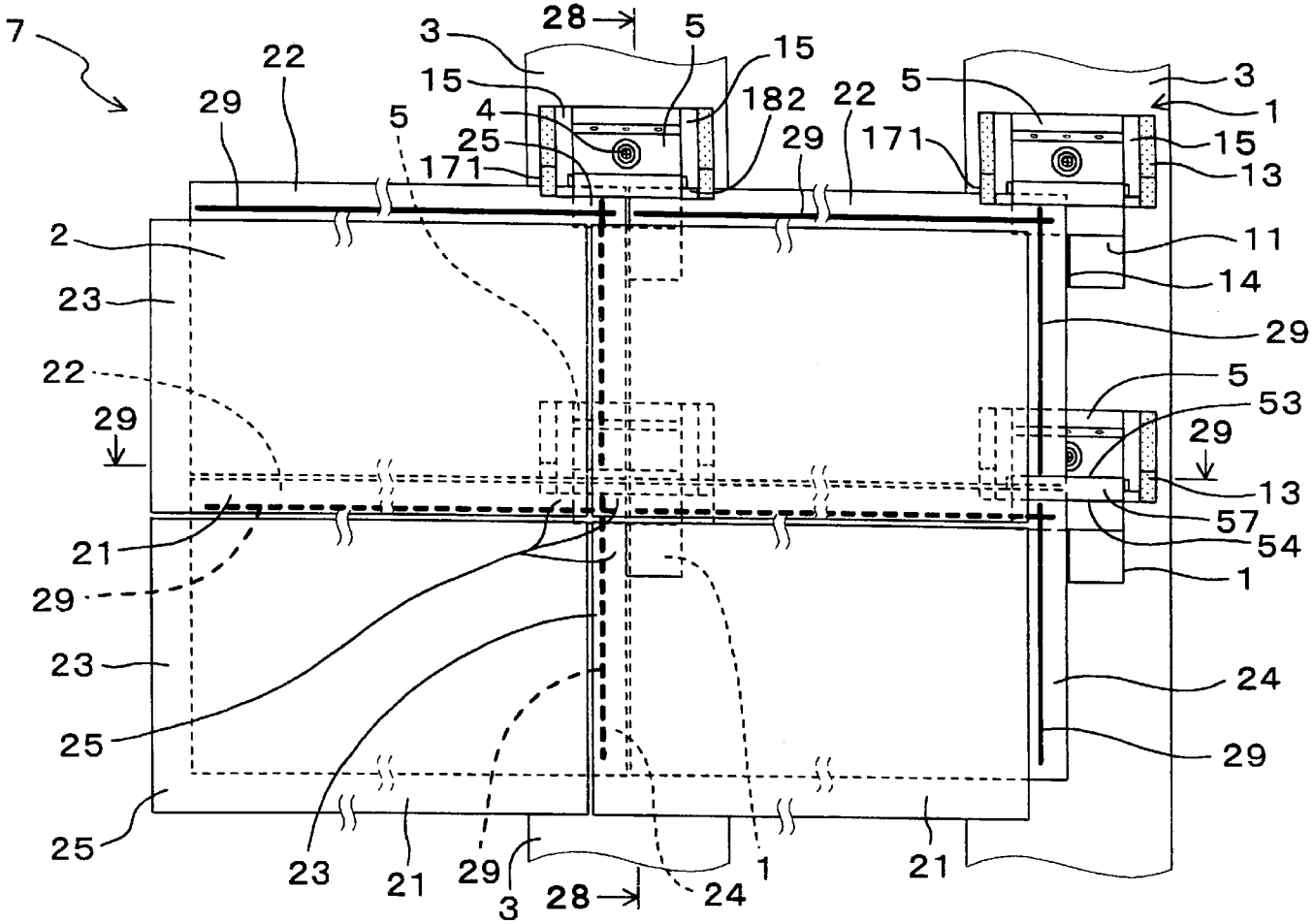
FIG. 27 is a front view of a siding boards attachment structure according to the Embodiment 3.

The sealing member 1 according to the present embodiment is used together with the fastening fitting 5 shown in FIG. 26A, and is arranged backward of the fastening fitting 5, as shown in FIG. 26B. The fastening fitting 5 is used for mounting on the underlayment 3 a siding board 2 with the four side shiplap structure having an upper underlying tongue portion 22, a lower overlying tongue portion 21, and a lateral underlying tongue portion 24 and a lateral overlying tongue portion 23 that are provided at the left and right sides as shown in FIG. 27. The fastening fitting is disposed at a portion at which corner portions 25 of four siding boards 2 are disposed to be opposed to each other, i.e., at the upper, lower, left, and right joint portion.

Figure 25:
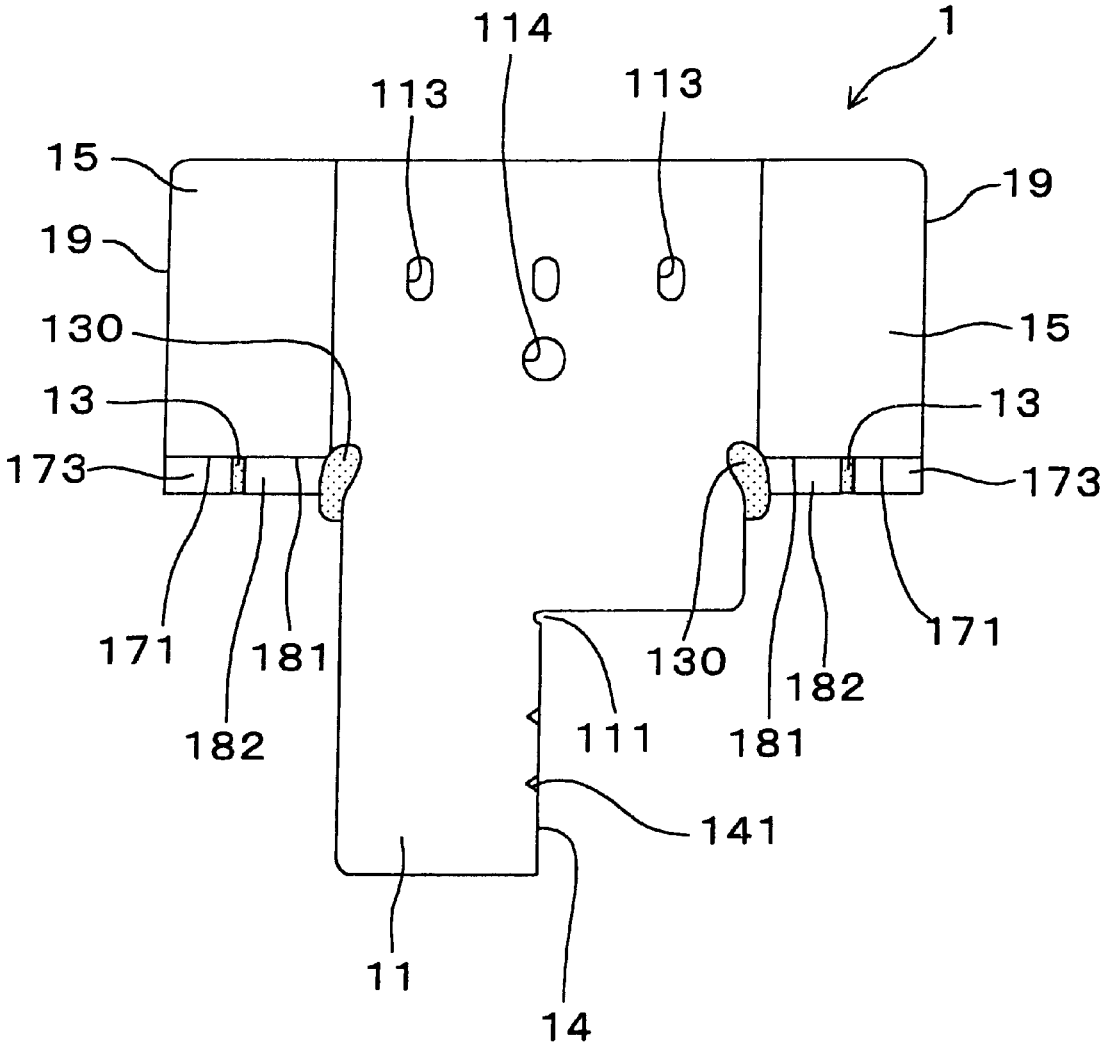
FIG. 25 is aback face view of the sealing member according to the Embodiment 3.

The sealing member 1 has a base plate portion 11 fixed to an underlayment 3 and a forward protrusion 15 protrudes forward at the left and right sides of the base plate portion, as shown in FIG. 23 to FIG. 25.

A storage recess 112 having a width substantially equal to the width of the fastening fitting 5 is formed between these left and right forward protrusions 15.

In addition, an inside horizontally rising plate portion 181 erected forward in a horizontal direction is formed at the side of the storage recess 112 of the forward protrusion 15, and an inside downwardly inclined portion 182 inclined diagonally downward is formed at the front end of the inside horizontally rising plate portion 181.

An outside horizontally rising plate portion 171 forwardly erected in a horizontal direction from the forward protrusion 15 is formed outside the inside horizontally rising plate portion 181. At the front end of the outside horizontally rising plate portion 171, an outside upwardly inclined portion 172 inclined diagonally upward; and a downward suspended plate portion 173 bent vertically downward from the tip end of the outside upwardly inclined portion 172 are formed.

A lateral elastic material 13 is arranged at the top faces of the outside horizontally rising plate portion 171 and the outside upwardly inclined portion 172, the front face of the forward protrusion 15 upward of them, and the front face of the downward suspended plate portion 173.

The lateral elastic material 13 is provided to be slightly wider than the width of the outside horizontally rising plate portion 171, the outside upwardly inclined portion 172, and the downward suspended plate portion 173, as shown in FIG. 24A. In this manner, as shown in FIG. 24B, the lateral elastic material 13 closes a clearance between the inside horizontally rising plate portion 181 and the outside horizontally rising plate portion 171.

The forward protrusion 15 rises at the left and right sides of the base plate portion 11 by about 90 degrees of about 3.5 mm in the forward direction, is further bent by about 90 degrees to the outside, and forms a plane which is substantially parallel to the base plate portion 11. The storage recess 112 between the forward protrusions is constructed to keep and place the fastening fitting 5, as shown in FIG. 26B. The storage recess is formed to be wider than the width of the fastening fitting 5 by about 0.5 mm. The depth of the storage recess 112 is formed to an extent such that the fixing plate portion 11 of the fastening fitting 5 protrudes by about 2 mm.

The inside horizontally rising plate portion 181 and the outside horizontally rising plate portion 171 are formed on the same plane.

A backward elastic material 130 continuously provided between the left and right inside horizontally rising plate portions 181 is provided at the storage recess 112.

As shown in FIG. 23 and FIG. 24, a vertically rising plate portion 14 erected forward in a vertical direction is provided at the bottom the base plate portion 11.

The sealing member 1 is fabricated by cutting and bending a metal plate such as stainless steel. In addition, the lateral elastic material 13 and the backward elastic material 130 are made of a foam body with closed cells that consists of EPDM or the like.

As shown in FIG. 24A, a base plate portion 11 of the sealing member 1 has through holes 113 and 114 at positions that correspond to a nail hole 552 and a screw hole 512 formed at the fastening fitting 5.

A notch 111 for facilitating bending is provided at bending portions of the sealing member 1, i.e., at the proximal end of the forward protrusion 15, the proximal end of the inside horizontally rising plate portion 181, and the proximal end of the vertically rising plate portion 14. As shown in FIG. 24C, a cavity 141 for reinforcing the vertically rising plate portion 14 is provided at the bent portion at which the vertically rising plate portion 14 of the sealing member 1 is bent, as shown in FIG. 24C.

The notches 111 at the proximal end of the forward protrusion 15 and the proximal end of the inside horizontally rising plate portion 181 is covered with the backward elastic material 130. That is, as shown in FIG. 25 (a view of which a sealing member is seen from the rear face side), the backward elastic material 130 is adhered such that both ends thereof is rounded to the rear side of the base plate portion 11.

In addition, the same fastening fitting 5 (FIG. 26A) as in the Embodiment 1 is used.

Now, a siding boards attachment structure 7 of a four side (left, right, upper and lower sides) shiplap structure in which a ceramic type siding board 2 is mounted on an underlayment 3 by using the sealing member 1 and the fastening fitting 5, will be described primarily with reference to FIG. 27 to FIG. 31.

Figure 29:
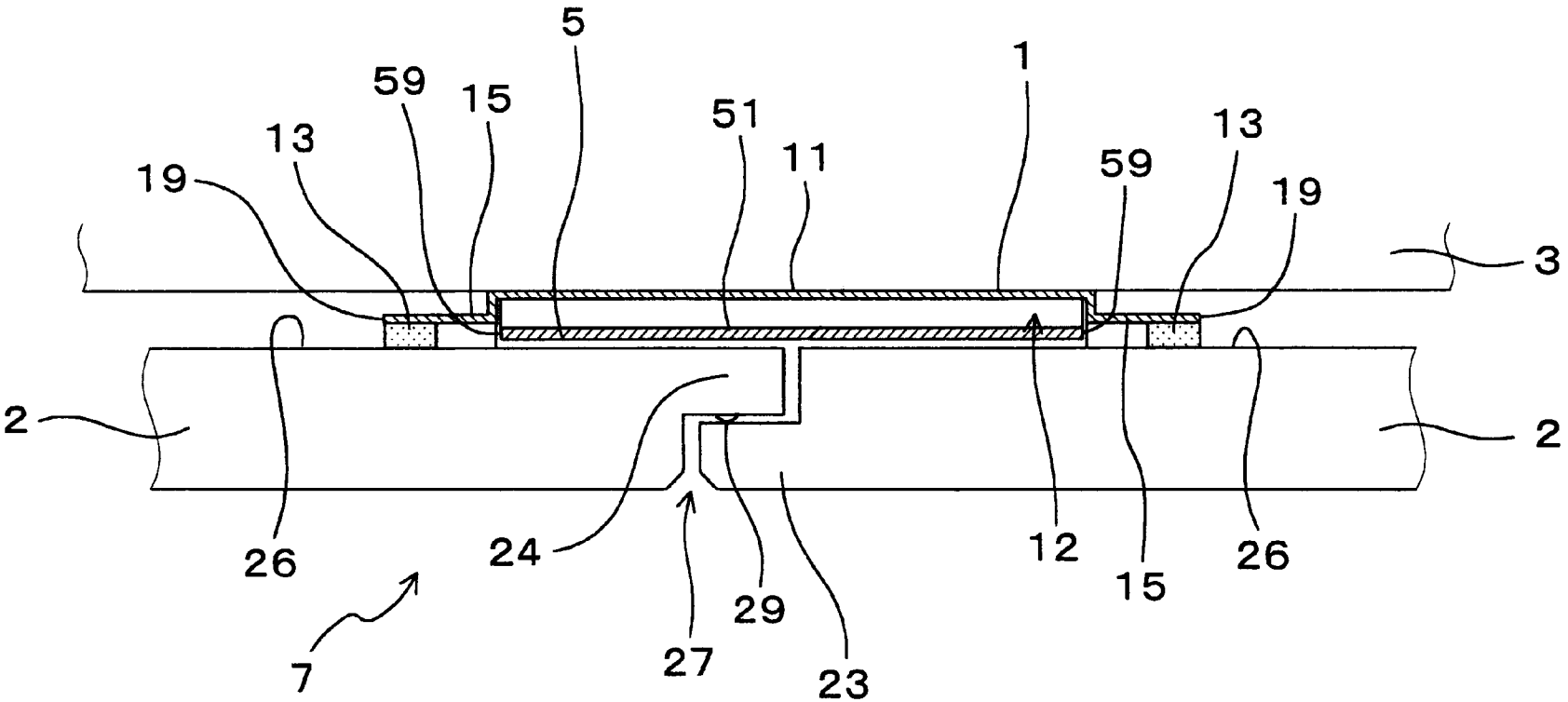
FIG. 29 is a lateral cross section illustrating a jointing portion of the left-right side shiplap structure taken along line 29—29 of FIG. 27.

FIG. 29 is a lateral cross sectional view showing a joint portion of the left and right siding boards 2. In FIG. 27, some of the sealing member 1, the fastening fitting 5 and the siding board 2 are omitted for the purpose of clarity.

The shape of the lower overlying tongue portion 21 and the upper underlying tongue portion 22 of the siding board 2, and an engagingly locking state of them caused by the fastening fittings 5 are similar to those of the Embodiment 1.

As shown in FIG. 28 and FIG. 30, in the siding boards attachment structure 7 according to the present embodiment, the sealing member 1 and the fastening fitting 5 arranged to be superimposed on the sealing member 1 in front of the sealing member 1 are fixed to the underlayment 3 together by means of a screw 4 of a fastening.

In the two adjacent siding boards 2 disposed downward of the fastening fitting 5, the upper underlying tongue portion 22 is engagingly locked with the lower board engaging portion 54 of the fastening fitting 5, as shown in FIG. 30. In addition, the upper underlying tongue portion 22 is engagingly locked with the inside downwardly inclined portion 182 of the sealing member 1.

In the two adjacent siding boards 2 disposed upward of the fastening fitting, the lower overlying tongue portion 21 is placed on the supporting portion 52 of the fastening fitting 5, and further, is engagingly locked with the upper board engaging portion 53, as shown in FIG. 30. In addition, the lower overlying tongue portion 21 is engagingly locked with the outside upwardly inclined portion 172 of the sealing member 1.

As shown in FIG. 30, in the siding boards attachment structure 7, the fastening fitting 5 is kept and placed at the storage recess 112 of the sealing member 1.

As shown in FIG. 28 to FIG. 31, a lateral elastic material 13 of the sealing member 1 comes into close contact with the rear side surface 26 and lower overlying tongue portion 21 of the upper siding board 2.

As shown in FIG. 30, a water conduit 71 communicating from the joint clearance portion 270 of the upper and lower siding boards 2 forward of the wall face is formed at the top face side of the inside horizontally rising plate portion 181 and the inside downwardly inclined portion 182 of the sealing member 1, i.e., at the inner side of the lateral elastic material 13.

As shown in FIG. 28, a backward elastic material 130 provided at the storage recess 112 of the sealing member 1 comes into close contact with a rear side surface of the fixing plate portion 51 of the fastening fitting 5. The backward elastic material 130 closes the notches 111 at the proximal end of the forward protrusion 15 and at the proximal end of the inside horizontally rising plate portion 181 of the sealing member 1, thereby preventing water penetration into the rear side of the sealing member 1 from the notches.

As shown in FIG. 35, a side face of the lateral underlying tongue portion 24 of the siding board 2 downward of the sealing member 1 abuts against the vertically rising plate portion 14 provided at the sealing member 1.

A method for constructing the siding boards attachment structure 7 will be described primarily with reference to FIG. 32 to FIG. 34. The following description corresponds to a description of some constructing steps caused by the method of attaching siding boards.

The method of attaching siding boards has the following first to sixth steps.

The first and second steps are similar to the first step (FIG. 12) and the second step (FIG. 13) of the method of attaching siding boards shown in the Embodiment 1.

At the third step, as shown in FIG. 32, the fastening fitting 5 is kept and placed at the storage recess 112 of the sealing member 1. At this time, a bent portion 56 at the lower end of the fastening fitting 5 abuts against the vertically rising plate portion 14 of the sealing member 1. Further, a screw hole 512 of the fastening fitting 5 and a through hole 114 of the sealing member 1 are superimposed on each other.

In this state, the base plate portion 11 of the sealing member land the fixing plate portion 51 of the fastening fitting 5 are inserted between the underlayment 3 and the siding board 2. In addition, a vertically rising plate portion 14 of the sealing member 1 is inserted into a rear side joint clearance 28 of about 1 mm at the back face side of the left and right siding boards 2.

At the fourth step, as shown in FIG. 33, the lower board engaging portion 54 of the fastening fitting 5 is engagingly locked with the upper underlying tongue portion 22 of the siding board 2, and the inside downwardly inclined portion 182 of the sealing member 1 is engagingly locked with the upper underlying tongue portion 22 of the siding board 2. At this time, as shown in FIG. 35, the vertically rising plate portion 14 of the sealing member 1 is pushed laterally against a side face of the lateral underlying tongue portion 24 at the first siding board 2.

A screw 4 is inserted into a screw hole 512 of the fastening fitting 5 and a through hole 114 of the sealing member 1, and the sealing member 1 and fastening fitting 5 are fixed to the underlayment 3 by means of the screw 4.

At the fifth step, as shown in FIG. 34, a third siding board 2 is disposed such that the lower overlying tongue portion 21 is superimposed on the upper underlying tongue portion 22 of the first siding board 2. At this time, the lower overlying tongue portion 21 is engagingly locked with the upper board engaging portion 53 of the fastening fitting 5 and an outside upwardly inclined portion 172 of the sealing member 1. In addition, the lower overlying tongue portion 21 and rear side surface 26 of the third siding board 2 are brought into close contact with the lateral elastic material 13 of the sealing member 1.

At the sixth step, a fourth siding board 2 is disposed such that the lower overlying tongue portion 21 is superimposed on the upper underlying tongue portion 22 of the second siding board 2, and the lateral overlying tongue portion 23 is superimposed on the lateral underlying tongue portion 24 of the third siding board 2. At this time, the lower overlying tongue portion 21 is engagingly locked with the upper board engaging portion 53 of the fastening fitting 5 and the outside upwardly inclined portion 172 of the sealing member 1.

By repeating the first to sixth steps, there is provided a siding boards attachment structure 7 in which the siding board 2 is fastened on the underlayment 3 by using the sealing member 1 and the fastening fitting 5 (FIG. 27).

Now, advantageous effect of the present embodiment will be described below.

As described above, in the sealing member 1, the forward protrusion 15 is provided at the base plate portion 11, and a storage recess 112 having a width substantially equal to the width of the fastening fitting 5 is formed between the left and right forward protrusions 15.

Therefore, in construcing the siding boards attachment structure 7, as shown in FIG. 26B, the fastening fitting 5 can be kept and placed at the storage recess 112. In this manner, during construction, the sealing member 1 and the fastening fitting 5 can be easily constructed.

The storage recess 112 has a width substantially equal to the width of the fastening fitting 5. Thus, when the fastening fitting 5 is disposed at the storage recess 112, a displacement between them can be prevented. Therefore, the sealing member 1 and the fastening fitting 5 can be easily and stably fixed to the underlayment 3.

As described above, in the sealing member 1, a lateral elastic material 13 is arranged at the top faces of the outside horizontally rising plate portion 171 and the outside upwardly inclined portion 172, at the front face of the forward protrusion 15 upward from them, and at the front face of the downward suspended plate portion 173 (FIG. 23 and FIG. 24). A lateral elastic material 13 arranged at the horizontal erected outward portion 171 and the outside upwardly inclined portion 172 comes into close contact with a lower engagement portion 211 of the lower overlying tongue portion 21 of the upper siding board 2. A lateral elastic material 13 arranged at the forward protrusion 15 comes into close contact with the rear side surface 26 of the siding board 2. In addition, the lateral elastic material 13 arranged at the downward suspended plate portion 173 comes into close contact with the rear side surface of the lower overlying tongue portion 21 of the upper siding board 2. In particular, the lateral elastic material 13 comes into close contact with the lower engagement portion 211 of the lower overlying tongue portion 21 of the siding board 2 so as to cover the lower engagement portion 211 (FIG. 31).

The lateral elastic material 13 is not arranged at the inside horizontally rising plate portion 181 and the inside downwardly inclined portion 182.

Therefore, in the case where a siding boards attachment structure 7 is constructed by using the sealing member 1, as shown in FIG. 35 to FIG. 37, a water conduit 71 is formed on the top faces of the inside horizontally rising plate portion 181 and the inside downwardly inclined portion 182 inside of the lateral elastic materials 13.

Thus, even if rain water 6 penetrates a longitudinal joint clearance portion 27 of the upper left and right two siding boards 2, i.e., a clearance between the lateral underlying tongue portion 24 and the lateral overlying tongue portion 23, the rain water 6 moving in the left and right direction is dammed by the lateral elastic material 13. The rain water 6 is positively discharged forward of the wall face through the water conduit 71. Therefore, the rain water 6 does not penetrate up to the inside of the siding boards attachment structure 7. This water penetration preventing function will be described below primarily with reference to FIG. 35 to FIG. 37.

That is, as shown in FIG. 35 to FIG. 37, the rain water 6 penetrating the joint clearance portion 27 is inhibited from lateral movement by means of the caulking material 29, and drops downwardly through the joint clearance portion 27. The rain water 6 passes through the front face of the front flat plate 57 of the fastening fitting 5, and further, moves to the downward joint clearance portion 27 and drops.

In addition, the rain water 6 moves in the lateral direction through the front flat plate 57. Further, a part of the rain water 6 travels over the upper board engaging portion 53, moves onto the supporting portion 52, and further, moves to both side ends 59 of the supporting portion 52.

A water conduit 71 is disposed outside the side end 59 of the fastening fitting 5, as described above (FIG. 35 to FIG. 37).

Thus, as shown in FIG. 35 to FIG. 37, even if the rain water 6 penetrates the joint clearance portion 27, the rain water 6 is discharged forward of the wall face through the water conduit 71. That is, the rain water 6 moving in a lateral direction through the front flat plate 57 reaches the top face of the inside horizontally rising plate portion 181 and the inside downwardly inclined portion 182 of the sealing member 1. However, the lateral elastic material 13 is arranged outward of the inside horizontally rising plate portion 181 and the inside downwardly inclined portion 182, and thus, lateral movement of the rain water 6 is inhibited. The rain water 6 travels on the inside horizontally rising plate portion 181 and the inside downwardly inclined portion 182, i.e., through the water conduit 71, and is discharged from the joint clearance portion 270 between the upper and lower siding boards 2 forwardly of the wall face.

In addition, as shown in FIG. 35, even if the rain water 6 penetrates on the supporting portion 52 of the fastening fitting 5 or between the siding board 2 and the fixing plate portion 51 of the fastening fitting 5, the rain water is dammed by the lateral elastic material 13 in close contact with the lower overlying tongue portion 21 of the siding board 2 (rear side surface 217 of the surface lower end 216 (FIG. 31)) and the rear side surface 26.

As shown in FIG. 23 and FIG. 24, in the storage recess 112, a backward elastic material 130 is continuously provided between the left and right inside horizontally rising plate portions 181. As shown in FIG. 28, the backward elastic material 130 comes into close contact with the rear side of the fixing plate portion 51 of the fastening fitting 5 and the side end 59 thereof.

Thus, the rain water 6 can be reliably prevented from downward leaking from a space between the supporting portion 52 of the fastening fitting 5 and the inside horizontally rising plate portion 181 of the sealing member 1. In addition, the notch 111 at the proximal ends of the forward protrusion 15 and the inside horizontally rising plate portion 181 of the sealing member 1 is closed by the lateral elastic material 130, whereby water leakage from the notch 111 can be reliably prevented.

In this way, the rain water 6 can be reliably prevented from penetrating the inside of the siding boards attachment structure 7 by using the sealing member 1, and corrosion or degradation of the siding board 2 or the underlayment 3 and the like can be reliably prevented.

In addition, the lateral elastic material 13 is arranged at the forward protrusion 15 that protrudes forward from the base plate portion 11. Thus, the lateral elastic material 13 can be brought into close contact with the rear side surface 26 of the siding board 2 without particularly increasing the thickness of the lateral elastic material 13 (FIG. 28 and FIG. 29). Therefore, an inexpensive sealing member 1 can be obtained by reducing the thickness of the lateral elastic material 13.

The base plate portion 11 of the sealing member 1 has through holes 113 and 114 at positions that correspond to a nail hole 552 and a screw hole 512 formed at the fastening fitting 5, and thus, the sealing member 1 can be easily and precisely fixed to the underlayment 3.

As shown in FIG. 35, the vertically rising plate portion 14 is provided at the bottom of the base plate portion 11 of the sealing member 1, and the side face of the lateral underlying tongue portion 24 of the lower siding board 2 abuts against the vertically rising plate portion 14. In this manner, the lateral displacement of the siding board 2 after construction can be reliably prevented.

In addition, the elastic material 13 is made of a foam body with closed cells that consists of EPDM or the like, whereby penetration of the rain water 6 can be prevented more reliably.

Further, by using the method of attaching siding boards as described above, the lateral elastic material 13 can easily and reliably be in close contact with the rear side surface 26 and lower overlying tongue portion 21 of the upper siding board 2.

As has been described above, according to the present embodiment, in siding boards attachment structure of a four-way siding boards attachment structure, there can be provided a sealing member capable of reliably preventing rain water penetration and achieving easy and stable construction.

Obviously, numerous modifications and variations of the present invention are possible in light of the above teachings. It is therefore to be understood that, within the scope of the appended claims, the invention may be practiced otherwise than as specifically described here.

What is claimed as new and desired to be secured by Letters Patent of the United States is:

1. A sealing member arranged at a rear of a fastening fitting disposed at an upper, lower, left, and right joint portion of four siding boards of a left, right, upper, and lower four-sided shiplap structure, the sealing member comprising:

a base plate portion fixed to an underlayment;

left and right horizontally rising plate portions provided at left and right sides, respectively, of the base plate portion and erected forwardly of the base plate portion in a horizontal direction; and left and right inclined portions bent diagonally downwardly from a front end of each of the left and right horizontally rising plate portions, respectively, wherein the base plate portion has left and right forward protrusions that protrude forwardly of the base plate portion at an upward portion of each of the left and right horizontally rising plate portions, respectively, wherein a storage recess has a width substantially equal to a width of the fastening fitting and is formed between the left and right forward protrusions, and wherein left and right lateral elastic materials cover a portion of a top surface of each of the left and right horizontally rising plate portions, respectively, a portion of each of a top surface of the left and right inclined portions, respectively, and a portion of a front surface of each of the left and right forward protrusions. respectively.

2. A sealing member according to claim 1, wherein the left and right lateral elastic materials cover each of the left and right forward protrusions, respectively, each of the left and right horizontally rising plate portions, respectively, and each of the left and right inclined portions, respectively, excluding inner ends of them.

3. A sealing member according to claim 1, wherein the left and right lateral elastic materials are constructed to be extended over tip ends of the left and right inclined portions, respectively, and tip ends of each of the left and right lateral elastic materials are disposed under caulking materials formed at each upper underlying tongue portion of two adjacent siding boards disposed downwardly of the sealing member when the sealing member is disposed at the upper underlying tongue portion of the siding boards.

4. A sealing member according to claim I, further comprising a backward elastic material continuously provided between the left and right horizontally rising plate portions at the storage recess.

5. A sealing member according to claim 1, wherein a first one of either the left lateral elastic material or the right lateral elastic material covers the left inclined portion or the right inclined portion, respectively, the left horizontally rising plate portion or the right horizontally rising plate portion, respectively, and the left forward protrusion or the right forward protrusion, respectively, including an inner end of each of them, and a second one of either the left lateral elastic material or the right lateral elastic material covers the left inclined portion or the right inclined portion, respectively, the left horizontally rising plate portion or the right horizontally rising plate portion, respectively, and the left forward protrusion or the right forward protrusion, respectively, excluding an inner end of each of them.

6. A sealing member according to claim 1, further comprising a vertically rising plate portion erected forwardly in a vertical direction at a bottom of the base plate portion.

7. A sealing member according to claim 4, wherein the left and right lateral elastic materials and the backward elastic material are made of a foam body.

8. A sealing member according to claim 1, wherein the base plate portion comprises a plurality of through holes at positions corresponding to a nail hole and a screw hole formed in the fastening fitting.

9. A siding boards attachment structure of a left, right, upper, and lower four-sided shiplap structure capable of disposing the four siding boards on the underlayment by using the sealing member according to claim 1 and the fastening fitting, the siding boards attachment structure comprising:

the fastening fitting including a fixing plate portion which abuts against rear surfaces of the four siding boards arranged vertically, a supporting portion erected forwardly over a full width of the fixing plate portion, an upper board engaging portion bent diagonally downwardly from a front end of the supporting portion, and a front flat plate continuously provided between a tip end of the upper board engaging portion and a tip end of a lower board engaging portion, wherein the sealing member and the fastening fitting, which is disposed at the storage recess of the sealing member, are fixed to the underlayment together via a fastening, wherein a first two adjacent siding boards, of the four siding boards, are disposed downwardly of the fastening fitting, an upper underlying tongue portion is engagingly locked with the lower board engaging portion of the fastening fitting and the left and right inclined portions of the sealing member, wherein a second two adjacent siding boards, of the four siding boards, are disposed upwardly of the fastening fitting, a lower overlying tongue portion is placed on the supporting portion of the fastening fitting and is engagingly locked with the upper board engaging portion, wherein, at each of the siding boards, caulking materials are attached either on front faces of the upper underlying tongue portion and a lateral underlying tongue portion at a first one of left and right sides of the siding board or on rear faces of the lower overlying tongue portion and a lateral overlying tongue portion at a second one of left and right sides of the siding board, and wherein the left and right lateral elastic materials of the sealing member are in close contact with the rear surfaces and the lower overlying tongue portions of the second two adjacent siding boards.

10. A siding boards attachment structure according to claim 9, further comprising a backward elastic material continuously provided between the left and right horizontally rising plate portions in at the storage recess of the sealing member, wherein the backward elastic material comes into contact with a rear surface of the fixing plate portion of the fastening fitting.

11. A siding boards attachment structure according to claim 9, further comprising a vertically rising plate portion erected forwardly in a vertical direction at a bottom of the base plate portion of the sealing member, wherein the lateral underlying tongue portion of a lower siding board of the four siding boards abuts against the vertically rising plate portion.

12. A method for constructing the siding boards attachment structure according to claim 9, the method comprising the steps of:

a first step of disposing a first siding board of the four siding boards at an underlayment;

a second step of jointing the lateral overlying tongue portion of a second siding board of the four siding boards with the lateral underlying tongue portion of the first siding board of the four siding boards via a left-right side shiplap joint, and disposing the second siding board of the four siding boards at the underlayment;

a third step of inserting the base plate portion of the sealing member and the fixing plate portion of the fastening fitting between the underlayment and one of the four siding boards in a state where the fastening fitting is disposed at the storage recess of the sealing member;

a fourth step of engagingly locking the lower board engaging portion of the fastening fitting to the upper underlying tongue portions of the first and second siding boards, and abutting the left and right horizontally rising plate portions and the left and right inclined portions of the sealing member against the upper underlying tongue portions of the first and second siding boards, thereby fixing the sealing member and the fastening fitting to the underlayment by means of the fastening;

a fifth step of disposing a third siding board of the four siding boards at the first siding board so that the lower overlying tongue portion thereof is superimposed on the upper underlying tongue portion of the first siding board, and is engagingly locked with the upper board engaging portion of the fastening fitting; and a sixth step of disposing a fourth siding board of the four siding boards so that the lower overlying tongue portion thereof is superimposed on the upper underlying tongue portion of the second siding board, the lateral overlying tongue portion is superimposed on the lateral underlying tongue portion of the third siding board, and the lower overlying tongue portion is engagingly locked with the upper board engaging portion of the fastening fitting;

wherein in the fifth and sixth steps, the lower overlying tongue portion and the rear surfaces of the third and fourth siding boards come into close contact with the left and right lateral elastic materials of the sealing member, respectively.

13. A method for constructing the siding boards attachment structure according to claim 16, further comprising providing a vertically rising plate portion erected forwardly in a vertical direction at a bottom of the base plate portion of the sealing member, wherein at the third step, inserting the vertically rising plate portion into a rear joint clearance at rear surfaces of the first and second siding boards, and at the fourth step, both pressing the vertically rising plate portion against the lateral underlying tongue portion of the first siding board and fixing the sealing member to the underlayment.

14. A siding boards attachment structure according to claim 9, wherein the left and right lateral elastic materials of the sealing member cover the left and right forward protrusions, respectively, the left and right horizontally rising plate portions, respectively, and the left and right inclined portions, respectively, excluding inner ends of them, and further comprising a water conduit communicating from a joint clearance portion of upper and lower siding boards of the four siding boards forwardly of a wall face, the water conduit being formed inwardly from the left and right lateral elastic materials.

15. A siding boards attachment structure according to claim 14, wherein the left and right lateral elastic materials of the sealing member each extend over a tip end of the left and right inclined portions, respectively, and tip ends of the left and right lateral elastic materials are disposed under the caulking materials formed at the upper underlying tongue portions of one of the four siding boards.

16. A siding boards attachment structure according to claim 9, wherein in the sealing member, a first one of either the left lateral elastic material or the right lateral elastic material covers the left inclined portion or the right inclined portion, respectively, the left horizontally rising plate portion or the right horizontally rising plate portion, respectively, and the left forward protrusion or the right forward protrusion, respectively, including an inner end of each of them, and a second one of either the left lateral elastic material or the right lateral elastic material covers the left inclined portion or the right inclined portion, respectively, the left horizontally rising plate portion or the right horizontally rising plate portion, respectively, and the left forward protrusion or the right forward protrusion, respectively, excluding an inner end of each of them, and further comprising a water conduit formed inwardly from the left and right lateral elastic materials.

17. A siding boards attachment structure according to claim 16, wherein the caulking material adjacent to the upper underlying tongue portion of one of the four siding boards is formed outwardly from the left and right lateral elastic materials that defines the water conduit.

18. A sealing member arranged at a rear of a fastening fitting disposed at an upper, lower, lefts and right joint portion of four siding boards of a left, right, upper, and lower four-sided shiplap structure, comprising:

a base plate portion fixed to an underlayment; and left and right forward protrusions that protrude forwardly at left and right sides, respectively, of the base plate portion;

a storage recess, having a width substantially equal to a width of the fastening fitting, is formed between the left and right forward protrusions;

left and right inside horizontally rising plate portions erected forwardly in a horizontal direction are formed at left and right sides, respectively, of the left and right forward protrusions, respectively, which are adjacent to the storage recess, and left and right inside downwardly inclined portions are inclined diagonally downwardly at left and right front ends, respectively, of the left and right inside horizontally rising plate portion, respectively;

left and right outside horizontally rising plate portions are erected forwardly in the horizontal direction from the left and right forward protrusions, respectively, and are formed at outsides of the left and right inside horizontally rising plate portions, respectively;

left and right outside upwardly inclined portions are inclined diagonally upwardly at left and right front ends, respectively, of the left and right outside horizontally rising plate portions, respectively;

left and right downward suspended plate portions are bent downwardly in a vertical direction from left and right tip ends, respectively, of the left and right outside upwardly inclined portions, respectively; and left and right lateral elastic materials are arranged at left and right top faces, respectively, of the left and right outside horizontally rising plate portions, respectively, and the left and right outside upwardly inclined portions, respectively, at left and right front faces, respectively, of the left and right forward protrusions, respectively, upwardly of the left and right outside horizontally rising plate portions, respectively, and the left and right outside upwardly inclined portions, respectively, and at left and right front faces of the left and right downward suspended plate portions, respectively.

19. A sealing member according to claim 18, further comprising a backward elastic material continuously provided between the left and right inside horizontally rising plate portions at the storage recess.

20. A sealing member according to claim 18, further comprising a vertically rising plate portion erected forwardly in the vertical direction at a bottom of the base plate portion.

21. A sealing member according to claim 18, wherein the left and right lateral elastic materials are made of either a rubber elastic material or a foam body.

22. A sealing member according to claim 18, wherein the base plate portion comprises a plurality of through holes at positions corresponding to a nail hole and a screw hole formed in the fastening fitting.

23. A siding boards attachment structure of the left, right, upper, and lower four-sided shiplap structure for disposing the four siding boards on the underlayment by using the sealing member according to claim 18 and the fastening fitting, the siding boards attachment structure comprising:

the fastening fitting including a fixing plate portion abutting against rear surfaces of the four siding boards arranged vertically, a supporting portion erected forwardly over a full width of the fixing plate portion, an upper board engaging portion bent diagonally upwardly from a front of the supporting portion, a lower board engaging portion bent diagonally downwardly from the front of the supporting portion, and a front flat plate continuously provided between a tip end of the upper board engaging portion and a tip end of the lower board engaging portion, wherein the sealing member and the fastening fitting, disposed at a storage recess of the sealing member, are fixed to the underlayment together via a fastening, wherein a first two adjacent siding boards of the four siding boards are disposed downwardly of the fastening fitting so that an upper underlying tongue portion is engagingly locked with the lower board engaging portion of the fastening fitting and the left and right inside downwardly inclined portions of the sealing member, wherein a second two adjacent siding boards of the four siding boards are disposed upwardly of the fastening fitting so that a lower overlying tongue portion is disposed on the supporting portion of the fastening fitting and is engagingly locked with the upper board engaging portion of the fastening fitting and the outside left and right upwardly inclined portions of the sealing member, wherein, at each of the siding boards, caulking materials are attached either on front faces of the upper underlying tongue portion and a lateral underlying tongue portion at a first one of left and right sides of the siding board or on rear faces of the lower overlying tongue portion and a lateral overlying tongue portion at a second one of left and right sides of the siding board, wherein left and right lateral elastic materials of the sealing member are in close contact with rear surfaces of the lower overlying tongue portions of the second two adjacent siding boards, and wherein a water conduit, communicating from a joint clearance portion of the second two adjacent siding boards and the first two adjacent siding boards forwardly of a wall face, is formed at top face sides of the left and right inside horizontally rising plate portions and the left and right inside downwardly inclined portions.

24. A siding boards attachment structure according to claim 23, further comprising a backward elastic material continuously provided between the left and right inside horizontally rising plate portions at the storage recess of the sealing member, wherein the backward elastic material comes into close contact with a rear surface of the fixing plate portion of the fastening fitting.

25. A siding boards attachment structure according to claim 23, further comprising a vertically rising plate portion erected forwardly in a vertical direction at a bottom of the base plate portion of the sealing member, wherein the lateral underlying tongue portion of a lower siding board of the four siding boards abuts against the vertically rising plate portion.

26. A method of constructing a siding boards attachment structure, the method comprising the steps of:

a first step of disposing a first siding board of four siding boards at an underlayment;

a second step of jointing a lateral overlying tongue portion of a second siding board of four siding boards at a lateral underlying tongue portion of the first siding board through a left-right side shiplap joint, and disposing the second siding board at the underlayment;

a third step of inserting a base plate portion of a sealing member and a fixing plate portion of a fastening fitting between the underlayment and the first and second siding boards in a state where the fastening fitting is disposed at a storage recess of the sealing member;

a fourth step of engagingly locking a lower board engaging portion of the fastening fitting with an upper underlying tongue portion of the first siding board, and engagingly locking an inside downwardly inclined portion of the sealing member with the upper underlying tongue portion of the first siding board, thereby fixing the sealing member and the fastening fitting to the underlayment via a fastening;

a fifth step of mounting a third siding board of the four siding boards so that a lower overlying tongue portion of the third siding board is superimposed on the upper underlying tongue portion of the first siding board, and is engagingly locked with an upper board engaging portion of the fastening fitting and an outside upwardly inclined portion of the sealing member; and a sixth step of disposing of a fourth siding board of the four siding boards so that a lower overlying tongue portion of the fourth siding board is superimposed on an upper underlying tongue portion of the second siding board, a lateral overlying tongue portion of the fourth siding board is superimposed on a lateral underlying tongue portion of the third siding board, and the lower overlying tongue portion of the fourth siding board is engagingly locked with an upper board engaging portion of the fastening fitting and the outside upwardly inclined portion of the sealing member, wherein in the fifth and sixth steps, a lower overlying tongue portion and a rear surface of the third siding board and the lower overlying tongue portion and a rear surface of the fourth siding board are brought into close contact with left and right lateral elastic materials of the sealing member.

27. A method of constructing the siding boards attachment structure according to claim 26, further comprising providing a vertically rising plate portion erected forwardly in a vertical direction at a bottom of the base plate portion of the sealing member, wherein at the third step, inserting the vertically rising plate portion into a rear joint clearance at a side adjacent a rear face of the first and second siding boards which are situated left and right of each other, and at the fourth step, pressing the vertically rising plate portion against the lateral underlying tongue portion of the first siding board, thereby fixing the sealing member to the underlayment.

* * * * *